US010448170B2

(12) United States Patent
Fukami et al.

(10) Patent No.: US 10,448,170 B2
(45) Date of Patent: Oct. 15, 2019

(54) SOUND GENERATOR AND SOUND GENERATION SYSTEM

(71) Applicant: KYOCERA CORPORATION, Kyoto (JP)

(72) Inventors: Satoshi Fukami, Kawasaki (JP); Hiroshi Taimura, Yokohama (JP); Atsuo Chiba, Yokohama (JP); Yuta Sakamoto, Kawasaki (JP); Akinori Wada, Kawasaki (JP); Daisuke Tsuiki, Tokyo (JP); Takashi Ikegami, Yokohama (JP); Kazuya Sono, Yokohama (JP); Hideaki Fujimoto, Yokohama (JP); Seiji Horii, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 15/825,252

(22) Filed: Nov. 29, 2017

(65) Prior Publication Data

US 2018/0084347 A1 Mar. 22, 2018

Related U.S. Application Data

(63) Continuation of application No. 14/499,630, filed on Sep. 29, 2014.

(30) Foreign Application Priority Data

Oct. 30, 2013 (JP) ..... 2013-225413
Dec. 24, 2013 (JP) ..... 2013-265928
(Continued)

(51) Int. Cl.
*H04R 17/00* (2006.01)
*B06B 1/02* (2006.01)
(Continued)

(52) U.S. Cl.
CPC ..... *H04R 17/00* (2013.01); *B06B 1/0253* (2013.01); *B06B 1/0603* (2013.01);
(Continued)

(58) Field of Classification Search
CPC . H04R 17/00; H04R 3/04; H04R 3/12; H04R 2420/01; H04R 2420/03;
(Continued)

(56) References Cited

U.S. PATENT DOCUMENTS 8,139,762 B2 3/2012 Kuroda et al.
8,536,766 B2 9/2013 Uetani et al.
(Continued)

FOREIGN PATENT DOCUMENTS

JP H05-85192 U 11/1993
JP H09-252496 A 9/1997
(Continued)

OTHER PUBLICATIONS

An Office Action issued by the Japanese Patent Office dated Nov. 28, 2017, which corresponds to Japanese Patent Application No. 2014-067089 and is related to U.S. Appl. No. 15/825,252; with English language Concise Explanation.
(Continued)

*Primary Examiner* — Norman Yu
(74) *Attorney, Agent, or Firm* — Studebaker & Brackett PC

(57) ABSTRACT

A sound generator includes at least one piezoelectric vibrator including a piezoelectric element, a vibration unit in one of a non-contact state not contacting the at least one piezoelectric vibrator and a contact state contacting the at least one piezoelectric vibrator. While in the contact state, the at least one piezoelectric vibrator generates vibration in response to a signal, and causes a contact surface contacted by the vibration unit to vibrate and generate a sound to be
(Continued)

emitted from the contact surface. The sound generator can detect driving allowed and driving denied states, and control application of a sound signal in accordance with the two states to the piezoelectric element.

5 Claims, 60 Drawing Sheets

(30) Foreign Application Priority Data

Dec. 24, 2013 (JP) ..... 2013-266027
Mar. 27, 2014 (JP) ..... 2014-066653
Mar. 27, 2014 (JP) ..... 2014-067089

(51) Int. Cl.
*B06B 1/06* (2006.01)
*H04R 3/04* (2006.01)
*H04R 3/12* (2006.01)

(52) U.S. Cl.
CPC ..... *B06B 1/0611* (2013.01); *H04R 3/04* (2013.01); *H04R 3/12* (2013.01); *H04R 2420/01* (2013.01); *H04R 2420/03* (2013.01); *H04R 2420/05* (2013.01); *H04R 2499/11* (2013.01); *H04R 2499/15* (2013.01)

(58) Field of Classification Search
CPC ..... H04R 2420/05; H04R 2499/11; H04R 2499/15; B06B 1/0253; B06B 1/0603; B06B 1/0611
USPC ..... 381/334, 151, 152, 337, 339, 162, 380, 381/190, 191
See application file for complete search history.

(56) References Cited

U.S. PATENT DOCUMENTS

| | | | | |
|---|---|---|---|---|
| 9,478,725 | B2 | 10/2016 | Kato | |
| 9,615,178 | B2 | 4/2017 | Fukami et al. | |
| 2006/0239479 | A1* | 10/2006 | Schobben | H04M 1/0266 381/306 |
| 2007/0057601 | A1 | 3/2007 | Kawase et al. | |
| 2009/0003630 | A1 | 1/2009 | Kuroda et al. | |
| 2009/0045700 | A1 | 2/2009 | Sasaki et al. | |
| 2011/0266962 | A1 | 11/2011 | Uetani et al. | |
| 2012/0121098 | A1 | 5/2012 | Gautama | |
| 2012/0281345 | A1 | 11/2012 | Masaki et al. | |
| 2014/0020659 | A1 | 1/2014 | Kato | |
| 2014/0364681 | A1 | 12/2014 | Hillbratt et al. | |

FOREIGN PATENT DOCUMENTS

| | | | |
|---|---|---|---|
| JP | 2002-119074 | A | 4/2002 |
| JP | 2002-369290 | A | 12/2002 |
| JP | 2005-130149 | A | 5/2005 |
| JP | 2006-140740 | A | 6/2006 |
| JP | 2006-253735 | A | 9/2006 |
| JP | 2006-525734 | A | 11/2006 |
| JP | 2007-074663 | A | 3/2007 |
| JP | 2008-263080 | A | 10/2008 |
| JP | 2009-027320 | A | 2/2009 |
| JP | 2009-027413 | A | 2/2009 |
| JP | 2009-053502 | A | 3/2009 |
| JP | 2011-071691 | A | 4/2011 |
| JP | 2011-141330 | A | 7/2011 |
| JP | 2011-175127 | A | 9/2011 |
| JP | 2011-182368 | A | 9/2011 |
| JP | 2012-103520 | A | 5/2012 |
| JP | 2013-009236 | A | 1/2013 |
| JP | 2013-077002 | A | 4/2013 |
| JP | 2013-223213 | A | 10/2013 |
| JP | 2014-027569 | A | 2/2014 |
| JP | 2014-127794 | A | 7/2014 |
| JP | 2015-088902 | A | 5/2015 |
| WO | 2007/086524 | A1 | 8/2007 |
| WO | 2011/122416 | A1 | 10/2011 |
| WO | 2012/115230 | A1 | 8/2012 |

OTHER PUBLICATIONS

An Office Action issued by the United States Patent and Trademark Office dated Jun. 29, 2017, which corresponds to U.S. Appl. No. 15/386,352 and is related to U.S. Appl. No. 14/499,630.
An Office Action; "Notice of Reasons for Rejection," issued by the Japanese Patent Office dated Jun. 6, 2017, which corresponds to Japanese Patent Application No. 2014-066653 and is related to U.S. Appl. No. 14/499,630; with English language Concise Explanation.
JP Office Action dated Apr. 25, 2017, from corresponding JP Appl No. 2014-067089, with English Statement of Relevance, 3 pp.
JP Office Action dated Dec. 20, 2016 from corresponding JP Appl No. 2013-265928, with concise statement of relevance, 4 pp.
An Office Action; "Notice of Reasons for Rejection," issued by the Japanese Patent Office dated Sep. 20, 2016, which corresponds to Japanese Patent Application No. 2013-225411 and is related to U.S. Appl. No. 14/499,630; with English language concise explanation.
An Office Action; "Notice of Reasons for Rejection," issued by the Japanese Patent Office dated Sep. 20, 2016, which corresponds to Japanese Patent Application No. 2013-225413 and is related to U.S. Appl. No. 14/499,630; with English language concise explanation.
An Office Action; "Notice of Reasons for Rejection," issued by the Japanese Patent Office dated Sep. 20, 2016, which corresponds to Japanese Patent Application No. 2013-225415 and is related to U.S. Appl. No. 14/499,630; with English language concise explanation.
An Office Action issued by the Japanese Patent Office dated Nov. 7, 2017, which corresponds to Japanese Patent Application No. 2016-206198 and is related to U.S. Appl. No. 15/825,252; with English language Concise Explanation.

* cited by examiner

A-A cross-section

A-A cross-section

SOUND GENERATOR AND SOUND GENERATION SYSTEM

CROSS-REFERENCE TO RELATED APPLICATIONS

This application is a Continuation Application of U.S. patent application Ser. No. 14/499,630 filed Sep. 29, 2014, which claims priority to and the benefit of Japanese Patent Application No. 2013-225413 filed Oct. 30, 2013, Japanese Patent Application No. 2013-265928 filed Dec. 24, 2013, Japanese Patent Application No. 2013-266027 filed Dec. 24, 2013, Japanese Patent Application No. 2014-066653 filed Mar. 27, 2014, and Japanese Patent Application No. 2014-067089 filed Mar. 27, 2014, the entire contents of which are incorporated herein by reference.

TECHNICAL FIELD

The present disclosure relates to a sound generator and a sound generation system that vibrate a contact surface contacted by the sound generator, causing sound to be emitted from the contact surface.

BACKGROUND

Patent Literature 1, for example, discloses a vibration generating device. The vibration generating device disclosed in Patent Literature 1 has a dynamic speaker configuration provided with a magnet, a voice coil, and a diaphragm, as well as a case housing these elements. Patent Literature 2 discloses a vibration generating device that includes an anchor formed from an elastic body and that causes the anchor to deform, such as by flexing, due to vibration of a piezoelectric vibrator, with a vibrated body being vibrated by this deformation. Patent Literature 3 discloses a vibration generating device in which an elastic body that receives the load of an anchor deforms, such as by flexing, due to vibration of a piezoelectric vibrator, with a vibrated body being vibrated by this deformation. Patent Literature 4 discloses a vibration generating device in which an elastic body deforms, such as by flexing, due to vibration of a piezoelectric vibrator, with a vibrated body being vibrated by this deformation.

CITATION LIST

Patent Literature 1: JP H05-085192 U
Patent Literature 2: JP 2007-074663 A
Patent Literature 3: JP 2009-027413 A
Patent Literature 4: JP 2009-027320 A

SUMMARY

Since the vibration generating device disclosed in Patent Literature 1 has a dynamic speaker configuration and uses a variety of components, such as a magnet, a voice coil, a diaphragm, and a case housing these elements, the number of components in the device necessarily increases. The devices disclosed in Patent Literature 2 through Patent Literature 4 use a piezoelectric element as the vibrating body, and it is necessary to provide space sufficient for the elastic body to flex within these devices in order to ensure a certain degree of freedom for deformation of the elastic body. An increase in size in these devices is thus unavoidable.

The present disclosure has been conceived in light of the above considerations and provides a sound generator with a simple structure.

A sound generator according to the present disclosure includes: at least one piezoelectric vibrator including a piezoelectric element; an anchor applying a load to the piezoelectric vibrator; and a control unit configured to control an input voltage based on a frequency characteristic, the input voltage being applied to the piezoelectric element as a sound signal, such that while the load from the anchor is being applied to the piezoelectric vibrator, the piezoelectric vibrator deforms in accordance with the input voltage applied to the piezoelectric element from the control unit, and deformation of the piezoelectric vibrator vibrates a contact surface contacted by the sound generator, causing sound to be emitted from the contact surface.

The control unit may control the input voltage to be a predetermined value.

The sound generator may further include a measurement unit configured to measure the frequency characteristic, and the control unit may control the input voltage based on the frequency characteristic measured by the measurement unit.

The frequency characteristic may be a frequency characteristic of sound pressure.

The frequency characteristic may be a frequency characteristic with respect to amplitude of vibration.

A sound generator according to the present disclosure includes: a piezoelectric vibrator including a piezoelectric element; an anchor applying a load to the piezoelectric vibrator; a voltage measurement unit configured to measure output voltage of the piezoelectric element; and a control unit configured to control an input voltage based on the output voltage measured by the voltage measurement unit and based on a frequency characteristic, the input voltage being applied to the piezoelectric element as a sound signal, such that while the load from the anchor is being applied to the piezoelectric vibrator, the piezoelectric vibrator deforms in accordance with the input voltage applied to the piezoelectric element from the control unit, and deformation of the piezoelectric vibrator vibrates a contact surface contacted by the sound generator, causing sound to be emitted from the contact surface.

The control unit may control the input voltage so that the output voltage is a predetermined value.

A sound generator according to the present disclosure includes: a housing; at least one piezoelectric vibrator including a piezoelectric element disposed within the housing; a vibration unit in one of a non-contact state not contacting the piezoelectric vibrator and a contact state contacting the piezoelectric vibrator; and an anchor applying a load to the vibration unit via the piezoelectric vibrator, such that while the vibration unit is in the contact state and the load from the anchor is being applied to the vibration unit, the piezoelectric vibrator deforms in response to a sound signal, and deformation of the piezoelectric vibrator vibrates a contact surface contacted by the vibration unit, causing sound to be emitted from the contact surface.

The sound generator may further include a cover, including the vibration unit, disposed displaceably in the housing. At a first position, the cover may place the vibration unit in the contact state, and at a second position, the cover may place the vibration unit in the non-contact state and protect the piezoelectric vibrator.

The piezoelectric element may be driven when the cover is in the first position and not driven when the cover is in the second position.

The vibration unit may include a cover member that vibrates the contact surface by transmitting vibration due to the piezoelectric vibrator to the contact surface.

A sound generator according to the present disclosure includes: at least one piezoelectric vibrator including a piezoelectric element; an anchor applying a load to the piezoelectric vibrator; a detection unit configured to detect two states, the two states being a driving allowed state that allows driving of the piezoelectric element and a driving denied state that denies driving of the piezoelectric element; and a control unit configured to control application of a sound signal in accordance with the two states, such that while the load from the anchor is being applied to the piezoelectric vibrator, the piezoelectric vibrator deforms upon application of the sound signal to the piezoelectric element from the control unit, and deformation of the piezoelectric vibrator vibrates a contact surface contacted by the sound generator, causing sound to be emitted from the contact surface.

When the detection unit detects the driving allowed state, the control unit may apply the sound signal to the piezoelectric element.

When the detection unit detects the driving denied state, the control unit may suspend application of the sound signal to the piezoelectric element.

The sound generator may further include a speaker; wherein when the detection unit detects the driving denied state, the control unit applies the sound signal to the speaker.

The detection unit may include at least one selected from the group consisting of an inclination detection sensor detecting inclination of the piezoelectric element, a microphone detecting sound emitted from the contact surface, a vibration detection sensor detecting vibration of the sound generator, a proximity sensor detecting presence of a detection target, and a wireless communication unit acquiring information on a position of the sound generator by wireless communication.

The detection unit may periodically detect the two states.

A sound generator according to the present disclosure includes: a speaker; a piezoelectric vibrator including a piezoelectric element; an anchor applying a load to the piezoelectric vibrator; a detection unit configured to detect two states with each of a first detection mechanism and a second detection mechanism, the two states being a driving allowed state that allows driving of the piezoelectric element and a driving denied state that denies driving of the piezoelectric element; and a control unit configured to control application of a sound signal in accordance with the two states, such that while the load from the anchor is being applied to the piezoelectric vibrator, the piezoelectric vibrator deforms upon application of the sound signal to the piezoelectric element from the control unit, and deformation of the piezoelectric vibrator vibrates a contact surface contacted by the sound generator, causing sound to be emitted from the contact surface.

When the detection unit detects the driving allowed state with both the first detection mechanism and the second detection mechanism, the control unit may apply the sound signal to the piezoelectric element and suspend application of the sound signal to the speaker.

When the detection unit detects the driving denied state with either of the first detection mechanism and the second detection mechanism, the control unit may suspend application of the sound signal to the piezoelectric element and apply the sound signal to the speaker.

A sound generator according to the present disclosure includes: at least one piezoelectric vibrator including a piezoelectric element; and at least one permanent magnet, such that while the piezoelectric vibrator is pressed against a contact surface due to a magnetic force of the permanent magnet, upon application of a sound signal to the piezoelectric element, the piezoelectric element deforms and the piezoelectric vibrator deforms, and deformation of the piezoelectric vibrator vibrates the contact surface, causing sound to be emitted from the contact surface.

The piezoelectric element may be a laminated piezoelectric element that deforms by expanding and contracting along a lamination direction.

The piezoelectric vibrator may include a cover member that vibrates the contact surface by transmitting vibration due to deformation of the piezoelectric element to the contact surface.

The sound signal may be a signal having at least a portion of a frequency component thereof cut or attenuated, the frequency component being higher than a predetermined threshold.

The sound signal may be a signal such that as frequency becomes higher than the predetermined threshold, an attenuation rate increases gradually or stepwise.

The sound signal may be a signal having at least the portion of the frequency component thereof cut or attenuated by a filter, the frequency component being higher than the predetermined threshold.

The sound signal may be a playback sound signal for music or speech, and music or speech may be caused to be emitted from the contact surface.

The sound generator may further include a wireless unit, and the sound signal may be generated based on a signal received by the wireless unit.

The sound generator may further include a line-in port, and the sound signal may be generated based on a line-in signal input into the line-in port.

The at least one permanent magnet may be arranged in a plane perpendicular to a deformation direction of the piezoelectric vibrator in a symmetrical positional relationship with respect to a portion of the piezoelectric vibrator contacting the contact surface.

The permanent magnet may be magnetized in a deformation direction of the piezoelectric vibrator.

The permanent magnet may be magnetized in a direction perpendicular to a deformation direction of the piezoelectric vibrator.

The contact surface may be a mounting surface on which the sound generator is mounted.

A sound generation system according to the present disclosure includes: any one of the above sound generators; and a vibration transmission member capable of attaching magnetically to the permanent magnet, such that while the vibration transmission member is mounted on a mounting surface and the piezoelectric vibrator is pressed against a contact surface of the vibration transmission member due to a magnetic force of the permanent magnet, upon application of a sound signal to the piezoelectric element, the piezoelectric element deforms and the piezoelectric vibrator deforms, and deformation of the piezoelectric vibrator vibrates the mounting surface via the vibration transmission member, causing sound to be emitted from the mounting surface.

The at least one piezoelectric vibrator may include a plurality of piezoelectric vibrators.

According to the present disclosure with the above structure, it is possible to provide a sound generator that has a simple structure.

A sound generator according to the present disclosure includes a housing, at least one piezoelectric vibrator including a piezoelectric element disposed within the housing, and a vibration unit in one of a non-contact state not contacting the at least one piezoelectric vibrator and a contact state contacting the at least one piezoelectric vibrator. While the vibration unit is in the contact state, the at least one piezoelectric vibrator generates vibration in response to a signal, and causes a contact surface contacted by the vibration unit to vibrate and generate a sound to be emitted from the contact surface.

A sound generator according to the present disclosure includes at least one piezoelectric vibrator including a piezoelectric element, a detection unit configured to detect two states, the two states being a driving allowed state that allows driving of the piezoelectric element and a driving denied state that denies driving of the piezoelectric element, and a control unit configured to control application of a sound signal in accordance with the two states. The at least one piezoelectric vibrator generates vibration upon application of the sound signal to the piezoelectric element from the control unit, and causes a contact surface contacted by the sound generator to vibrate and generate a sound to be emitted from the contact surface.

A sound generator according to the present disclosure includes a speaker, a piezoelectric vibrator including a piezoelectric element, a detection unit configured to detect two states with each of a first detection mechanism and a second detection mechanism, the two states being a driving allowed state that allows driving of the piezoelectric element and a driving denied state that denies driving of the piezoelectric element, and a control unit configured to control application of a sound signal in accordance with the two states. The piezoelectric vibrator generates vibration upon application of the sound signal to the piezoelectric element from the control unit, and causes a contact surface contacted by the sound generator to vibrate and generate a sound to be emitted from the contact surface.

BRIEF DESCRIPTION OF DRAWINGS

The present disclosure will be further described below with reference to the accompanying drawings, wherein.

DESCRIPTION OF EMBODIMENTS

The following describes embodiments of the present disclosure with reference to the drawings.

Embodiment 1

Figure 1:
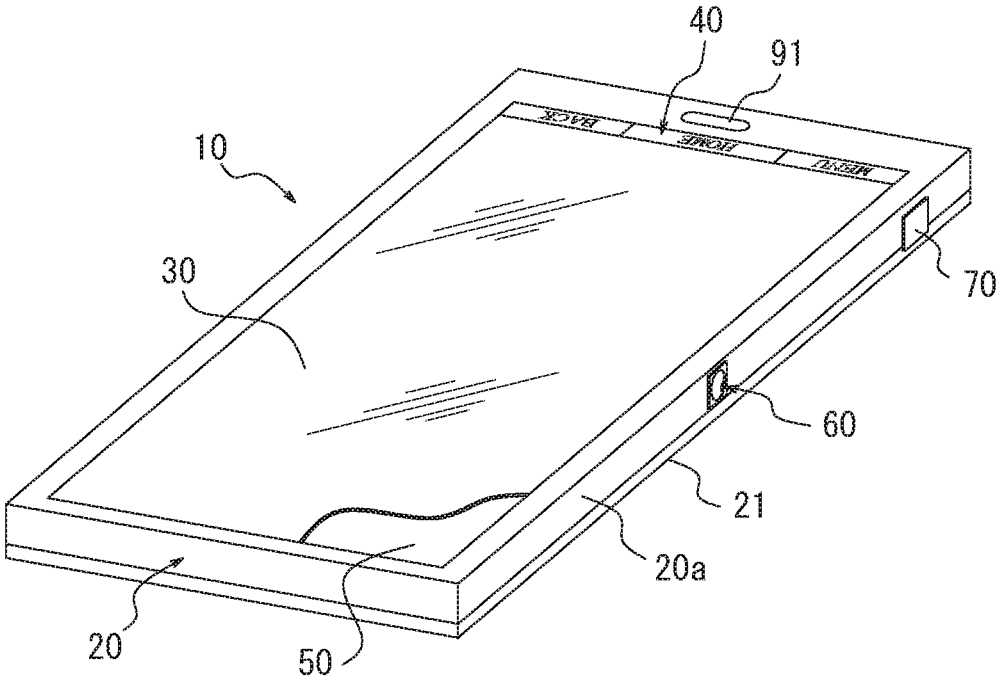
FIG. 1 is an external perspective view schematically illustrating the structure of a sound generator according to Embodiment 1 of the present disclosure.

FIG. 1 is an external perspective view of a sound generator according to Embodiment 1 of the present disclosure.

The sound generator according to the present embodiment includes a mobile phone 10, such as a smartphone, a piezoelectric vibrator 60, and an elastic member 70. As described below, the mobile phone 10 acts as an anchor (the anchor in the sound generator) providing a load to the piezoelectric vibrator 60. The mobile phone 10 includes a housing 20 having an approximately rectangular external shape. In the housing 20, a panel 30, an input unit 40, and a microphone 91 are provided at the front side of the mobile phone 10, and as illustrated by the partial cutout of the panel 30 in FIG. 1, a display unit 50 is held below the panel 30. A battery pack, camera unit, and the like are installed at the back side of the housing 20 and covered by a battery lid 21.

The panel 30 is configured using a touch panel that detects contact, a cover panel that protects the display unit 50, or the like and is, for example, made from glass or a synthetic resin such as acrylic or the like. The panel 30 is, for example, rectangular. The panel 30 may be a flat plate or may be a curved panel, the surface of which is smoothly inclined. When the panel 30 is a touch panel, the panel 30 detects contact by the user's finger, a pen, a stylus pen, or the like. Any detection system may be used in the touch panel, such as a capacitive system, a resistive film system, a surface acoustic wave system (or an ultrasonic wave system), an infrared system, an electromagnetic induction system, a load detection system, or the like. In the present embodiment, to simplify explanation, the panel 30 is a touch panel.

The input unit 40 accepts operation input from the user and may be configured, for example, using operation buttons (operation keys). Note that the panel 30 can also accept operation input from the user by detecting contact by the user.

The display unit 50 is a display device such as a liquid crystal display, an organic EL display, an inorganic EL display, or the like.

The sound generator according to the present embodiment includes the piezoelectric vibrator 60 for a sound generator and the sheet-like elastic member 70 on a bottom side 20*a*, which is one of the long sides of the housing 20 in the mobile phone 10. The elastic member 70 may, for example, be formed from rubber, silicone, polyurethane, or the like. When the mobile phone 10 is mounted on a horizontal contact surface, such as a desk, with the bottom side 20*a* downwards, i.e. when stood horizontally, the mobile phone 10 is supported by at least the piezoelectric vibrator 60 and the elastic member 70 that contact the contact surface. The arrangement of the piezoelectric vibrator 60 and the elastic member 70 is described in detail below.

The microphone 91 is used to detect speech of the user during a phone call, detect sound emitted from the contact surface during sound generation by the piezoelectric vibrator 60, and measure the frequency characteristic of sound pressure.

Figure 2:
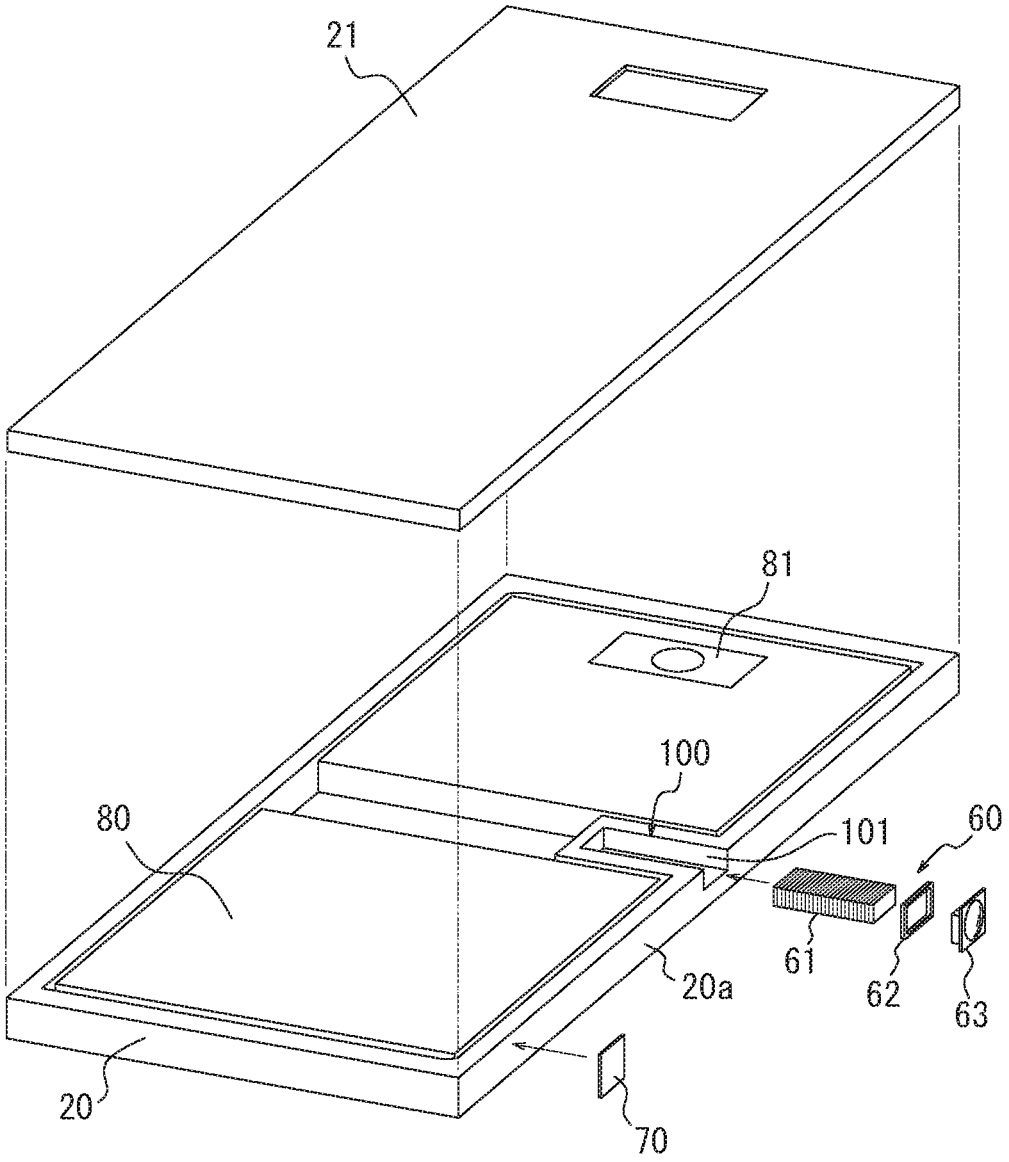
FIG. 2 is an external, exploded perspective view of the main parts at the back side of the mobile phone in FIG. 1.

FIG. 2 is an exploded perspective view schematically illustrating the main parts at the back side of the mobile phone 10 in FIG. 1. A battery pack 80, a camera unit 81, and the like are installed at the back side of the housing 20. At the back side of the housing 20, the mobile phone 10 according to the present embodiment includes a holding unit 100 that houses and holds the piezoelectric vibrator 60. The holding unit 100 includes a slit 101, with a uniform width, that extends along the transverse direction of the housing 20 and opens to the bottom side 20*a*.

The piezoelectric vibrator 60 includes a piezoelectric element 61, an O-ring 62, and an insulating cap 63 that is a cover member. The piezoelectric element is formed by elements that, upon application of an electric signal (voltage), either expand and contract or bend in accordance with the electromechanical coupling coefficient of their constituent material. Ceramic or crystal elements, for example, may be used. The piezoelectric element may be a unimorph, bimorph, or laminated piezoelectric element. Examples of a laminated piezoelectric element include a laminated bimorph element with layers of bimorph (for example, 8 to 40 layers) and a stack-type element configured with a laminated structure formed by a plurality of dielectric layers composed of, for example, lead zirconate titanate (PZT) and electrode layers disposed between the dielectric layers. Unimorph expands and contracts upon the application of an electric signal, bimorph bends upon the application of an electric signal, and a stack-type laminated piezoelectric element expands and contracts along the lamination direction upon the application of an electric signal.

In the present embodiment, the piezoelectric element 61 is a stack-type laminated piezoelectric element. For example as illustrated in the expanded cross-sectional view and plan view in FIG. 3A and FIG. 3B, the laminated piezoelectric element 61 is configured with alternately layered dielectric materials 61*a*, for example formed from ceramic such as PZT or the like, and internal electrodes 61*b* with a cross-sectional comb shape. Internal electrodes 61*b* connecting to a first lateral electrode 61*c* and internal electrodes 61*b* connecting to a second lateral electrode 61*d* are alternately layered and respectively connect to the first lateral electrode 61*c* and the second lateral electrode 61*d* electrically.

Figure 3A:
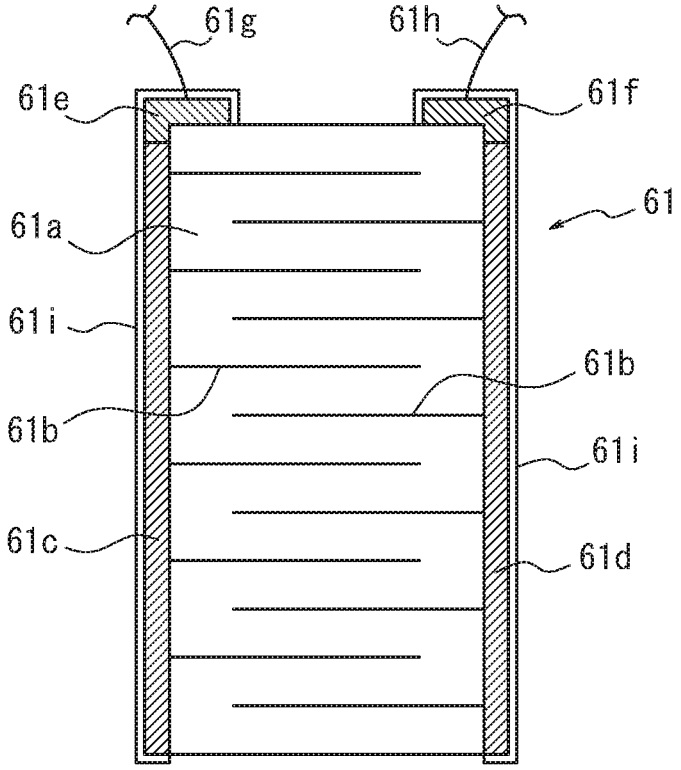
FIG. 3A is an enlarged cross-sectional view illustrating the structure of the laminated piezoelectric element in FIG. 2.
Figure 3B:
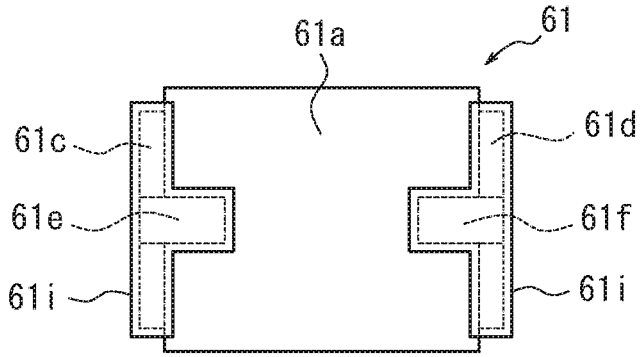
FIG. 3B is an enlarged plan view illustrating the structure of the laminated piezoelectric element in FIG. 2.

The laminated piezoelectric element 61 illustrated in FIG. 3A and FIG. 3B has formed, at one end face, a first lead connector 61*e* electrically connected to the first lateral electrode 61*c* and a second lead connector 61*f* electrically connected to the second lateral electrode 61*d*. A first lead wire 61*g* and a second lead wire 61*h* respectively connect to the first lead connector 61*e* and the second lead connector 61*f*. The first lateral electrode 61*c*, second lateral electrode 61*d*, first lead connector 61*e*, and second lead connector 61*f* are covered by an insulating layer 61*i* in a state with the first lead wire 61*g* and the second lead wire 61*h* respectively connected to the first lead connector 61*e* and the second lead connector 61*f*.

The laminated piezoelectric element 61 has a length of, for example, 5 mm to 120 mm in the lamination direction. The cross-sectional shape of the laminated piezoelectric element 61 in a direction perpendicular to the lamination direction may, for example, be an approximate square between 2 mm square and 10 mm square or may be any shape other than a square. Note that the number of layers and the cross-sectional area of the laminated piezoelectric element 61 are determined appropriately in accordance with the weight of the mobile phone 10 (in the case of a portable electronic device, for example 80 g to 800 g) that serves as an anchor, so as to ensure sufficient pressure or quality of the sound emitted from the contact surface, such as a desk, with which the piezoelectric vibrator 60 is in contact.

As described below with reference to FIG. 6, the laminated piezoelectric element 61 is supplied with a sound signal (playback sound signal) from a control unit 130. In other words, voltage corresponding to a sound signal is applied to the laminated piezoelectric element 61 from the control unit 130. If the voltage applied from the control unit 130 is AC voltage, negative voltage is applied to the second lateral electrode 61*d* when positive voltage is applied to the first lateral electrode 61*c*. Conversely, positive voltage is applied to the second lateral electrode 61*d* when negative voltage is applied to the first lateral electrode 61*c*. Upon voltage being applied to the first lateral electrode 61*c* and the second lateral electrode 61*d*, polarization occurs in the dielectric materials 61*a*, and the laminated piezoelectric element 61 expands and contracts from the state in which no voltage is applied. The laminated piezoelectric element 61 expands and contracts in a direction substantially along the lamination direction of the dielectric materials 61*a* and the internal electrodes 61*b*. Alternatively, the laminated piezoelectric element 61 may expand and contract in a direction substantially matching the lamination direction of the dielectric materials 61*a* and the internal electrodes 61*b*. Having the laminated piezoelectric element 61 expand and contract substantially along the lamination direction yields the advantage of good vibration transmission efficiency in the expansion and contraction direction.

Figure 4:
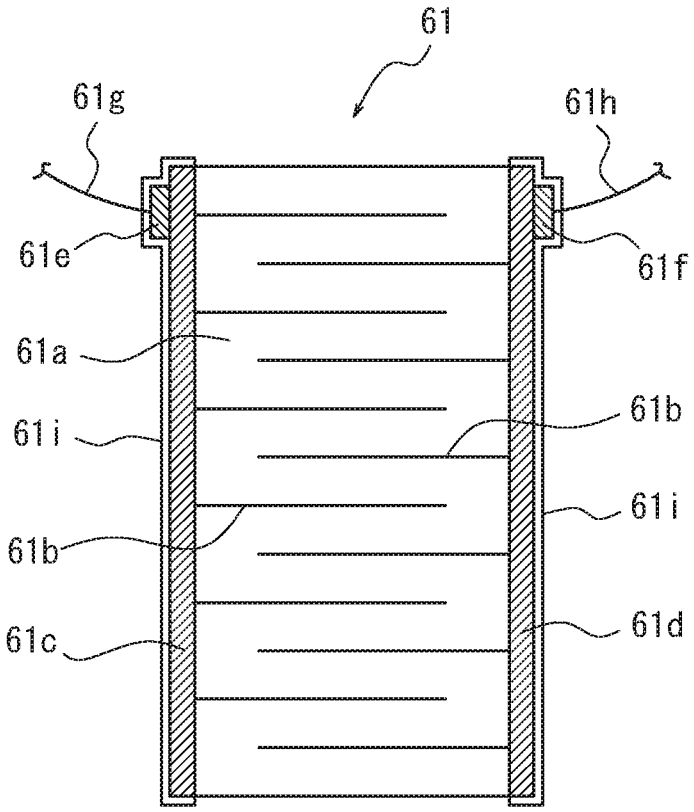
FIG. 4 illustrates a modification to the laminated piezoelectric element.

Note that in FIG. 3A and FIG. 3B, the first lateral electrode 61*c* and the second lateral electrode 61*d* may be through holes that are alternately connected to the internal electrodes 61*b* and respectively connected to the first lead connector 61*e* and second lead connector 61*f*. Furthermore, in FIG. 3A and FIG. 3B, the first lead connector 61*e* and the second lead connector 61*f* may, as illustrated in FIG. 4, be formed on the first lateral electrode 61*c* and the second lateral electrode 61*d* at one edge of the laminated piezoelectric element 61.

Figure 5:
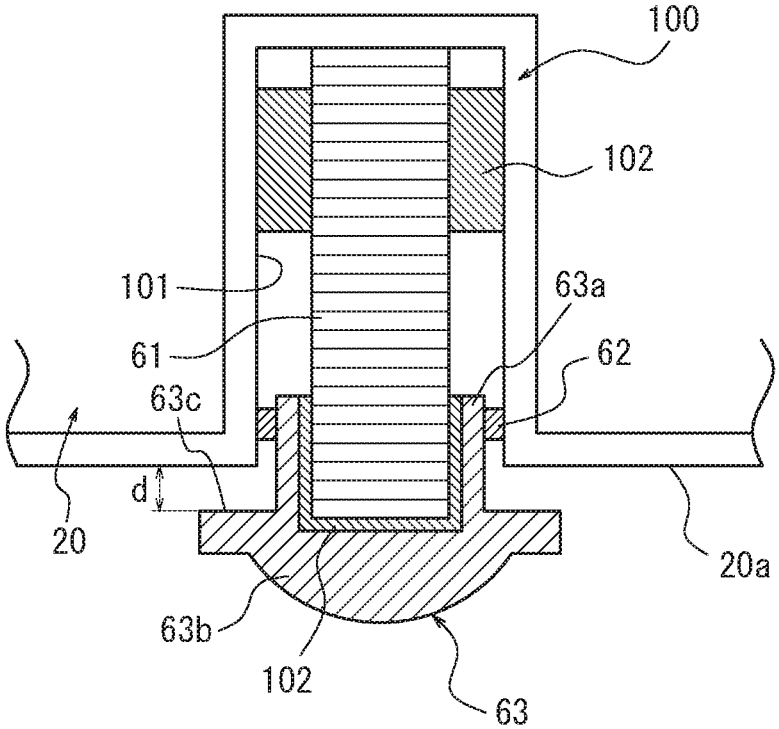
FIG. 5 is a partially enlarged cross-sectional view of the piezoelectric vibrator in FIG. 1.

As illustrated in the partially enlarged cross-sectional view in FIG. 5, the end of the laminated piezoelectric element 61 including the first lead connector 61*e* and the second lead connector 61*f* is fixed in the slit 101 of the holding unit 100 in the housing 20 via adhesive 102 (for example, epoxy resin). The cap 63 is inserted onto the other end of the laminated piezoelectric element 61 and fixed by adhesive 102.

The cap 63 is formed from a material, such as hard plastic or the like, that can reliably transmit the expanding and contracting vibration of the laminated piezoelectric element 61 to the contact surface, such as a desk. In order to suppress scratching of the contact surface 150, the cap 63 may be made from a relatively soft plastic instead of hard plastic. With the cap 63 mounted on the laminated piezoelectric element 61, an entering portion 63*a*located in the slit 101 and a protrusion 63*b* protruding from the housing 20 are formed in the cap 63. The O-ring 62 is disposed on the outer circumference of the entering portion 63*a* located in the slit 101. The O-ring 62 may, for example, be formed from silicone rubber. The O-ring 62 is for movably holding the laminated piezoelectric element 61 and also makes it difficult for moisture or dust to enter into the slit 101. The tip of the protrusion 63*b* is formed in a hemispherical shape. The tip of the protrusion 63*b* is not limited to being hemispherical, however, and may be any shape that reliably has point contact or surface contact with the contact surface, such as a desk, and can transmit the expanding and contracting vibration of the laminated piezoelectric element 61 to the mounting surface. In FIG. 5, the space between the O-ring 62 and the portion of the laminated piezoelectric element 61 adhered to the slit 101 may be filled with gel or the like to increase the effect of dust and moisture protection. In a state in which the piezoelectric vibrator 60 is mounted in the holding unit 100 and the battery lid 21 is mounted on the housing 20, the protrusion 63*b* of the cap 63 protrudes from the bottom side 20*a* of the housing 20. The protrusion 63*b* of the cap 63 has an opposing face 63*c* that is a surface facing the bottom side 20*a* of the housing 20. As illustrated in FIG. 5, in a state in which no voltage is applied to the laminated piezoelectric element 61 so that the laminated piezoelectric element 61 is not expanding or contracting, the opposing face 63*c* is at a distance of d from the bottom side 20*a*.

Figure 6:
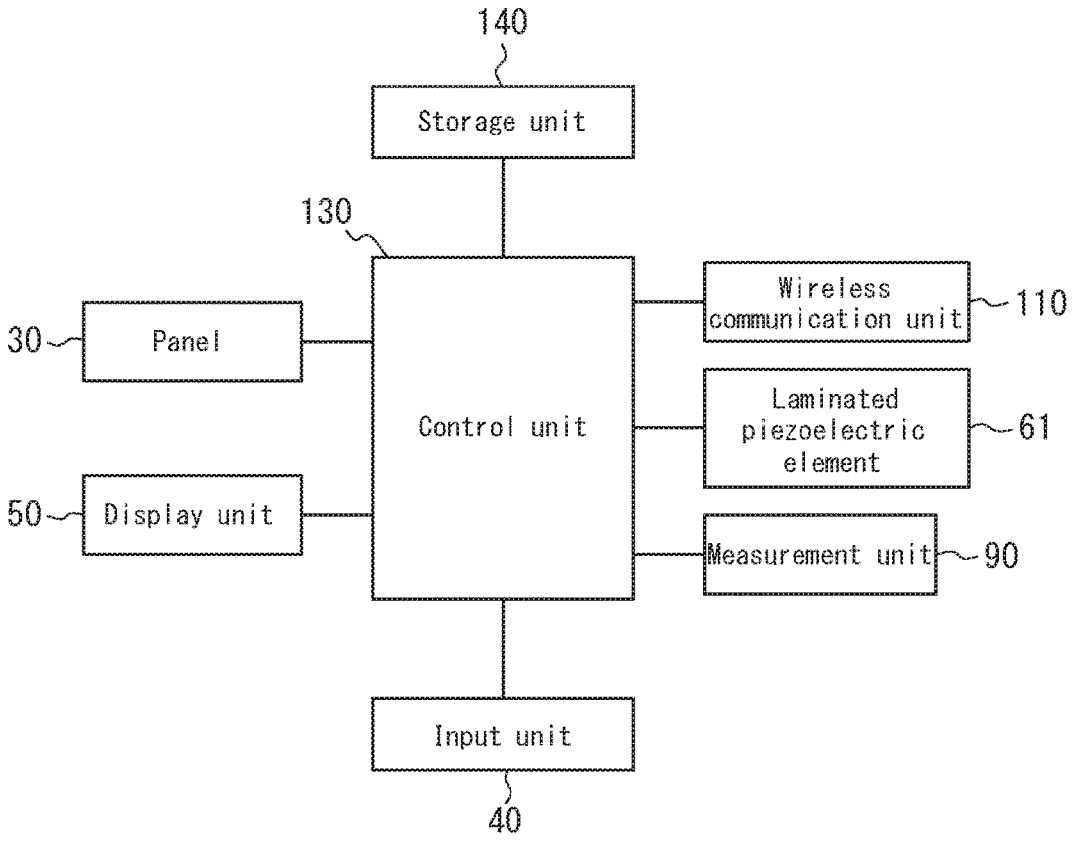
FIG. 6 is a functional block diagram of the main portions of the mobile phone in FIG. 1.

FIG. 6 is a functional block diagram of the main portions of the mobile phone 10 according to the present embodiment. In addition to the above-described panel 30, input unit 40, display unit 50, and laminated piezoelectric element 61, the mobile phone 10 includes a measurement unit 90, a wireless communication unit 110, the control unit 130, and a storage unit 140. The panel 30, input unit 40, display unit 50, measurement unit 90, wireless communication unit 110, and storage unit 140 connect to the control unit 130. The laminated piezoelectric element 61 is connected to a digital signal processor (DSP) provided in the control unit 130.

The measurement unit 90 measures a frequency characteristic when the laminated piezoelectric element 61 is used to cause sound to be emitted from the contact surface. In the present embodiment, the measurement unit 90 includes a microphone 91 and measures the frequency characteristic of sound pressure emitted by the contact surface based on output of the microphone 91.

The wireless communication unit 110 may have a well-known structure and connects wirelessly to a communication network via a base station or the like. The storage unit 140 stores a variety of information, such as the frequency characteristic measured by the measurement unit 90. The control unit 130 is a processor that controls overall operations of the mobile phone 10. The control unit 130 controls the input voltage that is applied to the laminated piezoelectric element 61 as a playback sound signal (voltage corresponding to a playback sound signal of the other party's voice, a ringtone, music including songs, or the like). Note that the playback sound signal may be based on music data stored in internal memory or may be music data stored on an external server or the like and played back over a network.

Figure 7A:
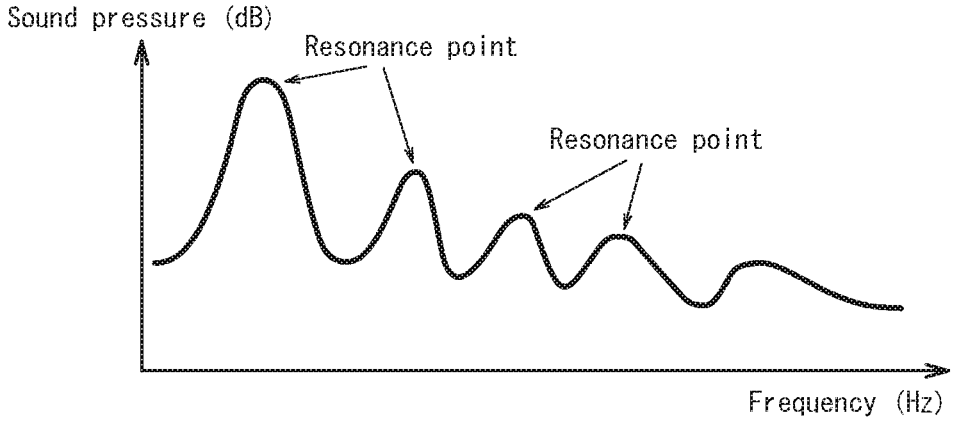
FIG. 7A schematically illustrates an example of a frequency characteristic of sound generated using a laminated piezoelectric element.
Figure 7B:
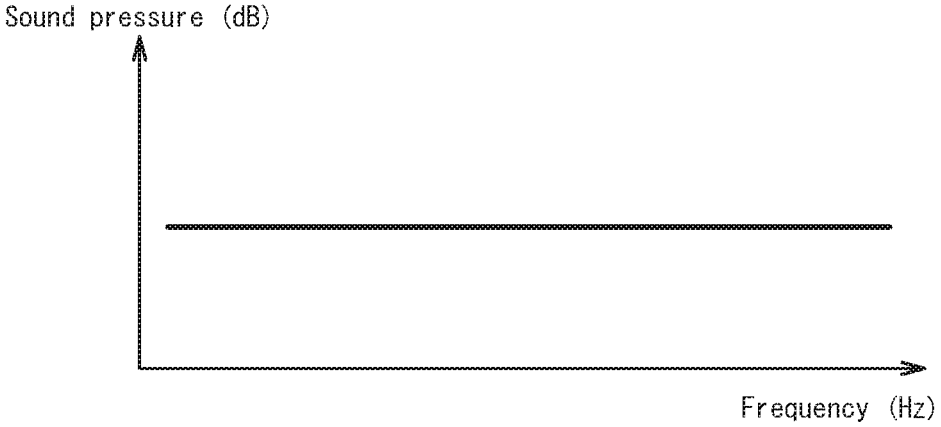
FIG. 7B schematically illustrates an example of a target frequency characteristic of sound generated using a laminated piezoelectric element.

The control performed by the control unit 130 is now described in detail. When the laminated piezoelectric element 61 is used to cause sound to be emitted, sound with a desired frequency characteristic is preferably emitted. Even if a sound signal with the same voltage is applied to the laminated piezoelectric element 61 at each frequency, however, the volume of the emitted sound might not be uniform. In greater detail, for example when the frequency of the sound signal applied to the laminated piezoelectric element 61 matches the resonance frequency of the mobile phone 10 or matches the resonance frequency of the contact surface, then as schematically illustrated in FIG. 7A, a more intense sound is generated as compared to when a sound signal at other frequencies is applied to the laminated piezoelectric element 61. Such a large difference in intensity of the sound pressure based on frequency is inconvenient for the user. Therefore, the control unit 130 controls the input voltage based on a frequency characteristic so that the sound emitted from the contact surface has a target frequency characteristic. The target frequency characteristic may be any frequency characteristic, for example a frequency characteristic such that the sound pressure is uniform at all frequencies, as schematically illustrated in FIG. 7B. The target frequency characteristic may, for example, be such that the sound pressure is reduced as the frequency grows higher, or such that the sound pressure of a predetermined frequency band is intensified or reduced.

In order to perform such control, the control unit 130 is, for example, provided with a digital signal processor (DSP) that includes an equalizer, A/D converter circuit, or the like and performs necessary signal processing, such as equalizing, D/A conversion, or the like on a digital signal to generate an input voltage as an analog playback sound signal, applying the input voltage to the laminated piezoelectric element 61. The DSP may be provided in the mobile phone 10 independently from the control unit 130. In this case, the laminated piezoelectric element 61 connects to the control unit 130 via the independent DSP.

Figure 8:
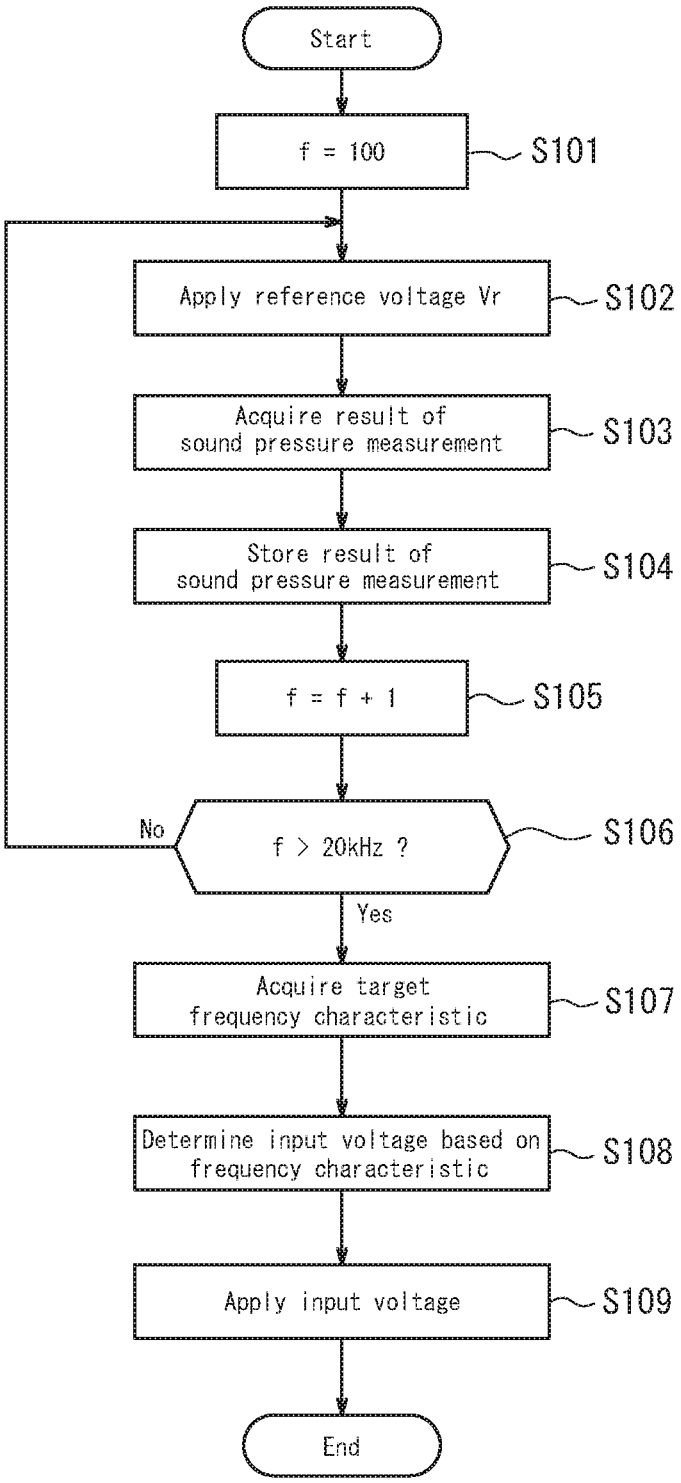
FIG. 8 is a flowchart illustrating a procedure for controlling input voltage performed by the control unit in FIG. 6.

FIG. 8 is a flowchart illustrating a procedure for controlling input voltage performed by the control unit 130. The control unit 130 can control the input voltage over a frequency band in any range. In the description of the flowchart in FIG. 8, however, control of the input voltage is described for a frequency band in a range from 100 Hz to 20 kHz.

The control unit 130 first initializes a frequency f, setting f=100 Hz (step S101). The control unit then applies a pure sound signal with the set frequency f=100 Hz to the laminated piezoelectric element 61 at a reference voltage Vr (step S102). The reference voltage Vr may be any voltage, yet in the present embodiment, the voltage needs to be at a level that at least allows the microphone 91 to detect the sound that is emitted from the contact surface due to application of the pure sound signal.

Next, the sound pressure of the sound emitted from the contact surface due to application of the pure sound signal is measured by the microphone 91, and the control unit 130 acquires the result of sound pressure measurement from the microphone 91 (step S103). The control unit 130 then stores the acquired result of sound pressure measurement in association with the frequency f=100 in the storage unit 140 (step S104). In this way, for the frequency f=100 Hz, the control unit 130 can acquire the sound pressure of the sound emitted from the contact surface when the reference voltage Vr is applied to the laminated piezoelectric element 61.

Next, the control unit 130 increases the value of the frequency. In the present embodiment, the control unit 130 increases the frequency by 1 Hz with the calculation f=f+1 (step S105). The control unit 130 then judges whether the value of the increased frequency f is larger than 20 kHz (step S106).

When the value of the frequency is 20 kHz or less (step S106: No), the control unit 130 applies a pure sound signal at the value of the frequency f increased in step S106 at the reference voltage Vr to the laminated piezoelectric element 61 (step S102) and acquires the sound pressure of the sound emitted as a result from the contact surface. By repeating the processing from step S102 to step S106, the control unit 130 acquires the relationship between the reference voltage Vr and the sound pressure of the sound emitted from the contact surface at each frequency from 100 Hz to 20 kHz.

When the value of the frequency f is greater than 20 kHz (step S106: Yes), i.e. when the frequency characteristic has been acquired from 100 Hz to 20 kHz, the control unit 130 acquires the target frequency characteristic (step S107). The target frequency characteristic may, for example, be stored in advance in the storage unit 140 or may be set by the user with the input unit 40.

The control unit 130 then refers to the acquired target frequency characteristic to determine the input voltage to the laminated piezoelectric element 61 based on the frequency characteristic (step S108). The determination of the input voltage is made so that the sound emitted from the contact surface has the predetermined target frequency characteristic. For example, when the sound pressure of the sound emitted from the contact surface is more intense than the sound pressure of the target frequency characteristic due to a certain frequency matching the resonance frequency of the contact surface, the control unit 130 reduces the input voltage in accordance with the intensity of the sound pressure so that the sound pressure of the sound emitted from the contact surface lowers to the sound pressure of the target frequency characteristic. Conversely, when the sound pressure of the sound emitted from the contact surface is less intense than the sound pressure of the target frequency characteristic at a certain frequency, the control unit 130 increases the input voltage in accordance with the intensity of the sound pressure so that the sound pressure of the sound emitted from the contact surface rises to the sound pressure of the target frequency characteristic. The control unit 130 then applies the determined input voltage to the laminated piezoelectric element 61 (step S109). Through such equalizing, the control unit 130 achieves the target frequency characteristic.

Note that in step S105 of the flowchart in FIG. 8, the value of the frequency has been described as being increased by 1 Hz, yet the value of the frequency f is not limited to being increased 1 Hz at a time and may instead be increased by any increment. Furthermore, the value of the frequency f is not limited to being increased in predetermined increments and may for example be swept from 100 Hz to 20 kHz. In this case, the control unit 130 can acquire the frequency characteristic continuously from 100 Hz to 20 kHz. The control unit 130 can execute the processing flow in FIG. 8 before using the laminated piezoelectric element 61 to cause sound to be emitted and then control the input signal applied to the laminated piezoelectric element 61. The control unit 130 can also execute the processing flow in FIG. 8 while using the laminated piezoelectric element 61 to cause sound to be emitted and then update the frequency characteristic acquired and stored in the storage unit 140.

Figure 9:
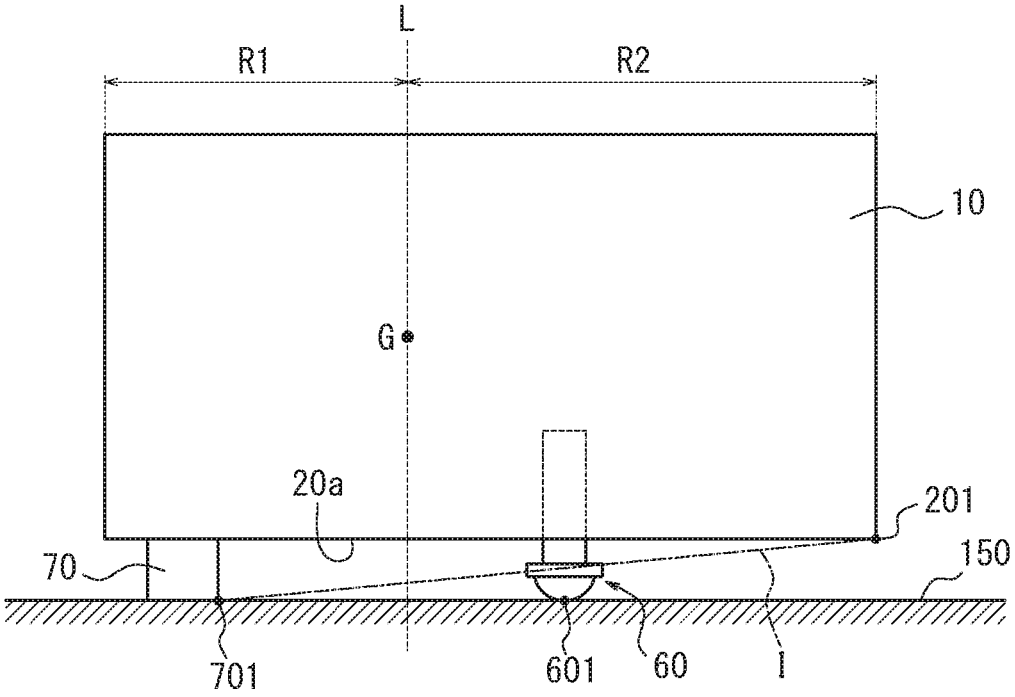
FIG. 9 illustrates the arrangement of the piezoelectric vibrator and the elastic member in the sound generator in FIG. 1.

Next, with reference to FIG. 9, the arrangement of the piezoelectric vibrator 60 and the elastic member 70 is described. FIG. 9 illustrates a state in which the mobile phone 10 is mounted on a horizontal contact surface 150, such as a desk, with the bottom side 20*a* downwards. The desk referred to here is an example of a contacted member in the present disclosure, and the contact surface 150 is an example of a contact surface that the sound generator contacts. As illustrated in FIG. 9, at least the piezoelectric vibrator 60 and the elastic member 70 contact the contact surface 150 and support the mobile phone 10. Point G is the center of gravity of the mobile phone 10. In other words, the point G is the center of gravity of the anchor in the sound generator.

In FIG. 9, the elastic member 70 has a lowermost edge 701. The lowermost edge 701 is, within the elastic member 70, the location that abuts the horizontal contact surface 150, such as a desk, when the mobile phone 10 is mounted on the contact surface 150 with the bottom side 20*a* downwards.

The piezoelectric vibrator 60 has a lowermost edge 601. The lowermost edge 601 is, within the piezoelectric vibrator 60, the location that abuts the horizontal contact surface 150, such as a desk, when the mobile phone 10 is mounted on the contact surface 150 with the bottom side 20*a* downwards. The lowermost edge 601 is, for example, the tip of the cap 63.

The mobile phone 10 has a lowermost edge 201. The lowermost edge 201 is, within the mobile phone 10, the location that would abut the horizontal contact surface 150, such as a desk, when the mobile phone 10 is mounted on the contact surface 150 with the bottom side 20*a* downwards if the piezoelectric vibrator 60 did not exist. A non-limiting example of the lowermost edge 201 of the mobile phone 10 is a corner of the housing 20. When a protrusion protrudes from the bottom side 20*a*, this protrusion may be the lowermost edge 201 of the mobile phone 10. The protrusion may, for example, be a side key, a connector cap, or the like.

In FIG. 9, a dashed line L is a line (virtual line) that traverses the center of gravity G of the mobile phone 10 and is perpendicular to the horizontal contact surface 150, such as a desk, when the mobile phone 10 is mounted on the contact surface 150 with the bottom side 20*a* downwards. An alternate long and short dash line I is a line (virtual line) that connects the lowermost edge 701 of the elastic member 70 and the lowermost edge 201 of the mobile phone 10 assuming the piezoelectric vibrator 60 does not exist.

In FIG. 9, the region R1 is a region at one side of the mobile phone 10, separated by the dashed line L. The region R2 is a region at the other side of the mobile phone 10, separated by the dashed line L. The elastic member 70 is provided on the bottom side 20*a* in the region R1. The piezoelectric vibrator 60 is provided on the bottom side 20*a* in the region R2.

In the region R2 of the bottom side 20*a*, the piezoelectric vibrator 60 is preferably provided at a position as close as possible to the dashed line L. The load on the piezoelectric vibrator 60 thus increases as compared to when the piezoelectric vibrator 60 is provided at a position distant from the dashed line L on the bottom side 20*a* in the region R2. Hence, the mobile phone 10 can effectively be used as an anchor for the sound generator.

In the region R1 of the bottom side 20*a*, the elastic member 70 is preferably provided at a position as far as possible from the dashed line L. A sufficient distance can thus be ensured between the elastic member 70 and the piezoelectric vibrator 60 even when the piezoelectric vibrator 60 is placed at a position as close as possible to the dashed line L. Hence, the sound generator can be stably mounted on the contact surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 of the piezoelectric vibrator 60 is preferably located towards the contact surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 preferably projects towards the contact surface 150 from the alternate long and short dash line I. In this way, the contact surface 150 can appropriately be vibrated by the piezoelectric vibrator 60.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 of the piezoelectric vibrator 60 is preferably located towards the contact surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 preferably projects towards the contact surface 150 from the alternate long and short dash line I. It is thus more difficult for the lowermost edge 201 of the mobile phone 10 to contact the contact surface 150, which for example depending on the type of paint on the housing 20, makes it more difficult for the paint to peel off. Abnormal noise is also less likely to be emitted between the lowermost edge 201 and the contact surface 150.

A commercially available stand or the like may be attached to the housing 20, for example, and the mobile phone 10 may be stood on a contact surface, such as a desk, with the bottom side 20*a* downwards. In this case, the bottom side 20*a* is supported at two points by the piezoelectric vibrator 60 and the elastic member 70, and the mobile phone 10 is further supported by the stand.

Figure 10A:
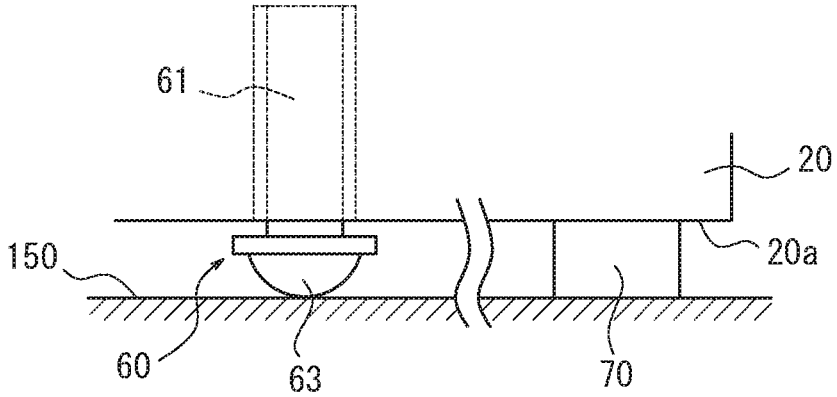
FIG. 10A schematically illustrates operation of the mobile phone in FIG. 1 as a sound generator.
Figure 10B:
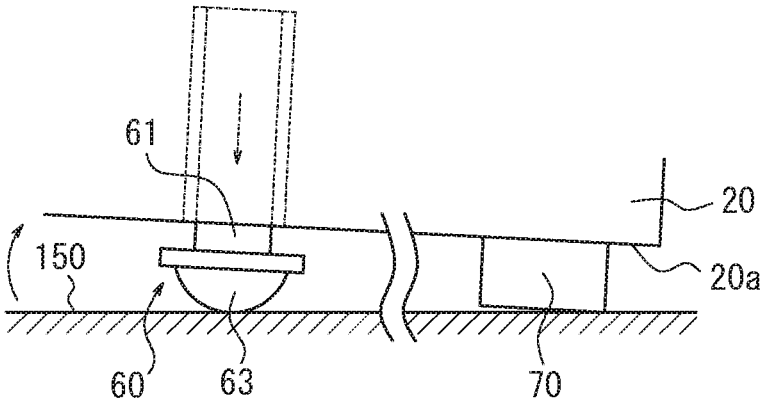
FIG. 10B schematically illustrates operation of the mobile phone in FIG. 1 as a sound generator.
Figure 10C:
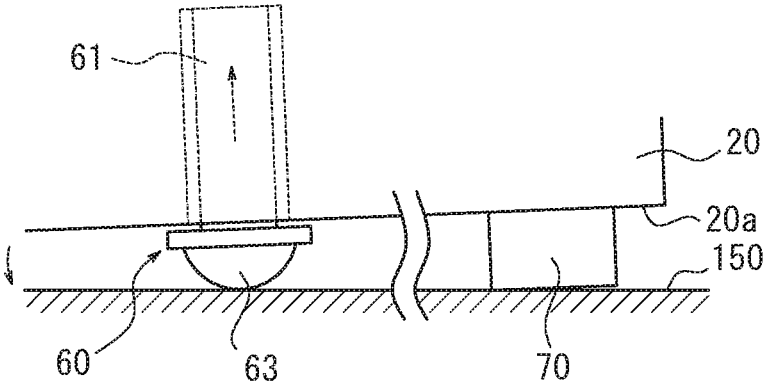
FIG. 10C schematically illustrates operation of the mobile phone in FIG. 1 as a sound generator.

FIGS. 10A, 10B, and 10C schematically illustrate operation of the mobile phone 10 according to the present embodiment as a sound generator. When causing the mobile phone 10 to function as a sound generator, the mobile phone 10 is stood horizontally with the bottom side 20*a* of the housing 20 downwards, so that the cap 63 of the piezoelectric vibrator 60 and the elastic member 70 contact the contact surface 150, such as a desk, as illustrated in FIG. 10A. In this way, the weight of the mobile phone 10 is provided to the piezoelectric vibrator 60 as a load. In other words, the mobile phone 10 acts as an anchor for the sound generator according to the present disclosure. Note that in the state illustrated in FIG. 10A, the laminated piezoelectric element 61 does not expand or contract, since no voltage is applied thereto.

In this state, when the laminated piezoelectric element 61 of the piezoelectric vibrator 60 is driven by a playback sound signal, the laminated piezoelectric element 61 vibrates by expanding and contracting in accordance with the playback sound signal with the portion of the elastic member 70 contacting the contact surface 150 acting as a pivot, and without the cap 63 separating from the contact surface 150, as illustrated in FIGS. 10B and 10C. As long as problems such as the lowermost edge 201 contacting the contact surface 150 and emitting abnormal noise do not occur, the cap 63 may separate slightly from the contact surface 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the contact surface 150 through the cap 63, and the contact surface 150 vibrates, causing the contact surface 150 to function as a vibration speaker by emitting sound. If the difference in length between full expansion and full contraction is less than 0.05 μm, it may not be possible to vibrate the contact surface 150 appropriately. Conversely, if the difference exceeds 50 μm, vibration grows large, and the sound generator may wobble.

As described above, when the laminated piezoelectric element 61 is fully expanded, the tip of the cap 63 is preferably located towards the contact surface 150 from a line (the alternate long and short dash line I in FIG. 9) connecting the lowermost edge 701 of the elastic member 70 and the lowermost edge 201 of the mobile phone 10 assuming the piezoelectric vibrator 60 does not exist. Furthermore, when the laminated piezoelectric element 61 is fully contracted, the tip of the cap 63 is preferably located towards the contact surface 150 from this virtual line.

The distance d between the bottom side 20*a* and the opposing face 63*c* of the cap 63 illustrated in FIG. 5 is preferably greater than the amount of displacement when the laminated piezoelectric element 61 is fully contracted from a state in which no voltage is applied thereto so that the laminated piezoelectric element 61 is not expanding or contracting. In this way, it is difficult for the bottom side 20*a* of the housing 20 and the cap 63 to contact even when the laminated piezoelectric element 61 is fully contracted (the state in FIG. 10C). Accordingly, the cap 63 does not easily detach from the laminated piezoelectric element 61.

The location at which the piezoelectric vibrator 60 is disposed on the bottom side 20*a*, the length of the laminated piezoelectric element 61 in the lamination direction, the dimensions of the cap 63, and the like are appropriately determined so as to satisfy the above conditions.

According to the sound generator of the present embodiment, a laminated piezoelectric element is used as the source of vibration, hence reducing the number of components as compared to a vibration generating device having a dynamic speaker configuration and achieving a simple structure with few components, thereby allowing for a reduction in size and weight. Furthermore, as the laminated piezoelectric element, the stack-type laminated piezoelectric element 61 is used and vibrates by expanding and contracting along the lamination direction due to a playback sound signal. Since this expanding and contracting vibration is transmitted to the contact surface, the vibration transmission efficiency with respect to the contact surface in the expansion and contraction direction (deformation direction) is good, and the contact surface can be vibrated efficiently. Moreover, since the laminated piezoelectric element 61 contacts the contact surface with the cap 63 therebetween, damage to the laminated piezoelectric element 61 can also be prevented. By standing the mobile phone 10 horizontally so that the cap 63 of the piezoelectric vibrator 60 contacts the contact surface, the weight of the mobile phone 10 is applied as a load to the cap 63. Hence, the cap 63 can reliably contact the contact surface, and the expanding and contracting vibration of the piezoelectric vibrator 60 can efficiently be transmitted to the contact surface.

Furthermore, according to the sound generator of the present embodiment, when using the laminated piezoelectric element 61 to cause sound to be emitted, the reference voltage Vr in a predetermined frequency range is applied to the laminated piezoelectric element 61 and the frequency characteristic is acquired in advance, and based on the acquired frequency characteristic, the input voltage applied to the laminated piezoelectric element 61 is controlled. Therefore, the mobile phone 10 can generate sound with a desired target frequency characteristic. The input voltage can also be controlled in accordance with the properties of the contact surface, thus allowing the mobile phone 10 to generate good sound regardless of the properties of the contact surface. Furthermore, when the mobile phone 10 is reduced in weight, the mobile phone 10 might separate from the contact surface, depending on the frequency of sound, due to the reaction to the vibration of the laminated piezoelectric element 61, which for example may generate abnormal noise. In the sound generator according to the present embodiment, however, since the input voltage is controlled based on the frequency characteristic, the input voltage at such a frequency can be kept low, and abnormal noise can be prevented. Therefore, the mobile phone 10 can be reduced in weight.

The sound generator according to the present embodiment can mainly transmit vibration of a laminated piezoelectric element directly to a contact surface. Therefore, unlike a technique to transmit vibration of a laminated piezoelectric element to another elastic body, there is no dependence on the high-frequency side threshold frequency at which another elastic body can vibrate when emitting sound. The high-frequency side threshold frequency at which another elastic body can vibrate is the inverse of the shortest time among the times from when the other elastic body is caused to deform by a laminated piezoelectric element until the other elastic body returns to a state in which deformation is again possible. In light of this fact, the anchor of the sound generator according to the present embodiment preferably has enough stiffness (flexural strength) so as not to undergo flexing deformation due to deformation of the laminated piezoelectric element.

Embodiment 2

In Embodiment 1, the control unit 130 has been described as controlling the input voltage based on the frequency characteristic of sound pressure acquired by the microphone 91. In Embodiment 2, the control unit 130 controls the input voltage based on the output voltage of the laminated piezoelectric element measured by a voltage measurement unit. The schematic structure of a mobile phone according to Embodiment 2 is similar to that of the mobile phone in Embodiment 1 illustrated in FIGS. 1 and 2. Note that in Embodiment 2, the sound generator need not be provided with the microphone 91. The following describes the differences from Embodiment 1, omitting a description of common features.

Figure 11:
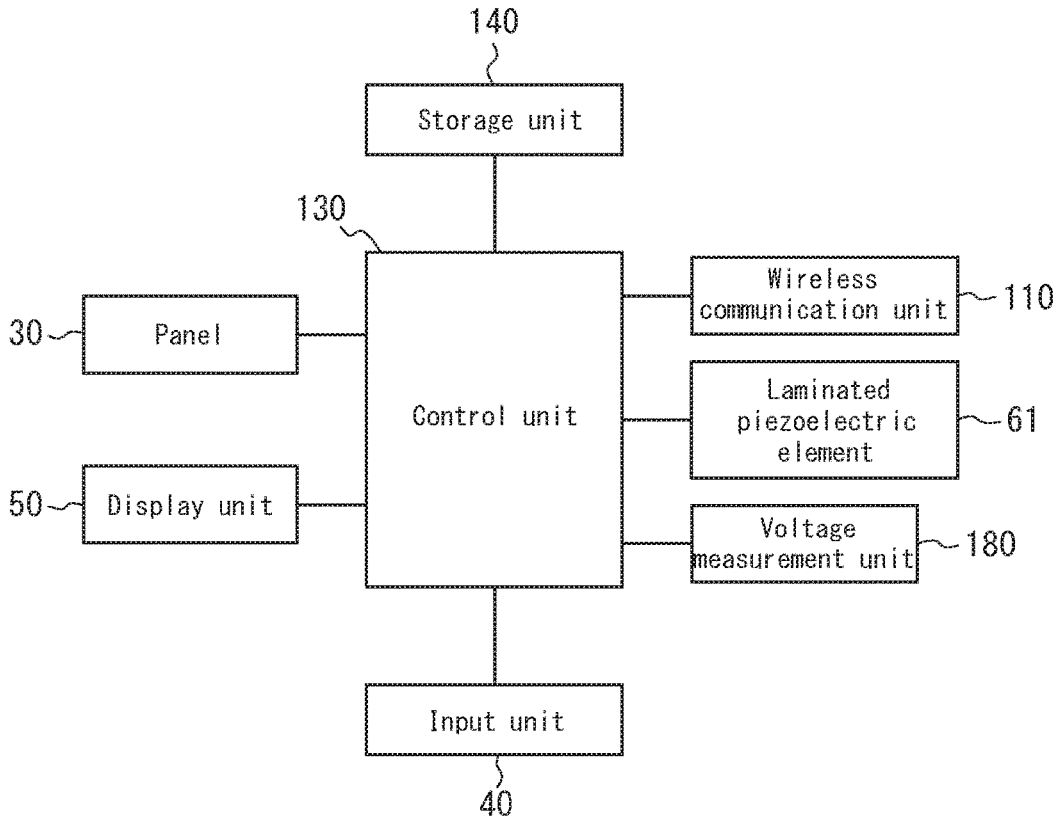
FIG. 11 is a functional block diagram of the main portions of a sound generator according to Embodiment 2.

FIG. 11 is a functional block diagram of the main portions of a sound generator according to Embodiment 2. Unlike the mobile phone according to Embodiment 1, the mobile phone 10 according to the present embodiment includes a voltage measurement unit 180. The voltage measurement unit 180 is connected to the laminated piezoelectric element 61 and the control unit 130. The voltage measurement unit 180 measures the output voltage from the laminated piezoelectric element 61 and transmits the result to the control unit 130.

Figure 12A:
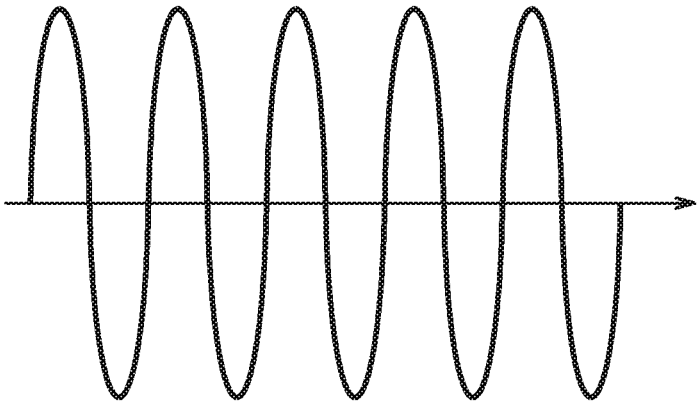
FIG. 12A illustrates an example of input voltage of a laminated piezoelectric element.
Figure 12B:
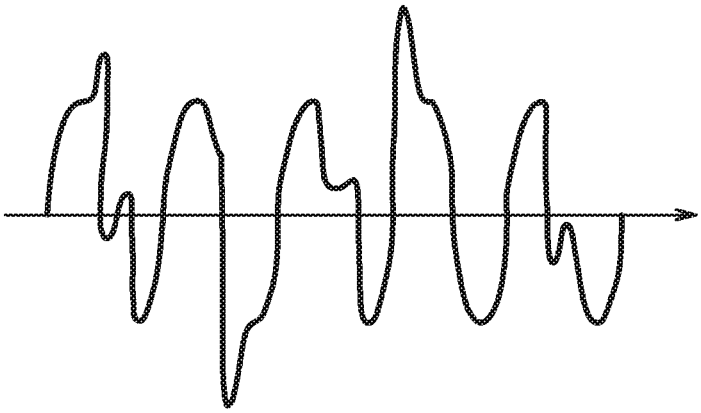
FIG. 12B illustrates an example of output voltage of a laminated piezoelectric element.

Measurement of the output voltage by the voltage measurement unit 180 is now described. The laminated piezoelectric element 61 undergoes expanding and contracting vibration by converting an input voltage into a force upon application of the input voltage as a sound signal and outputs voltage upon application of a force by converting the force into voltage. When using the laminated piezoelectric element 61 in the mobile phone 10, upon application of input voltage to the laminated piezoelectric element 61, the laminated piezoelectric element 61 applies a force to a contact surface due to vibrating by expanding and contracting. At this time, the laminated piezoelectric element 61 receives a force from the contact surface, as a reaction to the force applied to the contact surface, and outputs voltage. This output voltage changes in accordance with the force that the laminated piezoelectric element 61 receives. Therefore, by the voltage measurement unit 180 measuring the output voltage, the state of vibration of the contact surface can be detected. For example, suppose that voltage such as that illustrated in FIG. 12A is input into the laminated piezoelectric element 61. At this time, the laminated piezoelectric element 61 for example outputs the voltage illustrated in FIG. 12B due to the contact surface vibrating under the influence of the properties of the contact surface, such as the resonance frequency. Therefore, in the sound generator according to the present embodiment, good sound can be generated by measuring the characteristics of the output voltage for such an input voltage at each frequency and controlling the voltage at the frequency applied to the laminated piezoelectric element 61 based on the result of measurement.

Figure 13:
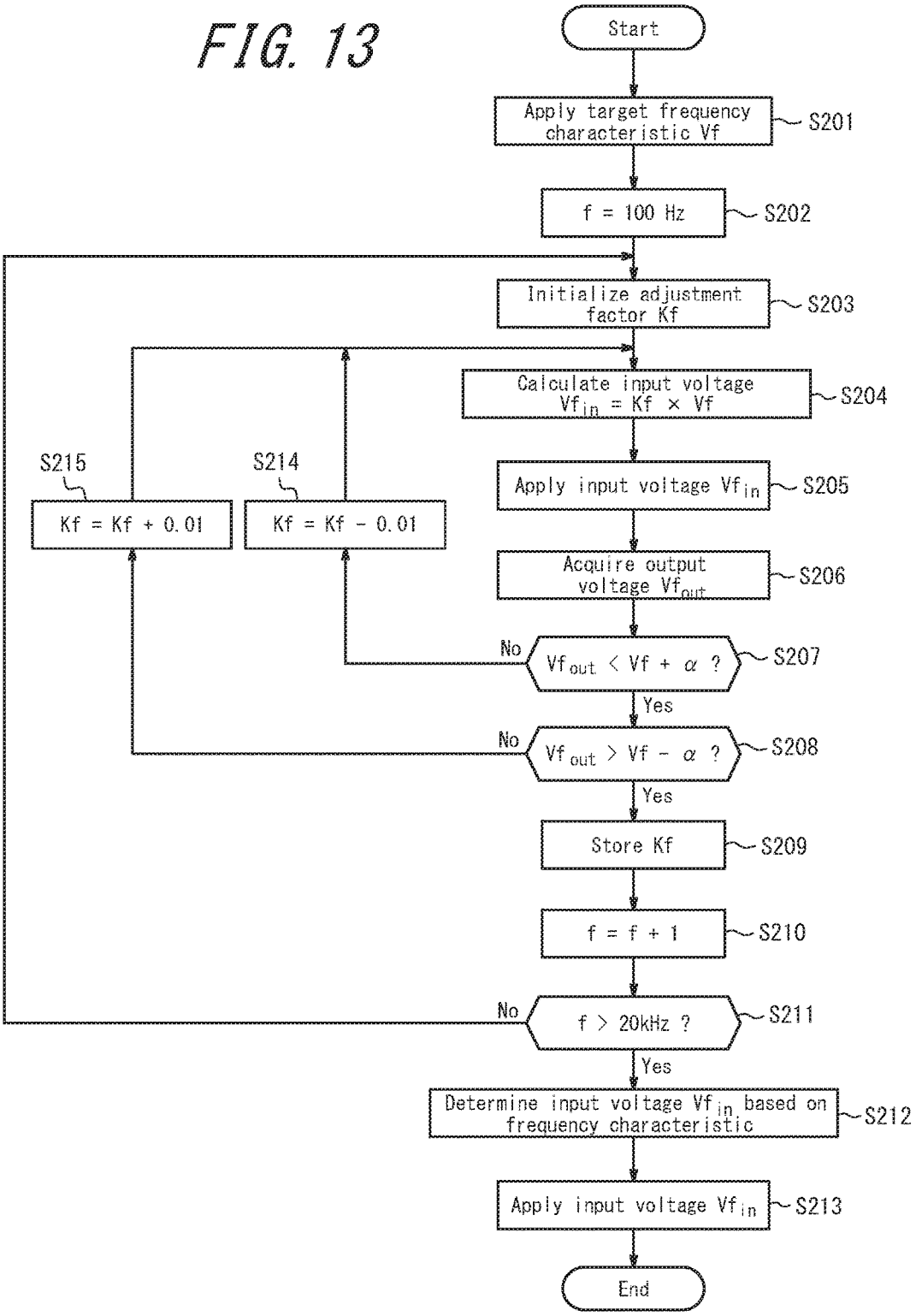
FIG. 13 is a flowchart illustrating a procedure for controlling input voltage performed by the control unit in the sound generator according to Embodiment 2.

FIG. 13 is a flowchart illustrating a procedure for controlling input voltage performed by the control unit 130 in the sound generator according to the present embodiment. The control unit 130 can control the input voltage over a frequency band in any range. In the description of the flowchart in FIG. 13, however, control of the input voltage is described for a frequency band in a range from 100 Hz to 20 kHz.

At the start of the processing flow, the control unit 130 first acquires the target frequency characteristic Vf (f=100 Hz to 20 kHz) (step S201). The target frequency characteristic Vf may, for example, be stored in advance in the storage unit 140 or may be set by the user with the input unit 40. The control unit 130 then initializes a frequency f, setting f=100 Hz (step S202). The control unit 130 also initializes an adjustment factor Kf for determining the value of the input voltage with respect to the target frequency characteristic (step S203). The adjustment factor Kf may be initialized to any value, for example by setting the adjustment factor Kf so that Kf=1.

Next, the control unit 130 calculates an input voltage $Vf_{in}$ (step S204). The input voltage $Vf_{in}$ is calculated as the product of the adjustment factor Kf and the target frequency characteristic Vf. Accordingly, for example when the adjustment factor Kf is set to 1 in step S203, the value of the target frequency characteristic Vf initially becomes the input voltage $Vf_{in}$. The control unit 130 then applies the calculated input voltage $Vf_{in}$ to the laminated piezoelectric element 61 (step S205). Upon application of the input voltage $Vf_{in}$ to the laminated piezoelectric element 61, the laminated piezoelectric element 61 is driven and vibrates the contact surface. Simultaneously, the laminated piezoelectric element 61 receives a force from the contact surface and outputs voltage. The voltage measurement unit 180 then measures the output voltage $Vf_{out}$, and the control unit 130 acquires the measured output voltage $Vf_{out}$ (step S206).

Next, the control unit 130 confirms whether the acquired output voltage $Vf_{out}$ is within a predetermined range with respect to the target frequency characteristic Vf. As an example, the control unit 130 is described below as confirming during this processing flow whether the output voltage $Vf_{out}$ is within a range of $\pm\alpha$ ($\alpha$ being a predetermined constant) with respect to the target frequency characteristic Vf. In other words, the control unit 130 judges whether the value of the output voltage $Vf_{out}$ is smaller than $Vf+\alpha$ (step S207). When the value of the output voltage $Vf_{out}$ is equal to or greater than $Vf+\alpha$ (step S207: No), the control unit 130 reduces the value of the adjustment factor Kf. The adjustment factor Kf may be reduced by any amount. For example, the amount of reduction may be 0.01, as in FIG. 13. In this case, the control unit 130 reduces the adjustment factor Kf by performing the calculation Kf=Kf−0.01 (step S214). The control unit 130 then calculates the input voltage $Vf_{in}$ by calculating the product of the newly calculated adjustment factor Kf and the target frequency characteristic (step S204).

Conversely, when the value of the output voltage $Vf_{out}$ is smaller than $Vf+\alpha$ (step S207: Yes), the control unit 130 then judges whether the value of the output voltage $Vf_{out}$ is larger than $Vf-\alpha$ (step S208). When the value of the output voltage $Vf_{out}$ is equal to or less than $Vf-\alpha$ (step S208: No), the control unit 130 increases the value of the adjustment factor Kf. Here as well, as in step S214, the adjustment factor Kf may be increased by any amount. For example, the amount of increase may be 0.01. In other words, in the flowchart illustrated in FIG. 13, the control unit 130 increases the adjustment factor Kf by performing the calculation Kf=Kf+0.01 (step S214). The control unit 130 then calculates the input voltage $Vf_{in}$ by calculating the product of the newly calculated adjustment factor Kf and the target frequency characteristic (step S204). In this way, by repeating the processing from step S204 to step S208, the control unit 130 can calculate $Vf_{out}$ to be within a predetermined range with respect to the target frequency characteristic Vf.

When the value of the output voltage $Vf_{out}$ is larger than $Vf-\alpha$ (step S208: Yes), the control unit 130 stores the value of the adjustment factor Kf used to output the value of this output voltage $Vf_{out}$ in the storage unit 140 (step S209). Subsequently, the control unit 130 increases the value of the frequency. In the present embodiment, the control unit 130 increases the frequency by 1 Hz with the calculation f=f+1 (step S210). The control unit 130 then judges whether the value of the increased frequency f is larger than 20 kHz (step S211).

When the value of the frequency is 20 kHz or less (step S211: No), the control unit 130 initializes the adjustment factor Kf in order to calculate the adjustment factor Kf for the value of the frequency f increased in step S210 (step S203). By repeating the processing from step S203 to step S211, the control unit 130 acquires the adjustment factor Kf for outputting $Vf_{out}$ within a predetermined range with respect to the target frequency characteristic Vf at each frequency from 100 Hz to 20 kHz, storing each adjustment factor Kf in the storage unit 140.

When the value of the frequency f is greater than 20 kHz (step S211: Yes), i.e. when the adjustment factor Kf has been stored in the storage unit 140 for each frequency from 100 Hz to 20 kHz, the control unit 130 determines the input voltage $Vf_{in}$ for outputting the target frequency characteristic Vf at each frequency based on the adjustment factor Kf stored in the storage unit 140 (step S212). The control unit 130 then applies the determined input voltage $Vf_{in}$ to the laminated piezoelectric element 61 (step S213). Through such equalizing, the control unit 130 achieves the target frequency characteristic.

Note that in step S210 of the flowchart in FIG. 13, the value of the frequency has been described as being increased by 1 Hz, yet the value of the frequency f is not limited to being increased 1 Hz at a time and may instead be increased by any increment. Furthermore, the value of the frequency f is not limited to being increased in predetermined increments and may for example be swept from 100 Hz to 20 kHz. In this case, the control unit 130 can acquire the frequency characteristic continuously from 100 Hz to 20 kHz. The control unit 130 can execute the processing flow in FIG. 13 before using the laminated piezoelectric element 61 to cause sound to be emitted and then control the input signal applied to the laminated piezoelectric element 61. The control unit 130 can also execute the processing flow in FIG. 13 while using the laminated piezoelectric element 61 to cause sound to be emitted and then update the value of the adjustment factor Kf stored in the storage unit 140.

Figure 14:
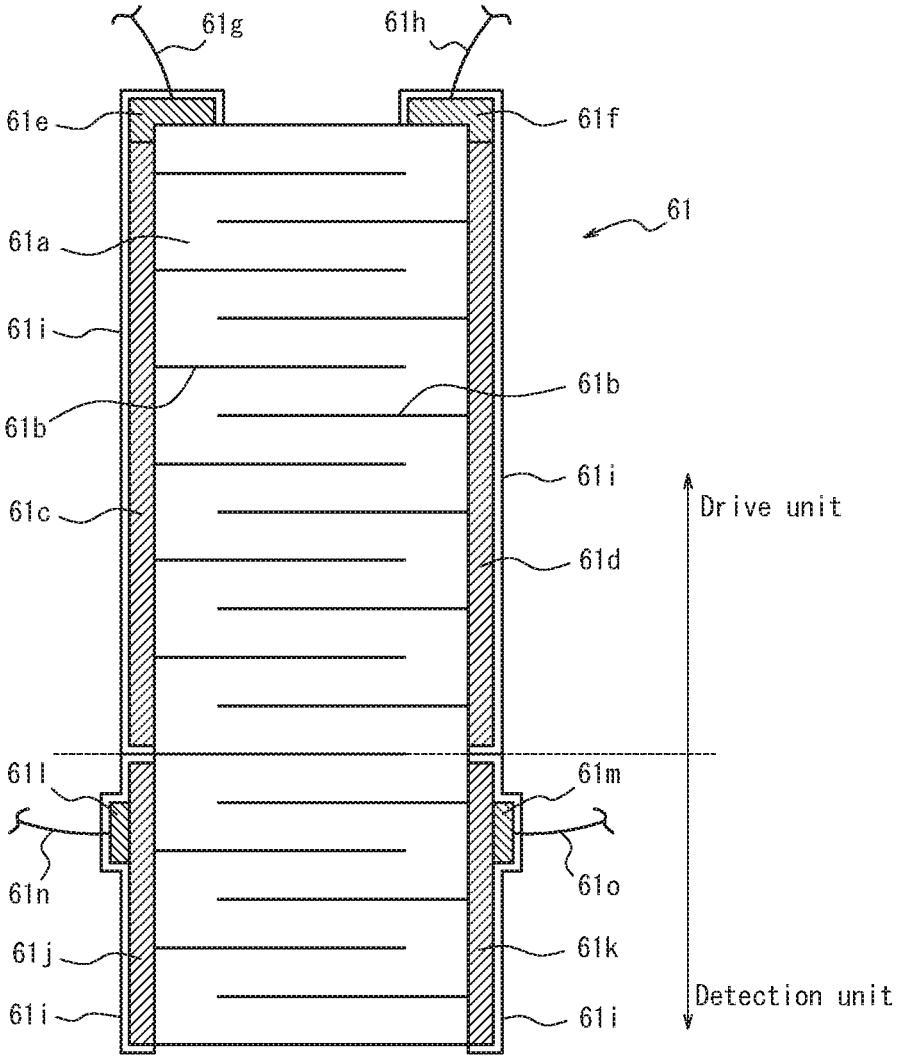
FIG. 14 illustrates the structure of a laminated piezoelectric element in the sound generator according to Embodiment 2.

In the present embodiment, the laminated piezoelectric element 61 is driven by application of an input voltage from the control unit 130 and outputs an output voltage upon receiving a force from the contact surface. As illustrated in FIG. 14, however, a drive unit for driving and a detection unit that outputs the output voltage may both be provided in one laminated piezoelectric element 61. In the laminated piezoelectric element 61 illustrated in FIG. 14, the drive unit side includes a structure similar to the structure described in FIG. 3A. On the other hand, at the detection unit side, the laminated piezoelectric element 61 is provided with a third lateral electrode 61*j* and a fourth lateral electrode 61*k*. The third lateral electrode 61*j* is disposed laterally on the same side as the first lateral electrode 61*c* of the laminated piezoelectric element 61, and the fourth lateral electrode 61*k* is disposed laterally on the same side as the second lateral electrode 61*d* of the laminated piezoelectric element 61. On the detection unit side, internal electrodes 61*b* connecting to the third lateral electrode 61*j* and internal electrodes 61*b* connecting to the fourth lateral electrode 61*k* are alternately layered and respectively connect to the third lateral electrode 61*j* and the fourth lateral electrode 61*k* electrically. A third lead connector 61*l* and a fourth lead connector 61*m* are formed to connect respectively to the third lateral electrode 61*j* and the fourth lateral electrode 61*k*, and a third lead wire 61*n* and a fourth lead wire 610 are respectively connected to the third lead connector 61*l* and the fourth lead connector 61*m*. The third lead wire 61*n* and the fourth lead wire 610 are connected to the voltage measurement unit 180 and transmit the output voltage of the laminated piezoelectric element 61 to the voltage measurement unit 180.

Embodiment 3

Figure 15:
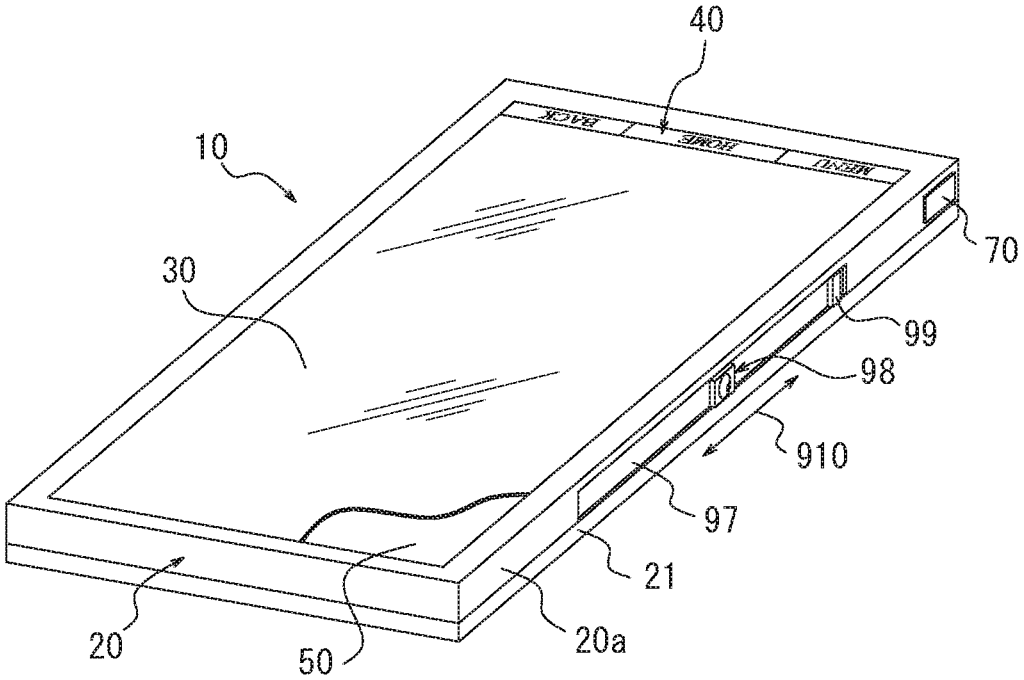
FIG. 15 is an external perspective view schematically illustrating the structure of a sound generator according to Embodiment 3 of the present disclosure.

FIG. 15 is an external perspective view of a sound generator according to Embodiment 3 of the present disclosure. The sound generator according to the present embodiment includes a mobile phone 10, such as a smartphone, an elastic member 70, and a cover 97. The mobile phone 10 includes a housing 20 having an approximately rectangular external shape. In the housing 20, a panel 30 and an input unit 40 are provided at the front side of the mobile phone 10, and as illustrated by the partial cutout of the panel 30 in FIG. 15, a display unit 50 is held below the panel 30. A battery pack, camera unit, and the like are installed at the back side of the housing 20 and covered by a battery lid 21. The following describes the differences from Embodiment 1, omitting a description of common features.

Figure 16:
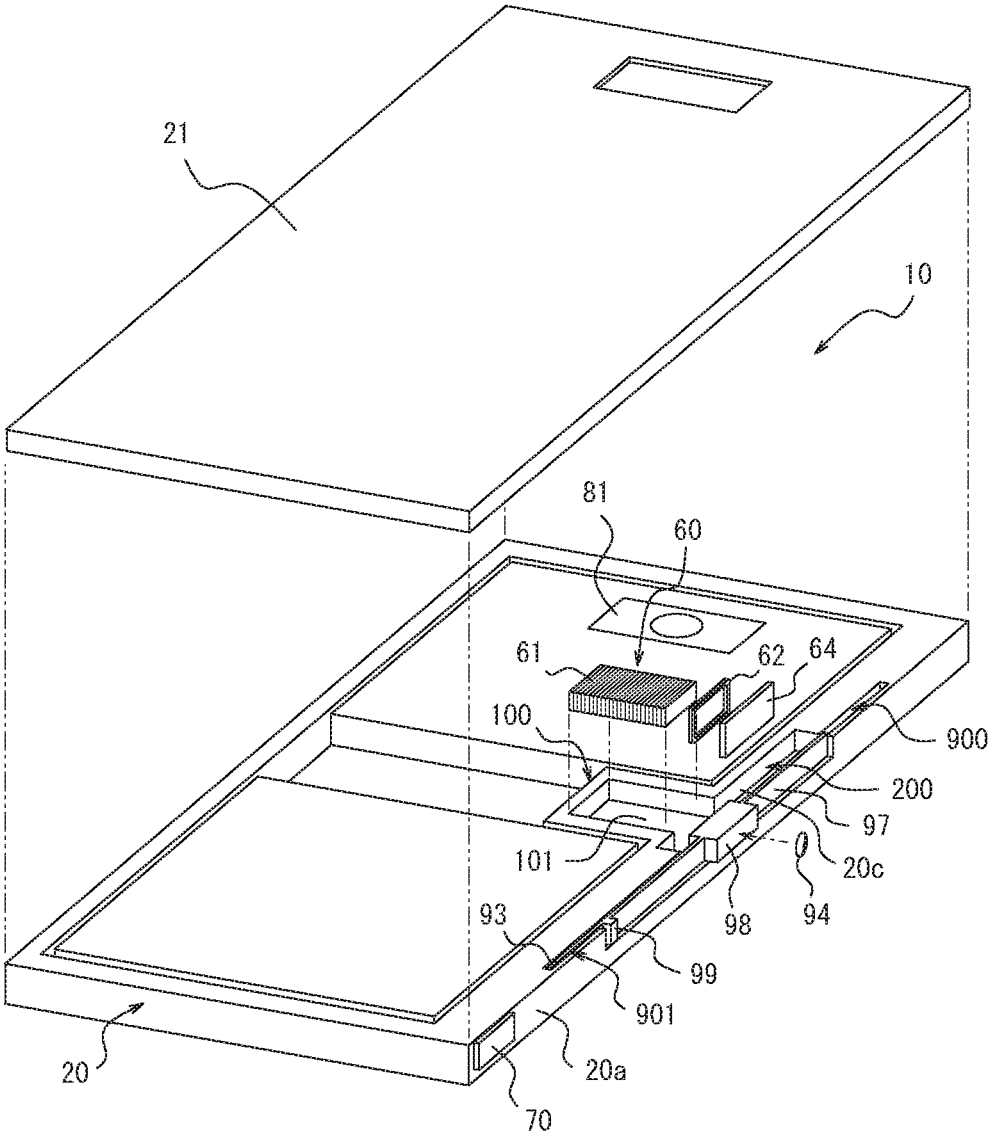
FIG. 16 is an external, exploded perspective view of the main parts at the back side of the mobile phone in FIG. 15.

On a bottom side 20*a*, which is one of the long sides of the housing 20 in the mobile phone 10, the sound generator according to the present embodiment includes the sheet-like elastic member 70 and the cover 97 for protecting a piezoelectric vibrator 60 inside the housing 20 (see FIG. 16). The elastic member 70 may, for example, be formed from rubber, silicone, polyurethane, or the like. The cover 97 includes a vibration unit 98 and a protrusion 99. The cover 97 is disposed displaceably in the housing 20. By manipulating the protrusion 99 with a finger, the user of the mobile phone 10 can move the cover 97, thus sliding the cover 97 in the longitudinal direction along the bottom side 20*a*, as illustrated by the arrows 910. When the mobile phone 10 is mounted on a horizontal contact surface, such as a desk, with the bottom side 20*a* downwards, i.e. when stood horizontally, the mobile phone 10 is supported at two points on the contact surface by the elastic member 70 and the vibration unit 98. The arrangement of the elastic member 70 and the vibration unit 98 is described below.

FIG. 16 is an exploded perspective view schematically illustrating the main parts at the back side of the mobile phone 10 in FIG. 15. A battery pack 80, a camera unit 81, and the like are installed at the back side of the housing 20. The piezoelectric vibrator 60, which includes a piezoelectric element 61, is provided inside the housing 20. At the back side of the housing 20, the mobile phone 10 includes a concavity 200 that becomes a space for the vibration unit 98 to displace. The concavity 200 includes a surface 20*c* parallel to the bottom side 20*a*. At the back side of the housing 20, the mobile phone 10 also includes a holding unit 100 that houses and holds the piezoelectric vibrator 60. The holding unit 100 includes a slit 101, with a uniform width, that extends along the transverse direction of the housing 20 and opens to the surface 20*c*. At the back side of the housing 20, the mobile phone 10 also includes a holding unit 900 and a holding unit 901 that house and hold the edges of the cover 97. In FIG. 16, a portion of the cover 97 is housed and held in the holding unit 901.

As described below with reference to FIG. 18A and FIG. 18B, by displacement of the cover 97, the vibration unit 98 can adopt either a contact state in contact with the piezoelectric vibrator 60 or a non-contact state not in contact with the piezoelectric vibrator 60. When the vibration unit 98 is in the contact state, the mobile phone 10 acts as an anchor (the anchor in the sound generator) providing a load to the vibration unit 98 via the piezoelectric vibrator 60 when the mobile phone 10 is mounted on a horizontal contact surface, such as a desk, with the bottom side 20*a* downwards.

The piezoelectric vibrator 60 includes the piezoelectric element 61, an O-ring 62, and a cover member 64 that protects the piezoelectric element 61.

The number of layers and the cross-sectional area of the laminated piezoelectric element 61 are determined appropriately in accordance with the weight of the mobile phone 10 (in the case of a portable electronic device, for example 80 g to 800 g) that serves as an anchor, so as to ensure sufficient pressure or quality of the sound emitted from the contact surface, such as a desk, with which the vibration unit 98 is in contact.

As described below with reference to FIG. 19, the laminated piezoelectric element 61 is supplied with a sound signal (playback sound signal) from a control unit 130 via a piezoelectric element drive unit 120. In other words, voltage corresponding to a sound signal is applied to the laminated piezoelectric element 61 from the control unit 130 via the piezoelectric element drive unit 120. If the voltage applied from the control unit 130 is AC voltage, negative voltage is applied to the second lateral electrode 61*d* when positive voltage is applied to the first lateral electrode 61*c*. Conversely, positive voltage is applied to the second lateral electrode 61*d* when negative voltage is applied to the first lateral electrode 61*c*. Upon voltage being applied to the first lateral electrode 61*c* and the second lateral electrode 61*d*, polarization occurs in the dielectric materials 61*a*, and the laminated piezoelectric element 61 expands and contracts from the state in which no voltage is applied. The laminated piezoelectric element 61 expands and contracts in a direction substantially along the lamination direction of the dielectric materials 61*a* and the internal electrodes 61*b*. Alternatively, the laminated piezoelectric element 61 may expand and contract in a direction substantially matching the lamination direction of the dielectric materials 61*a* and the internal electrodes 61*b*. Having the laminated piezoelectric element 61 expand and contract substantially along the lamination direction yields the advantage of good vibration transmission efficiency in the expansion and contraction direction.

Figure 17:
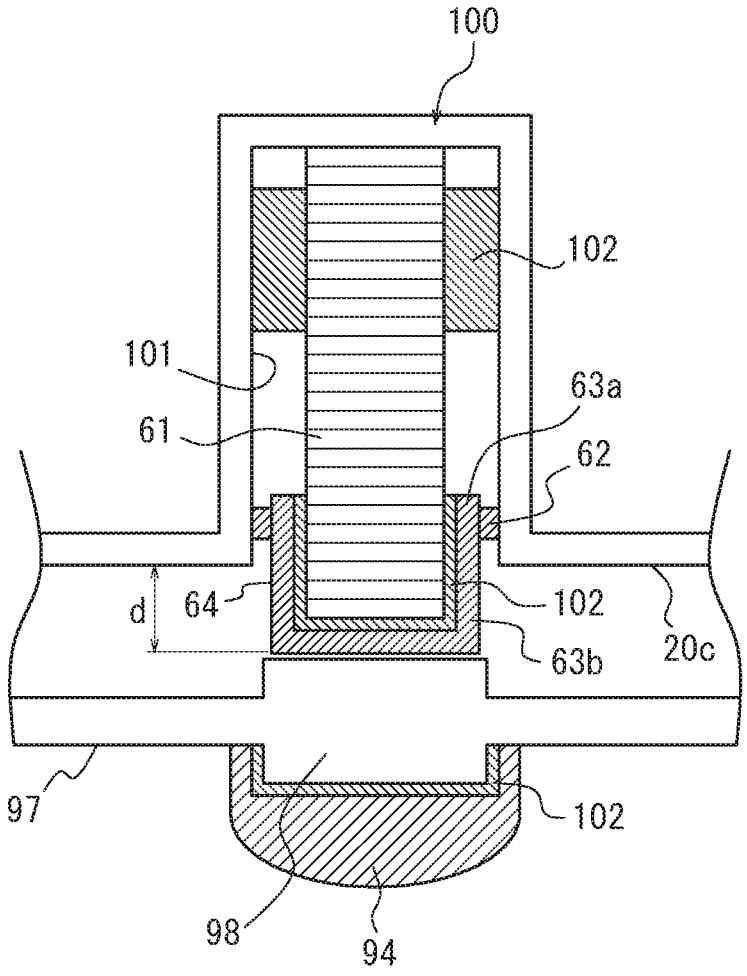
FIG. 17 is a partially enlarged cross-sectional view of a contact state between the piezoelectric vibrator and the vibration unit in FIG. 16.

As illustrated in the partially enlarged cross-sectional view in FIG. 17, the end of the laminated piezoelectric element 61 including the first lead connector 61*e* and the second lead connector 61*f* is fixed in the slit 101 of the holding unit 100 in the housing 20 via adhesive 102 (for example, epoxy resin). The cover member 64 is inserted onto the other end of the laminated piezoelectric element 61 and fixed by adhesive 102.

The cover member 64 is formed from a material, such as hard plastic, that can reliably transmit the expanding and contracting vibration of the laminated piezoelectric element 61 to the vibration unit 98. With the cover member 64 mounted on the laminated piezoelectric element 61, an entering portion 63*a* located in the slit 101 and a protrusion 63*b* protruding from the housing 20 are formed in the cover member 64. The O-ring 62 is disposed on the outer circumference of the entering portion 63*a* located in the slit 101. The O-ring 62 may, for example, be formed from silicone rubber. The O-ring 62 is for movably holding the laminated piezoelectric element 61 and also makes it difficult for moisture or dust to enter into the slit 101. The tip of the protrusion 63*b* is formed in a planar shape. The tip of the protrusion 63*b* is not limited to being planar, however, and may be any shape that reliably has point contact or surface contact with the vibration unit 98 and can transmit the expanding and contracting vibration of the laminated piezoelectric element 61. In FIG. 17, the space between the O-ring 62 and the portion of the laminated piezoelectric element 61 adhered to the slit 101 may be filled with gel or the like to increase the effect of dust and moisture protection. The piezoelectric vibrator 60 is mounted in the holding unit 100, and the protrusion 63*b* of the cover member 64 protrudes from the surface 20*c*. In a state in which no voltage is applied to the laminated piezoelectric element 61 so that the laminated piezoelectric element 61 is not expanding or contracting, the tip of the protrusion 63*b* in the cover member 64 is at a distance of d from the surface 20*c*.

The vibration unit 98 is formed from a material, such as metal, ceramic, hard plastic, or the like, that can reliably transmit the expanding and contracting vibration of the laminated piezoelectric element 61 to the contact surface, such as a desk. The vibration unit 98 is held at both edges by the cover 97, which is flexible so as not to obstruct transmission of the vibration of the laminated piezoelectric element 61. At the bottom side 20*a* of the housing 20, the vibration unit 98 has a cap 94 that is a cover member. The cap 94 is fixed by adhesive 102. The cap 94 is formed from a material such as hard plastic or the like that can reliably transmit, to the contact surface, such as a desk, the expanding and contracting vibration of the laminated piezoelectric element 61 transmitted via the vibration unit 98. In order to suppress scratching of the contact surface, the cap 94 may be made from a relatively soft plastic instead of hard plastic. As long as the cover 97 has a structure that does not obstruct transmission of the vibration of the laminated piezoelectric element 61 to the vibration unit 98, the cover 97 need not be flexible, and the same material as the vibration unit 98 may be used. In this case, the cover 97 and the vibration unit 98 may be formed integrally.

Figure 18A:
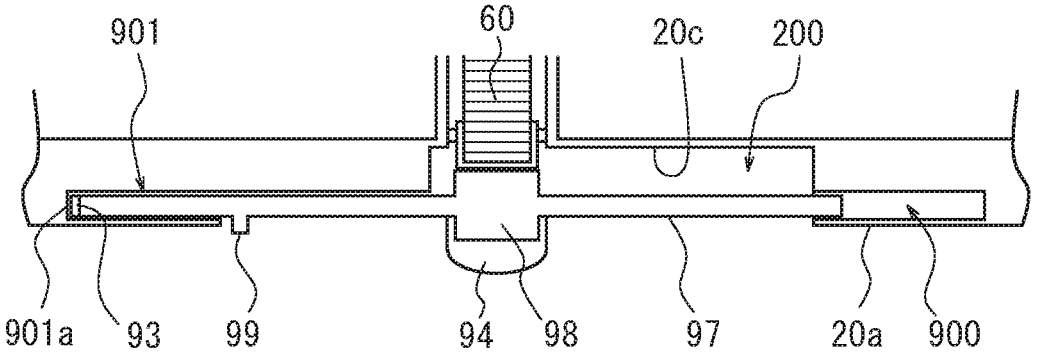
FIG. 18A schematically illustrates a first position of the cover in FIG. 16.
Figure 18B:
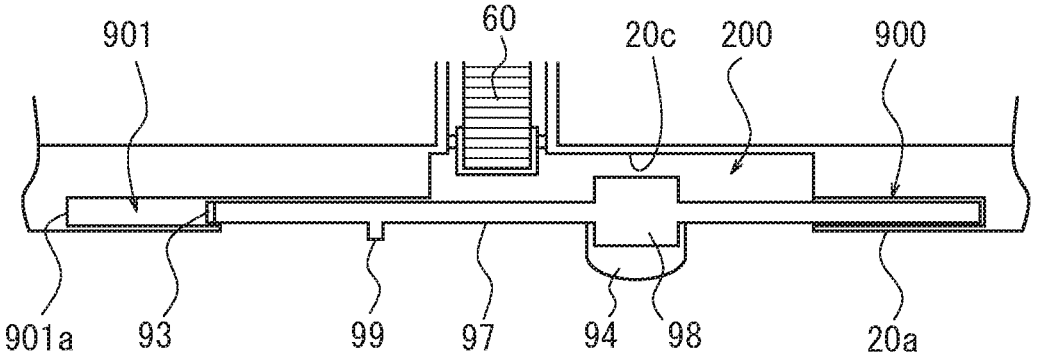
FIG. 18B schematically illustrates a second position of the cover in FIG. 16.

FIG. 18A illustrates the contact state of the vibration unit 98 with the piezoelectric vibrator 60. At this time, the cover 97 is in a first position. FIG. 18B illustrates the non-contact state of the vibration unit 98 with the piezoelectric vibrator 60. At this time, the cover 97 is in a second position. By manipulating the protrusion 99, the user of the mobile phone 10 can move the cover 97 (vibration unit 98) between the first position and the second position, thereby switching between the contact state and the non-contact state of the vibration unit 98 with the piezoelectric vibrator 60. The first position in FIG. 18A is used when emitting sound with the mobile phone 10. In other words, since the piezoelectric vibrator 60 and the vibration unit 98 are in contact, vibration of the piezoelectric element is transmitted to the contact surface, such as a desk, via the vibration unit 98. Conversely, the second position in FIG. 18B is used when not emitting sound with the mobile phone 10. In this case, since the piezoelectric vibrator 60 and the vibration unit 98 are not in contact, vibration of the piezoelectric element is not transmitted to the contact surface. Furthermore, in the non-contact state, the piezoelectric vibrator 60 is protected by the cover 97. Therefore, even if the mobile phone 10 is dropped, for example, providing a shock to the bottom side 20*a* from the location of impact, the cover 97 receives the shock and can thus protect the piezoelectric vibrator 60 from the shock of the drop.

Furthermore, the cover 97 functions as a switch for input of a sound signal to the piezoelectric element 61. As illustrated in FIGS. 18A and 18B, the cover 97 includes a switch 93 at the edge by the holding unit 901. The switch 93 includes, for example, conductive metal, and at an end face 901*a*, the holding unit 901 includes two terminals that form part of a circuit for inputting a sound signal to the piezoelectric element 61. When the cover 97 is in the first position, as illustrated in FIG. 18A, the switch 93 contacts the end face 901*a*, and the two terminals provided at the end face 901*a* are connected via the conductive metal of the switch 93. Hence, the circuit inputting a sound signal to the piezoelectric element 61 is closed, and as a result of a signal being input into the piezoelectric element 61, the piezoelectric vibrator 60 is driven, and vibration thereof is transmitted to the contact surface via the vibration unit 98. The mobile phone 10 can thus cause sound to be emitted from the contact surface. Conversely, when the cover 97 is in the second position, the vibration unit 98 is in the non-contact state with the piezoelectric vibrator 60, and the circuit is open. Therefore, no sound signal is input into the piezoelectric element 61, and the piezoelectric vibrator 60 is not driven. Hence, the mobile phone 10 does not cause sound to be emitted.

Figure 19:
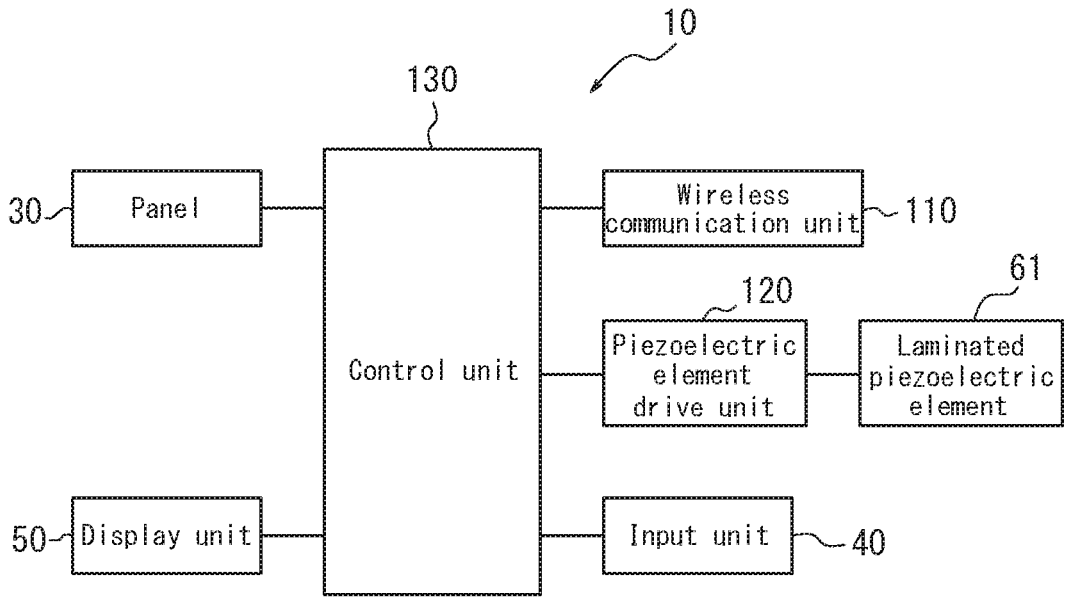
FIG. 19 is a functional block diagram of the main portions of the mobile phone in FIG. 15.

FIG. 19 is a functional block diagram of the main portions of the mobile phone 10 according to the present embodiment. In addition to the above-described panel 30, input unit 40, display unit 50, and laminated piezoelectric element 61, the mobile phone 10 includes a wireless communication unit 110, the piezoelectric element drive unit 120, and the control unit 130. The panel 30, input unit 40, display unit 50, and wireless communication unit 110 connect to the control unit 130. The laminated piezoelectric element 61 connects to the control unit 130 via the piezoelectric element drive unit 120.

The wireless communication unit 110 may have a well-known structure and connects wirelessly to a communication network via a base station or the like. The control unit 130 is a processor that controls overall operations of the mobile phone 10. The control unit 130 applies a playback sound signal (voltage corresponding to a playback sound signal of the other party's voice, a ringtone, music including songs, or the like) to the laminated piezoelectric element 61 via the piezoelectric element drive unit 120. Note that the playback sound signal may be based on music data stored in internal memory or may be music data stored on an external server or the like and played back over a network.

Figure 20:
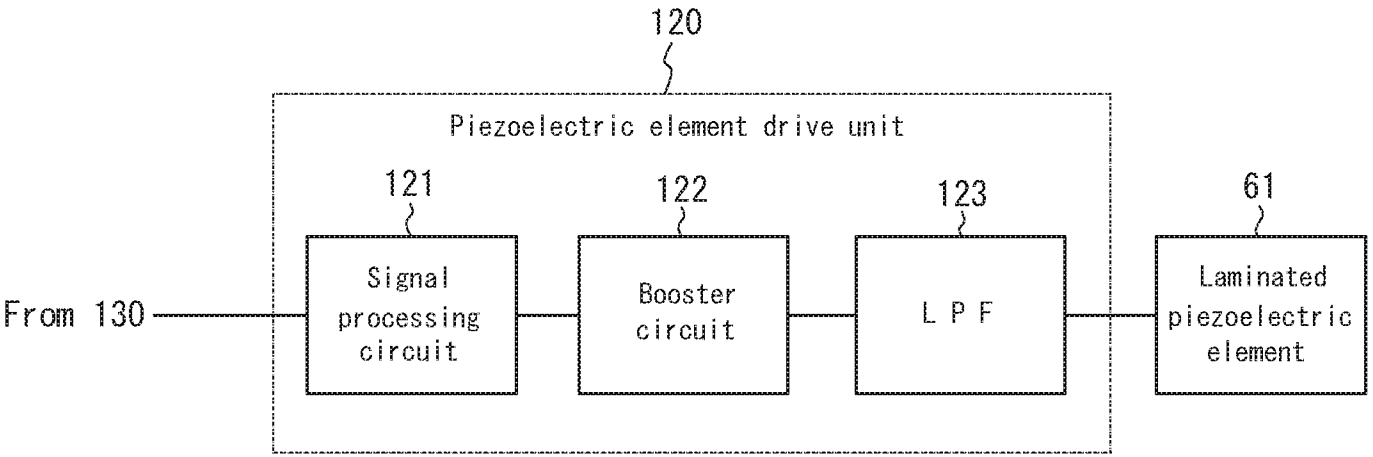
FIG. 20 is a functional block diagram illustrating the structure of an example of the piezoelectric element drive unit in FIG. 19.

For example as illustrated in FIG. 20, the piezoelectric element drive unit 120 includes a signal processing circuit 121, a booster circuit 122, and a low pass filter (LPF) 123. The signal processing circuit 121 may be configured using a digital signal processor (DSP) that includes an equalizer, A/D converter circuit, or the like and performs necessary signal processing, such as equalizing, D/A conversion, or the like on a digital signal from the control unit 130 to generate an analog playback sound signal, outputting the analog playback sound signal to the booster circuit 122. The functions of the signal processing circuit 121 may be internal to the control unit 130.

The booster circuit 122 boosts the voltage of the input analog playback sound signal and applies the result to the laminated piezoelectric element 61 via the LPF 123. The maximum voltage of the playback sound signal applied to the laminated piezoelectric element 61 by the booster circuit 122 may, for example, be from 10 Vpp to 50 Vpp, yet the voltage is not limited to this range and may be adjusted appropriately in accordance with the weight of the mobile phone 10 and the performance of the laminated piezoelectric element 61. For the playback sound signal applied to the laminated piezoelectric element 61, direct current may be biased, and the maximum voltage may be set centered on the bias voltage.

Figure 21:
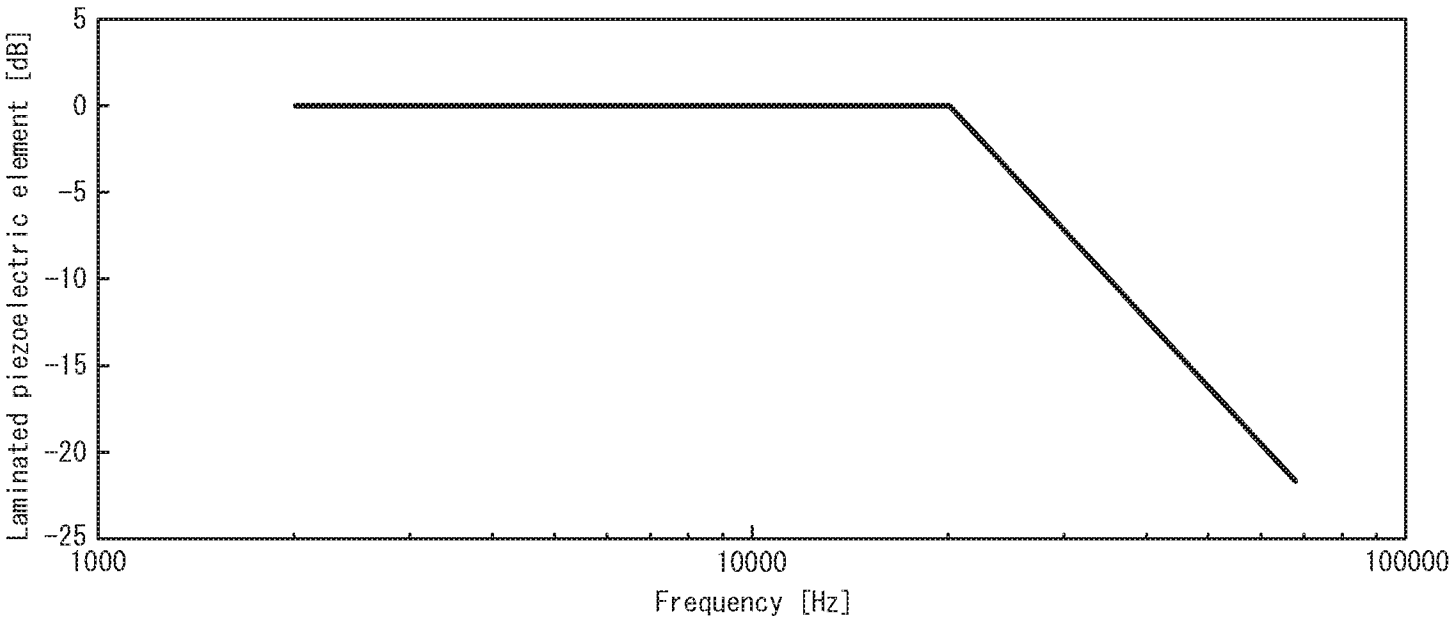
FIG. 21 illustrates an example of the frequency characteristic of the LPF in FIG. 20.

For piezoelectric elements in general, not just the laminated piezoelectric element 61, power loss increases as the frequency becomes higher. Therefore, the LPF 123 is set to have a frequency characteristic that attenuates or cuts at least a portion of a frequency component of approximately 10 kHz to 50 kHz or more, or to have a frequency characteristic such that the attenuation rate increases gradually or stepwise. As an example, FIG. 21 illustrates the frequency characteristic of the LPF 123 when the cutoff frequency is approximately 20 kHz. Thus attenuating or cutting the high-frequency component can suppress power consumption.

Figure 22:
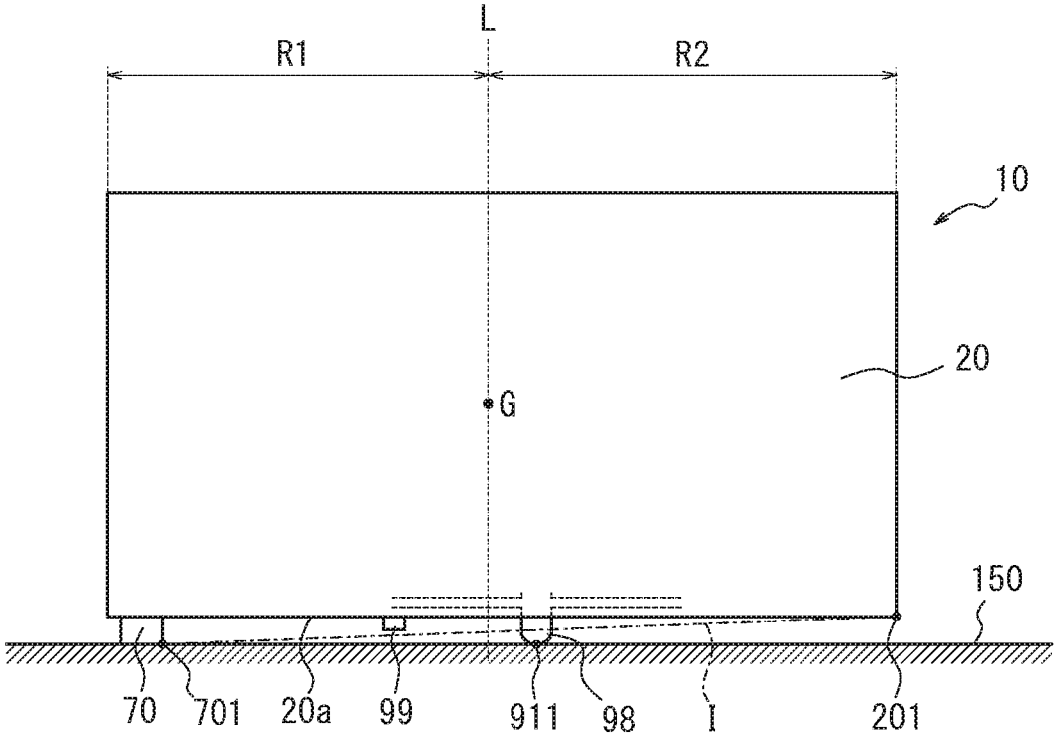
FIG. 22 illustrates the arrangement of the vibration unit, the protrusion, and the elastic member in the sound generator in FIG. 15.

Next, with reference to FIG. 22, the arrangement of the vibration unit 98, the protrusion 99, and the elastic member 70 is described. FIG. 22 illustrates a state in which the mobile phone 10 is mounted on a horizontal contact surface 150, such as a desk, with the bottom side 20*a* downwards while the cover 97 is in the first position. The desk referred to here is an example of a contacted member in the present disclosure, and the contact surface 150 is an example of a contact surface that the sound generator contacts. As illustrated in FIG. 22, the mobile phone 10 is supported at two points on the contact surface 150 by the vibration unit 98 and the elastic member 70. Point G is the center of gravity of the mobile phone 10. In other words, the point G is the center of gravity of the anchor in the sound generator.

In FIG. 22, the elastic member 70 has a lowermost edge 701. The lowermost edge 701 is, within the elastic member 70, the location that abuts the horizontal contact surface 150, such as a desk, when the mobile phone 10 is mounted on the contact surface 150 with the bottom side 20*a* downwards.

The vibration unit 98 has a lowermost edge 911. The lowermost edge 911 is, within the vibration unit 98, the location that abuts the horizontal contact surface 150, such as a desk, when the mobile phone 10 is mounted on the contact surface 150 with the bottom side 20*a* downwards. The lowermost edge 911 is, for example, the tip of the cap 94.

The mobile phone 10 has a lowermost edge 201. The lowermost edge 201 is, within the mobile phone 10, the location that would abut the horizontal contact surface 150, such as a desk, when the mobile phone 10 is mounted on the contact surface 150 with the bottom side 20*a* downwards if the vibration unit 98 did not exist. A non-limiting example of the lowermost edge 201 of the mobile phone 10 is a corner of the housing 20. When a protrusion protrudes from the bottom side 20*a*, this protrusion may be the lowermost edge 201 of the mobile phone 10. The protrusion may, for example, be a side key, a connector cap, or the like.

In FIG. 22, a dashed line L is a line (virtual line) that traverses the center of gravity G of the mobile phone 10 and is perpendicular to the horizontal contact surface 150, such as a desk, when the mobile phone 10 is mounted on the contact surface 150 with the bottom side 20*a* downwards. An alternate long and short dash line I is a line (virtual line) that connects the lowermost edge 701 of the elastic member 70 and the lowermost edge 201 of the mobile phone 10 assuming the vibration unit 98 does not exist.

In FIG. 22, the region R1 is a region at one side of the mobile phone 10, separated by the dashed line L. The region R2 is a region at the other side of the mobile phone 10, separated by the dashed line L. The elastic member 70 is provided on the bottom side 20*a* in the region R1. The vibration unit 98 is provided on the bottom side 20*a* in the region R2.

In the region R2 of the bottom side 20*a*, the vibration unit 98 is preferably provided at a position as close as possible to the dashed line L. The load on the vibration unit 98 via the piezoelectric vibrator 60 thus increases as compared to when the vibration unit 98 is provided at a position distant from the dashed line L on the bottom side 20*a* in the region R2. Hence, the mobile phone 10 can effectively be used as an anchor for the sound generator.

In the region R1 of the bottom side 20*a*, the elastic member 70 is preferably provided at a position as far as possible from the dashed line L. A sufficient distance can thus be ensured between the elastic member 70 and the piezoelectric vibrator 60 even when the piezoelectric vibrator 60 is placed at a position as close as possible to the dashed line L. Hence, the sound generator can be stably mounted on the contact surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 911 of the vibration unit 98 is preferably located towards the contact surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 911 preferably projects towards the contact surface 150 from the alternate long and short dash line I. In this way, the contact surface 150 can appropriately be vibrated by the piezoelectric vibrator 60.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 911 of the vibration unit 98 is preferably located towards the contact surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 911 preferably projects towards the contact surface 150 from the alternate long and short dash line I. Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the protrusion 99 is preferably located towards the housing 20 from the alternate long and short dash line I. It is thus more difficult for the lowermost edge 201 of the mobile phone 10 and the protrusion 99 to contact the contact surface 150, which for example depending on the type of paint on the housing 20, makes it more difficult for the paint to peel off. Abnormal noise is also less likely to be emitted between the contact surface 150 and the lowermost edge 201 or the protrusion 99.

A commercially available stand or the like may be attached to the housing 20, for example, and the mobile phone 10 may be stood on a contact surface, such as a desk, with the bottom side 20*a* downwards. In this case, the bottom side 20*a* is supported at two points by the vibration unit 98 and the elastic member 70, and the mobile phone 10 is further supported by the stand.

Figure 23A:
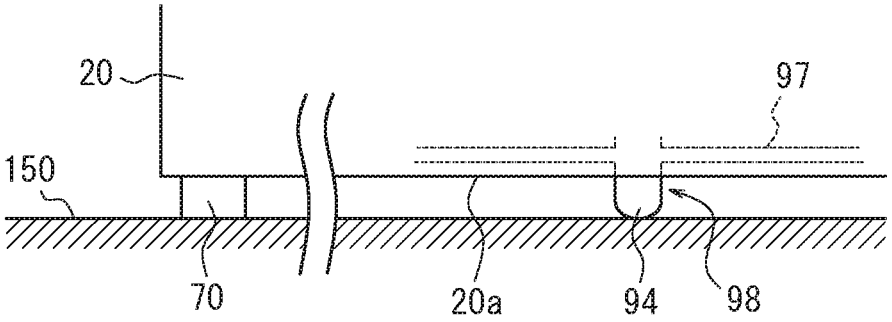
FIG. 23A schematically illustrates operation of the mobile phone in FIG. 15 as a sound generator.
Figure 23B:
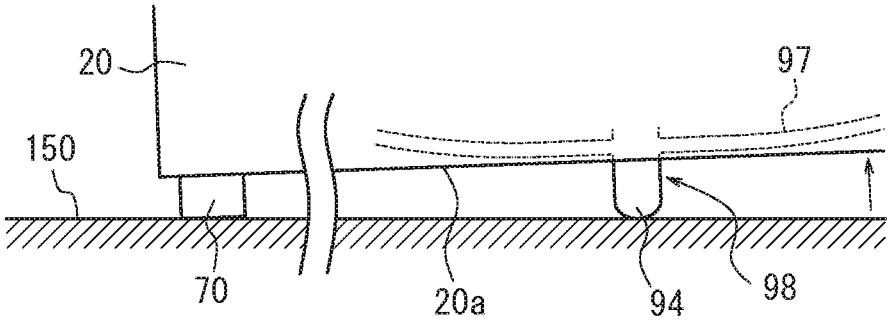
FIG. 23B schematically illustrates operation of the mobile phone in FIG. 15 as a sound generator.
Figure 23C:
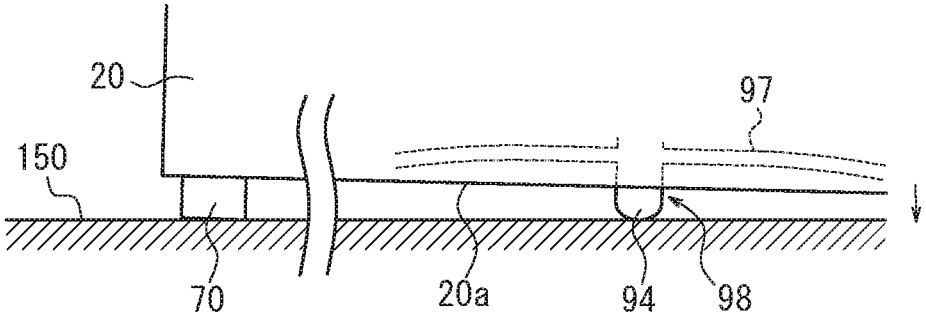
FIG. 23C schematically illustrates operation of the mobile phone in FIG. 15 as a sound generator.

FIGS. 23A, 23B, and 23C schematically illustrate operation of the mobile phone 10 according to the present embodiment as a sound generator. When causing the mobile phone 10 to function as a sound generator, the mobile phone 10 is stood horizontally with the bottom side 20*a* of the housing 20 downwards and the cover 97 at the first position, so that the cap 94 of the vibration unit 98 and the elastic member 70 contact the contact surface 150, such as a desk, as illustrated in FIG. 23A. In this way, the weight of the mobile phone 10 is provided to the vibration unit 98 as a load via the piezoelectric vibrator 60. In other words, the mobile phone 10 acts as an anchor for the sound generator according to the present disclosure. Note that in the state illustrated in FIG. 23A, no voltage is applied to the laminated piezoelectric element 61, and the laminated piezoelectric element 61 is neither expanding nor contracting.

In this state, when the laminated piezoelectric element 61 of the piezoelectric vibrator 60 is driven by a playback sound signal, the laminated piezoelectric element 61 vibrates by expanding and contracting. FIG. 23B is an exaggerated view of the laminated piezoelectric element 61 in the expanded state. The vibration unit 98 receives a force from the piezoelectric vibrator 60, and by bending, the cover 97 projects from the housing 20 towards the contact surface 150 more than when the laminated piezoelectric element 61 is at rest (the state illustrated in FIG. 23A). FIG. 23C is an exaggerated view of the laminated piezoelectric element 61 in the contracted state. At this time, due to application of the load of the mobile phone 10, the cover 97 bends, and the vibration unit 98 withdraws towards the housing 20 more than when the laminated piezoelectric element 61 is at rest. In this way, by alternating between the states illustrated in FIGS. 23B and 23C, the vibration unit 98 vibrates in accordance with the playback sound signal with the portion of the elastic member 70 contacting the contact surface 150 acting as a pivot, and without the cap 94 separating from the contact surface 150. As long as problems such as the lowermost edge 201 contacting the contact surface 150 and emitting abnormal noise do not occur, the cap 94 may separate slightly from the contact surface 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the contact surface 150 through the vibration unit 98, and the contact surface 150 vibrates, causing the contact surface 150 to function as a vibration speaker by emitting sound. If the difference in length between full expansion and full contraction is less than 0.05 μm, it may not be possible to vibrate the contact surface appropriately. Conversely, if the difference exceeds 50 μm, vibration grows large, and the sound generator may wobble.

As described above, when the laminated piezoelectric element 61 is fully expanded, the tip of the cap 94 is preferably located towards the contact surface 150 from a line (the alternate long and short dash line I in FIG. 22) connecting the lowermost edge 701 of the elastic member 70 and the lowermost edge 201 of the mobile phone 10 assuming the vibration unit 98 does not exist. Furthermore, when the laminated piezoelectric element 61 is fully contracted, the tip of the cap 94 is preferably located towards the contact surface 150 from this virtual line.

Furthermore, the distance d between the surface 20*c* and the tip of the protrusion 63*b* illustrated in FIG. 17 is preferably greater than the amount of displacement when the laminated piezoelectric element 61 is fully contracted from a state in which no voltage is applied thereto so that the laminated piezoelectric element 61 is not expanding or contracting. In this way, even when the laminated piezoelectric element 61 is fully contracted (the state illustrated in FIG. 23C), vibration of the laminated piezoelectric element 61 can be transmitted to the contact surface 150 without the vibration unit 98 separating from the protrusion 63*b*.

The locations at which the vibration unit 98 and the piezoelectric vibrator 60 are disposed, the length of the laminated piezoelectric element 61 in the lamination direction, the dimensions of the cap 94, and the like are appropriately determined so as to satisfy the above conditions.

According to the sound generator of the present embodiment, a piezoelectric element is used as the source of vibration, hence reducing the number of components as compared to a vibration generating device having a dynamic speaker configuration and achieving a simple structure with few components, thereby allowing for a reduction in size and weight. Furthermore, the stack-type laminated piezoelectric element 61 is used as the piezoelectric element and vibrates by expanding and contracting along the lamination direction due to a playback sound signal. Since this expanding and contracting vibration is transmitted to the contact surface 150, the vibration transmission efficiency with respect to the contact surface 150 in the expansion and contraction direction (deformation direction) is good, and the contact surface 150 can be vibrated efficiently. Moreover, since the laminated piezoelectric element 61 contacts the vibration unit 98 with the cover member 64 therebetween, damage to the laminated piezoelectric element 61 can also be prevented. By standing the mobile phone 10 horizontally so that the cap 94 of the vibration unit 98 contacts the contact surface 150, the weight of the mobile phone 10 is applied as a load to the cap 94 via the piezoelectric vibrator 60. Hence, the cap 94 can reliably contact the contact surface 150, and the expanding and contracting vibration of the piezoelectric vibrator 60 can efficiently be transmitted to the contact surface 150.

According to the sound generator of the present embodiment, when not using the sound generator to cause sound to be emitted, the vibration unit 98 can be placed in the non-contact state with the piezoelectric vibrator 60 by manipulating the cover 97. By doing so, the piezoelectric vibrator 60 is covered by the cover 97 and hence protected from external shocks. Furthermore, according to the sound generator of the present embodiment, the switching between the first position and the second position by displacement of the cover 97 is coordinated with a function for switching the sound signal to the piezoelectric element 61. Therefore, when not using the sound generator to cause sound to be emitted, moving the cover 97 to the second position can both place the vibration unit 98 in the non-contact state with the piezoelectric vibrator 60 and also stop a sound signal from being input to the piezoelectric element 61. By thus coordinating operation of the cover 97 with a function for switching the sound signal to the piezoelectric element 61, operation can be simplified as compared to when the cover 97 and a switch are provided separately.

Embodiment 4

Figure 24:
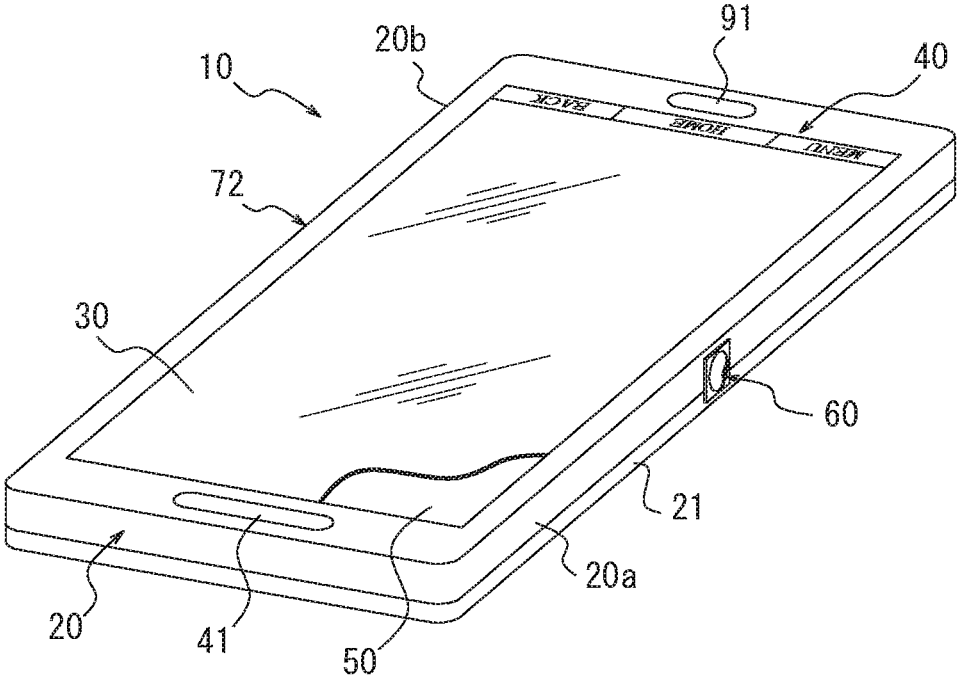
FIG. 24 is an external perspective view schematically illustrating the structure of a sound generator according to Embodiment 4 of the present disclosure.

FIG. 24 is an external perspective view of a sound generator according to Embodiment 4 of the present disclosure. The sound generator according to the present embodiment includes a mobile phone 10, such as a smartphone, and a piezoelectric vibrator 60. As described below, the mobile phone 10 acts as an anchor (the anchor in the sound generator) providing a load to the piezoelectric vibrator 60. The sound generator according to the present embodiment includes the piezoelectric vibrator 60 for a sound generator on a bottom side 20*a*, which is one of the long sides of a housing 20 in the mobile phone 10. The bottom side 20*a* faces a contact surface, such as a desk, when the mobile phone 10 is mounted horizontally on the contact surface. The following describes the differences from Embodiment 1, omitting a description of common features.

In the housing 20, a panel 30, an input unit 40, a speaker 41, and a microphone 91 are provided at the front side of the mobile phone 10, and as illustrated by the partial cutout of the panel 30 in FIG. 24, a display unit 50 is held below the panel 30. A proximity sensor 72 is disposed on the housing 20 at a top side 20*b* opposite the bottom side 20*a*. In the mobile phone 10, the microphone 91 and the proximity sensor 72 are detection mechanisms forming a detection unit that detects two states. The two states that the detection unit detects and the concrete detection method thereof are described below. A battery pack, camera unit, and the like are installed at the back side of the housing 20 and covered by a battery lid 21.

The speaker 41 is a sound output device, such as a dynamic speaker or a capacitor speaker, and outputs sound based on a sound signal applied by a control unit included in the mobile phone 10.

The microphone 91 detects speech of the user during a phone call and detects sound emitted from the contact surface during sound generation by the piezoelectric vibrator 60. The proximity sensor 72 is a sensor that detects the presence of a detection target without contact and may, for example, be a camera, an infrared sensor, an acoustic sensor, or the like.

Figure 25:
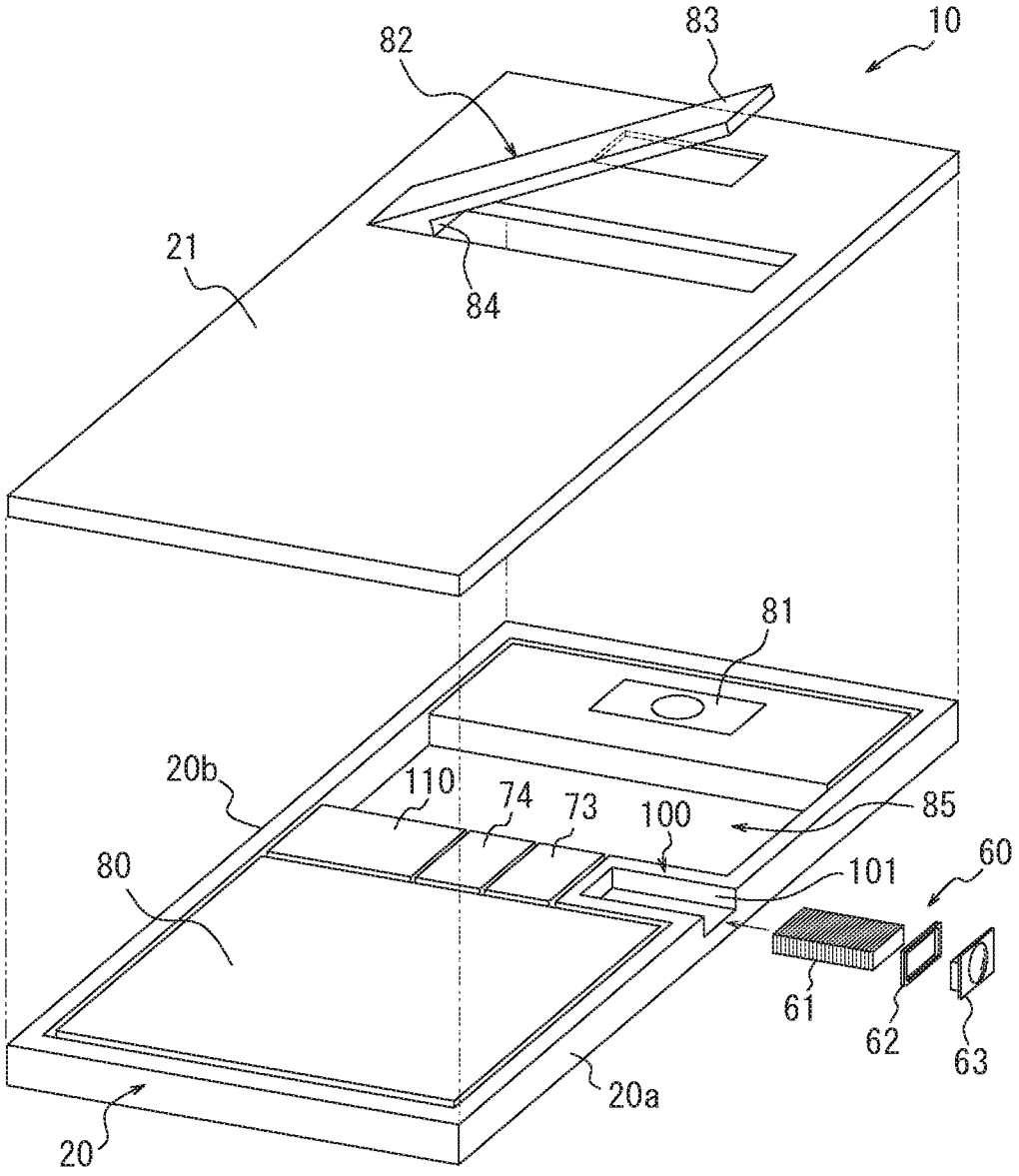
FIG. 25 is an external, exploded perspective view of the main parts at the back side of the mobile phone in FIG. 24.

FIG. 25 is an exploded perspective view schematically illustrating the main parts at the back side of the mobile phone 10 in FIG. 24. A battery pack 80, a camera unit 81, and the like are installed at the back side of the housing 20. Inside the housing 20, the mobile phone 10 also includes an inclination detection sensor 73 that detects the below-described inclination of the piezoelectric element in the piezoelectric vibrator 60, a vibration detection sensor 74 that detects vibration applied to the mobile phone 10, and a wireless communication unit 110. The inclination detection sensor 73 and the vibration detection sensor 74 are detection mechanisms forming the detection unit that detects two states and are, for example, configured using an acceleration sensor. The wireless communication unit 110 has a well-known communication function for the mobile phone 10 and can acquire information on the position of the mobile phone 10 by acquiring position information via a Global Positioning System (GPS) function or by acquiring connection information on a Wireless Fidelity (WiFi) access point.

As described below with reference to FIG. 27, the laminated piezoelectric element 61 is supplied with a sound signal (playback sound signal) from a control unit 130 via a digital signal processor (DSP) 124. In other words, voltage corresponding to a sound signal is applied to the laminated piezoelectric element 61 from the control unit 130 via the DSP 124.

Referring again to FIG. 25, the mobile phone 10 includes a stand 82 that is openable and closable with respect to the battery lid 21, i.e. the housing 20. The stand 82 includes a leg 83 and an attaching portion 84 acting as a pivot during opening and closing. In the present embodiment, while housed in the housing 20, the stand 82 includes the attaching portion 84 at a top side 20*b* of the housing 20 opposite the bottom side 20*a*, and the leg 83 extends towards the bottom side 20*a* along the transverse direction of the housing 20. A space 85 for housing the stand 82 included in the battery lid 21 is provided in the housing 20 of the mobile phone 10. When the mobile phone 10 is mounted on a horizontal contact surface 150, such as a desk, with the bottom side 20*a* downwards, i.e. when stood horizontally, the mobile phone 10 is supported by at least the leg 83 and the piezoelectric vibrator 60 that contact the contact surface 150. The stand 82 is preferably provided so that when the mobile phone 10 is stood horizontally, the inclination angle of the panel 30 can be adjusted.

Figure 26A:
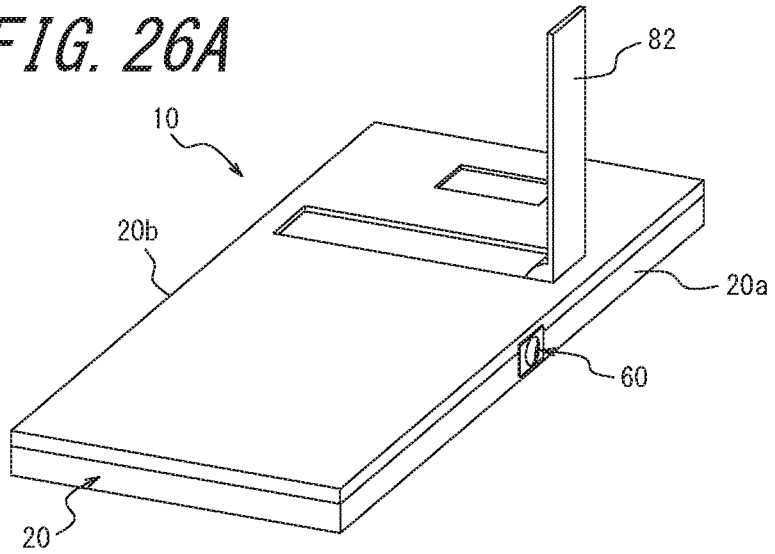
FIG. 26A illustrates a modification to the stand at the back side of the mobile phone.
Figure 26B:
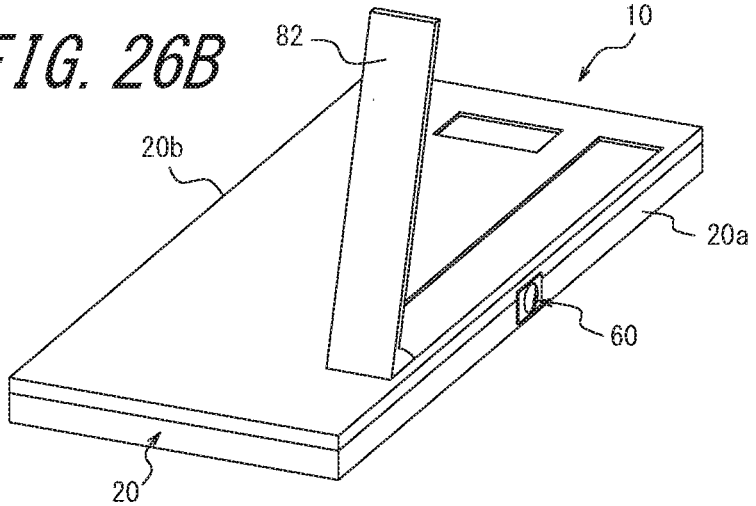
FIG. 26B illustrates another modification to the stand at the back side of the mobile phone.
Figure 26C:
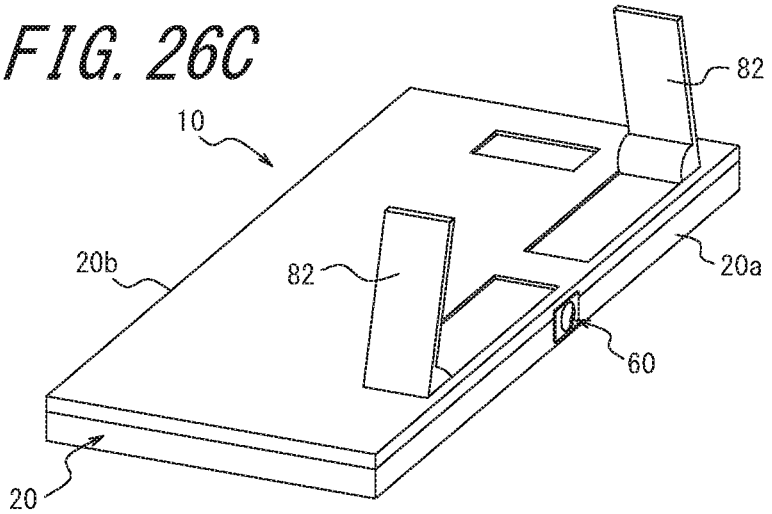
FIG. 26C illustrates yet another modification to the stand at the back side of the mobile phone.

The stand 82 is not limited to the above-described configuration. For example, as illustrated in FIG. 26A, while housed in the housing 20, the stand 82 may include the attaching portion 84 at the bottom side 20*a* of the housing 20, and the leg 83 may extend towards the top side 20*b* along the transverse direction of the housing 20. Alternatively, for example as illustrated in FIG. 26B, while housed in the housing 20, the stand 82 may include the attaching portion 84 at one side of the housing 20, and the leg 83 may extend towards the other side along the longitudinal direction of the housing. The mobile phone 10 may also be provided with a plurality of stands 82, for example as illustrated in FIG. 26C.

Figure 27:
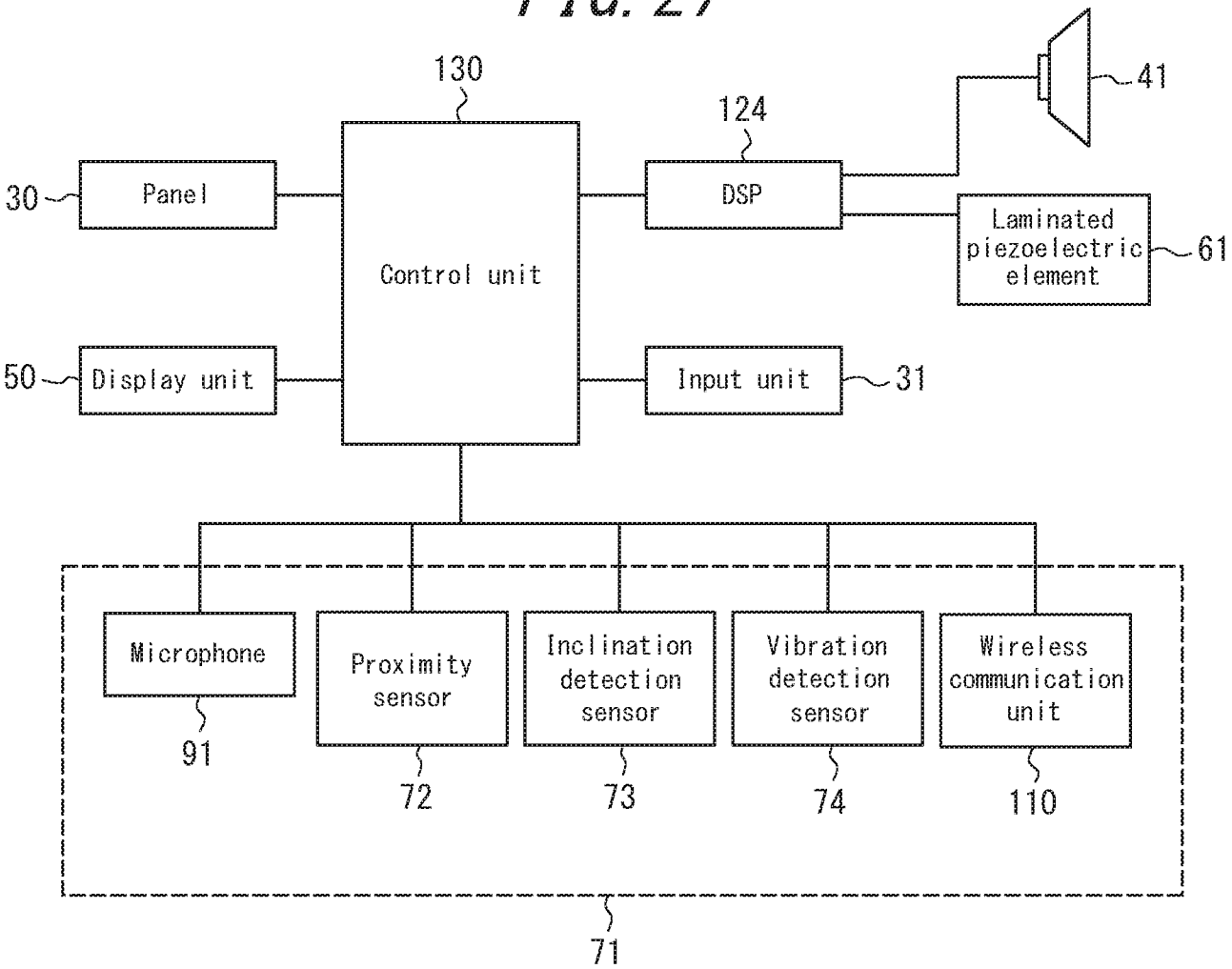
FIG. 27 is a functional block diagram of the main portions of the mobile phone in FIG. 24.

FIG. 27 is a functional block diagram of the main portions of the mobile phone 10. In addition to the above-described panel 30, input unit 40, speaker 41, display unit 50, laminated piezoelectric element 61, microphone 91, proximity sensor 72, inclination detection sensor 73, vibration detection sensor 74, and wireless communication unit 110, the mobile phone 10 includes the DSP 124 and the control unit 130. The microphone 91, proximity sensor 72, inclination detection sensor 73, vibration detection sensor 74, and wireless communication unit 110 are examples of detection mechanisms forming the detection unit 71. The detection unit 71 need not include all of the five detection mechanisms illustrated in FIG. 27. It suffices for at least one detection mechanism to be included. The panel 30, input unit 40, display unit 50, and each of the detection mechanisms connect to the control unit 130. The speaker 41 and the laminated piezoelectric element 61 connect to the control unit 130 via the DSP 124. The DSP 124 may be internal to the control unit 130.

The control unit 130 is a processor that controls overall operations of the mobile phone 10. In accordance with the two states detected by the detection unit 71, the control unit 130 controls the playback sound signal that is applied to the speaker 41 or the laminated piezoelectric element 61 via the DSP 124 (voltage corresponding to a playback sound signal of the other party's voice, a ringtone, music including songs, or the like). Note that the playback sound signal may be based on music data stored in internal memory or may be music data stored on an external server or the like and played back over a network.

Detection of the two states by the detection unit 71 using the detection mechanisms is now described. Using any of the detection mechanisms, the detection unit 71 detects two states, namely a driving allowed state that allows driving of the piezoelectric element 61 and a driving denied state that denies driving of the piezoelectric element 61.

First, the case of using the microphone 91 as a detection mechanism is described. When the mobile phone 10 is, for example, used by being placed on a bed or the like, vibration of the piezoelectric element 61 is absorbed by the soft bed, which is the contact surface 150. Therefore, it is difficult to obtain good sound from the contact surface 150. Accordingly, when sound is to be generated by driving the piezoelectric element 61, the contact surface 150 on which the mobile phone 10 is stood horizontally is preferably a hard material from which sound having at least a predetermined setting value is emitted. When the contact surface 150 is soft, instead of driving the piezoelectric element 61, sound is preferably emitted from the speaker 41. Accordingly, the control unit 130 preferably controls application of a sound signal to the piezoelectric element 61 or the speaker 41 in accordance with the level of sound emitted from the contact surface 150.

Therefore, the microphone 91 first acquires sound emitted from the contact surface 150, and the detection unit 71 detects the driving allowed state and the driving denied state based on whether the volume of the acquired sound is at least the setting value. In accordance with the state detected by the detection unit 71, the control unit 130 then controls application of a sound signal to the piezoelectric element 61 or the speaker 41. In greater detail, before outputting sound that the user of the mobile phone 10 is attempting to play back, the control unit 130 applies a pure sound sweep signal at a constant level to the piezoelectric element 61 as a sound signal, thereby vibrating the piezoelectric element 61 to cause sound to be emitted from the contact surface 150. The microphone 91 acquires the sound emitted from the contact surface 150, and when the volume of the acquired sound is at least the setting value, the detection unit 71 detects the driving allowed state. Conversely, when the volume of the acquired sound is less than the setting value, the detection unit 71 detects the driving denied state. The setting value for the volume used for detection of the state may be any value, such as 40 db. The pure sound sweep signal may be a signal in a frequency range that is difficult for the human ear to hear.

When the detection unit 71 detects the driving allowed state, the control unit 130 applies a sound signal to the piezoelectric element 61. Conversely, when the detection unit 71 detects the driving denied state, the control unit 130 does not apply a sound signal to the piezoelectric element 61, or when a sound signal is already being applied, suspends application of the sound signal. When not applying a sound signal to the piezoelectric element 61, the control unit 130 may apply a sound signal to the speaker 41. Note that operations of the control unit after the detection unit 71 detects either the driving allowed state or the driving denied state are similar in the case of the other detection mechanisms described below.

Detection of the two states using the microphone 91 may be performed only once before application of a sound signal or may be performed successively while a sound signal is being applied to the piezoelectric element 61. Detection of the state using the microphone 91 may also be performed when movement of the mobile phone 10 is detected by the below-described vibration detection sensor 74. When the detection unit 71 detects the state successively while a sound signal is being applied to the piezoelectric element 61, the detection unit 71 may acquire, from the microphone 91, the sound emitted from the contact surface 150 due to application of the sound signal to the piezoelectric element 61 and detect the state based on whether the volume of the acquired sound is at least equal to the setting value. Detection may be performed continuously, periodically, or irregularly. When detecting the state based on the sound emitted from the contact surface 150 due to the sound signal applied to the piezoelectric element 61, the setting value of the volume used for detection of the two states may be different from the setting value when detecting the state with the pure sound sweep signal. For example, when the user increases the setting of the volume output from the mobile phone 10, the setting value of the volume used for detection of the state may be increased.

In addition to the sound emitted from the contact surface 150, the microphone 91 may also acquire surrounding noise. In order to prevent erroneous detection of the state due to the effect of noise, when no sound signal is output from the control unit 130 or output is low, the mobile phone 10 may acquire surrounding sound from the microphone 91 and store the sound in a non-illustrated storage unit of the mobile phone 10. When subsequently detecting the state, the mobile phone 10 may first execute processing to cancel sound corresponding to the stored noise from the sound acquired by the microphone 91 and then detect the state.

Next, the case of using the proximity sensor 72 as a detection mechanism is described. For example, even when the user is listening to sound emitted from the contact surface 150 upon application of the sound signal to the piezoelectric element 61, the user may temporarily step away from the mobile phone 10. In this case, no user listening to sound is near the mobile phone 10. Hence, sound need not be generated. It would therefore be advantageous to suspend sound automatically when the user steps away from the mobile phone 10. In other words, the control unit 130 preferably controls application of a sound signal to the piezoelectric element 61 or the speaker 41 in accordance with whether somebody is nearby.

Therefore, the proximity sensor 72 acquires information on whether a person is nearby. Based on the acquired information, the detection unit 71 detects the driving allowed state and the driving denied state, and in accordance with the detected state, the control unit 130 controls application of the sound signal to the piezoelectric element 61 or the speaker 41. In greater detail, when the proximity sensor 72 has confirmed the presence of a detection target near the mobile phone 10, the detection unit 71 detects the driving allowed state, whereas when the proximity sensor 72 has not confirmed the presence of a detection target near the mobile phone 10, the detection unit 71 detects the driving denied state. In other words, upon the proximity sensor 72 confirming the presence of a person, who is a detection target, near the mobile phone 10, the detection unit 71 detects the driving allowed state. Hence, the control unit 130 applies a sound signal to the piezoelectric element 61. Conversely, when the proximity sensor 72 confirms that nobody is near the mobile phone 10, the detection unit 71 detects the driving denied state, and the control unit 130 can suspend application of the sound signal to the piezoelectric element 61.

The proximity sensor 72 may confirm the presence of a detection target near the mobile phone 10 continuously, periodically, or irregularly. In the above-described example, when the proximity sensor 72 confirms the presence of a detection target, the detection unit 71 detects the driving allowed state, whereas when the proximity sensor 72 has not confirmed the presence of a detection target, the detection unit 71 detects the driving denied state. Detection of the driving allowed state and the driving denied state by the detection unit 71 may, however, be reversed. In other words, when the proximity sensor 72 has not confirmed the presence of a detection target, the detection unit 71 may detect the driving allowed state, and the control unit 130 may apply a sound signal to the piezoelectric element 61. Conversely, when the proximity sensor 72 confirms a detection target, the detection unit 71 may detect the driving denied state, and the control unit 130 may suspend application of the sound signal to the piezoelectric element 61.

Figure 28A:
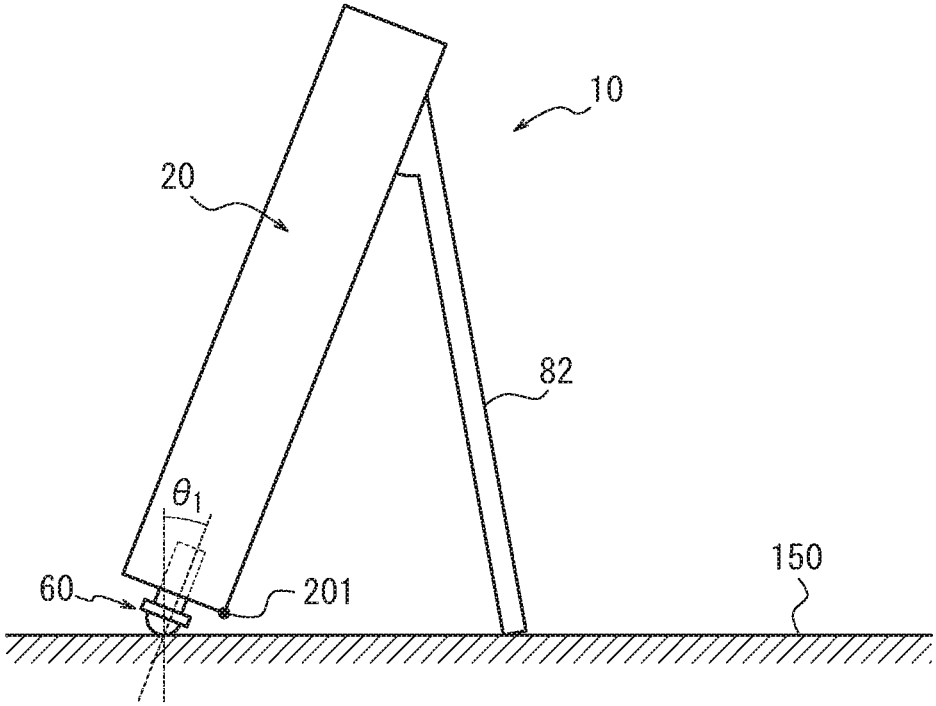
FIG. 28A is a side view illustrating use of the stand to mount the mobile phone in FIG. 24 on a contact surface.
Figure 28B:
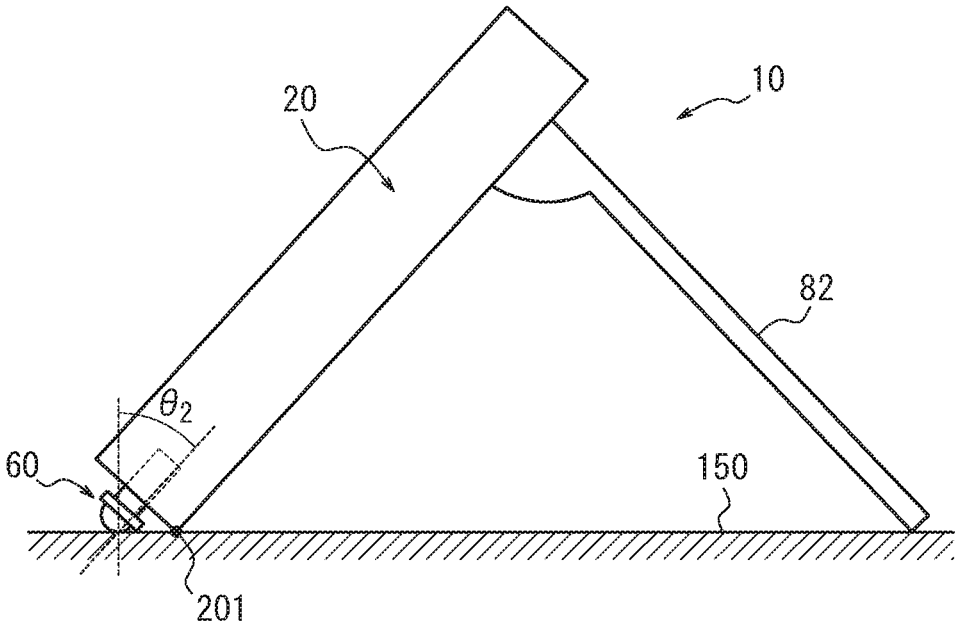
FIG. 28B is a side view illustrating use of the stand to mount the mobile phone in FIG. 24 on a contact surface.

Next, use of the inclination detection sensor 73 as a detection mechanism is described with reference to FIG. 28A and FIG. 28B. FIG. 28A and FIG. 28B illustrate a state in which the mobile phone 10 is mounted on a horizontal contact surface 150, such as a desk, using the stand 82. As illustrated in FIG. 28A and FIG. 28B, the mobile phone 10 is supported on the contact surface 150 by the piezoelectric vibrator 60 and the stand 82 (leg 83). The mobile phone 10 has a lowermost edge 201. The lowermost edge 201 is, within the mobile phone 10, the location that would abut the horizontal contact surface 150, such as a desk, when the mobile phone 10 is mounted on the contact surface 150 with the bottom side 20*a* downwards if the piezoelectric vibrator 60 did not exist. A non-limiting example of the lowermost edge 201 of the mobile phone 10 is a corner of the housing 20. When a protrusion protrudes from the bottom side 20*a*, this protrusion may be the lowermost edge 201 of the mobile phone 10. The protrusion may, for example, be a side key, a connector cap, or the like.

As illustrated in FIG. 28A, when the mobile phone 10 is mounted horizontally, the load from the mobile phone 10 acting as an anchor is sufficiently applied to the piezoelectric vibrator 60 when the angle θ (inclination θ) of the piezoelectric element 61 with respect to the perpendicular direction is less than a predetermined angle $\theta_0$ (the case of $\theta_1$ in FIG. 28A). In this way, the piezoelectric vibrator 60 can appropriately vibrate the contact surface 150, so that good sound is emitted from the contact surface 150. On the other hand, as illustrated in FIG. 28B, when the angle θ (inclination θ) of the piezoelectric element 61 with respect to the perpendicular direction is at least a predetermined angle $\theta_0$ (the case of $\theta_2$ in FIG. 28B), a sufficient load cannot be provided from the mobile phone 10 to the piezoelectric vibrator 60. As a result, it is difficult to cause good sound to be emitted from the contact surface 150. Furthermore, when the angle of the piezoelectric element 61 is $\theta_2$, the magnitude of the horizontal component received by the housing 20 of the mobile phone 10 as a reaction to the force applied to the contact surface 150 by vibration of the piezoelectric element 61 increases as compared to when the angle of the piezoelectric element 61 is $\theta_1$. Therefore, the mobile phone 10 might move sideways. If the mobile phone 10 moves while mounted on, for example, a desk or the like, the mobile phone 10 might fall from the desk, and the mobile phone 10 or the piezoelectric vibrator 60 might malfunction due to the shock of the fall. Furthermore, if the angle $\theta_2$ is large and the lowermost edge 201 contacts the contact surface 150, abnormal noise may be generated between the lowermost edge 201 and the contact surface 150 when the piezoelectric element 61 vibrates. Accordingly, application of a sound signal to the piezoelectric element 61 or the speaker 41 is preferably controlled in accordance with the inclination θ of the piezoelectric element 61.

Therefore, the inclination detection sensor 73 detects the inclination of the piezoelectric element 61, and the detection unit 71 detects the driving allowed state and the driving denied state based on the inclination θ of the piezoelectric element 61. In accordance with the state detected by the detection unit 71, the control unit 130 then controls application of a sound signal to the piezoelectric element 61 or the speaker 41. In greater detail, when the inclination θ of the piezoelectric element 61 is less than a predetermined angle $\theta_0$, the detection unit 71 detects the driving allowed state. Conversely, when the inclination θ of the piezoelectric element 61 is at least the predetermined angle $\theta_0$, the detection unit 71 detects the driving denied state. The predetermined angle $\theta_0$ may be set appropriately based, for example, on factors such as the size of the mobile phone 10 and the piezoelectric vibrator 60, the weight of the mobile phone 10, and the length and position of the stand 82. For example, the predetermined angle $\theta_0$ may be 30°.

Next, the case of using the vibration detection sensor 74 as a detection mechanism is described. When the mobile phone 10 is, for example, used by being placed on a bed or the like, vibration of the piezoelectric element 61 is absorbed by the soft bed, which is the contact surface 150. Therefore, it is difficult to obtain good sound from the contact surface 150. Accordingly, when sound is to be generated by driving the piezoelectric element 61, the contact surface 150 on which the mobile phone 10 is stood horizontally is preferably a hard material to which vibration of the piezoelectric element 61 is sufficiently transmitted. When the contact surface 150 is soft, instead of driving the piezoelectric element 61, sound is preferably emitted from the speaker 41. Accordingly, the control unit 130 preferably controls application of a sound signal to the piezoelectric element 61 or the speaker 41 in accordance with whether the contact surface 150 is a hard material. Here, when sound is caused to be emitted from the contact surface 150 by driving of the piezoelectric element 61, if the contact surface 150 is sufficiently hard, the mobile phone 10 receives vibration as a reaction to the force applied to the contact surface 150 due to vibration of the piezoelectric element 61. The mobile phone 10 then vibrates with an amplitude in accordance with vibration of the piezoelectric element 61. In other words, by the vibration detection sensor 74 detecting vibration of the mobile phone 10, it can be judged whether the contact surface 150 is a hard material.

Therefore, the vibration detection sensor 74 detects vibration of the mobile phone 10, and the detection unit 71 detects the driving allowed state and the driving denied state based on the vibration of the mobile phone 10. In accordance with the state detected by the detection unit 71, the control unit 130 then controls application of a sound signal to the piezoelectric element 61 or the speaker 41. In greater detail, the vibration detection sensor 74 acquires the vibration waveform of the mobile phone 10. When the contact surface 150 is sufficiently hard and does not absorb vibration of the piezoelectric element 61, the mobile phone 10 vibrates at the same amplitude as the amplitude of vibration by the piezoelectric element 61. When the material of the contact surface 150 is not sufficiently hard, however, the amplitude of the mobile phone 10 is reduced by the amount of vibration of the piezoelectric element 61 that is absorbed in correspondence with the material. Accordingly, the detection unit 71 detects the two states based on whether the ratio of the vibration amplitude of the mobile phone 10 to the vibration amplitude of the piezoelectric element 61 is at least a predetermined ratio. When the ratio of the amplitude of the mobile phone 10 to the amplitude of the piezoelectric element 61 is at least a predetermined ratio, the detection unit 71 detects the driving allowed state, whereas when the ratio is less than the predetermined ratio, the detection unit 71 detects the driving denied state. The predetermined ratio may be set to any value, such as 50%. When the predetermined ratio is set to 50%, and the amount of elongation (amplitude) of the piezoelectric element 61 is, for example, 10 μm, then the detection unit 71 detects the driving allowed state when the amplitude of the mobile phone 10 is at least 5 μm and detects the driving denied state when the amplitude is less than 5 μm.

Note that the vibration detection sensor 74 can be used not only to detect the amplitude of vibration that the mobile phone 10 receives as a reaction to vibration of the piezoelectric element 61 but also to detect movement of the mobile phone 10. Movement of the mobile phone 10 is detected by the vibration detection sensor 74 detecting the vibration frequency of the mobile phone 10. For example, suppose the vibration detection sensor 74 detects vibration at a frequency of 1 kHz to 2 kHz, which is the vibration frequency when a person walks. In this case, the detection unit 71 confirms that the mobile phone 10 is moving and is not mounted on the contact surface 150. The detection unit 71 therefore detects the driving denied state. When the vibration detection sensor 74 does not detect vibration at such a frequency, the detection unit 71 can detect the driving allowed state.

Next, the case of using the wireless communication unit 110 as a detection mechanism is described. As information on the position of the mobile phone 10, the wireless communication unit 110 is described as acquiring position information with a GPS function. When using the mobile phone 10 to generate sound, there are some places in which sound should not be generated, for example a library or other such public facility. It would be advantageous for the mobile phone 10 to automatically suspend generation of sound in such locations. In other words, the control unit 130 preferably controls application of a sound signal to the piezoelectric element 61 or the speaker 41 in accordance with the position of the mobile phone 10.

Therefore, the wireless communication unit 110 acquires position information using a GPS function. Based on the position information, the detection unit 71 detects the driving allowed state and the driving denied state, and in accordance with the detected state, the control unit 130 controls application of the sound signal to the piezoelectric element 61 or the speaker 41. In greater detail, for example the user registers locations at which output of sound from the mobile phone 10 is inappropriate in advance in the detection unit 71. Based on the position information acquired by the wireless communication unit 110, the detection unit 71 then detects the driving denied state upon confirming that the mobile phone 10 is at a position registered in advance. In this case, the control unit 130 can suspend application of the sound signal. Conversely, the detection unit 71 detects the driving allowed state when confirming that the mobile phone 10 is not at a position registered in advance. In this case, the control unit 130 can apply the sound signal.

In the above-described example, locations at which outputting sound from the mobile phone 10 is inappropriate have been described as being registered in the detection unit 71 in advance, yet locations at which outputting sound from the mobile phone 10 is allowed may be registered in advance in the detection unit 71. For example, private locations such as the user's home may be registered in the detection unit 71 in advance. Based on the position information acquired by the wireless communication unit 110, the detection unit 71 then detects the driving allowed state upon confirming that the mobile phone 10 is at a position registered in advance. In this case, the control unit 130 can apply the sound signal. Conversely, the detection unit 71 detects the driving denied state when confirming that the mobile phone 10 is not at a position registered in advance. In this case, the control unit 130 can suspend application of the sound signal.

Figure 29:
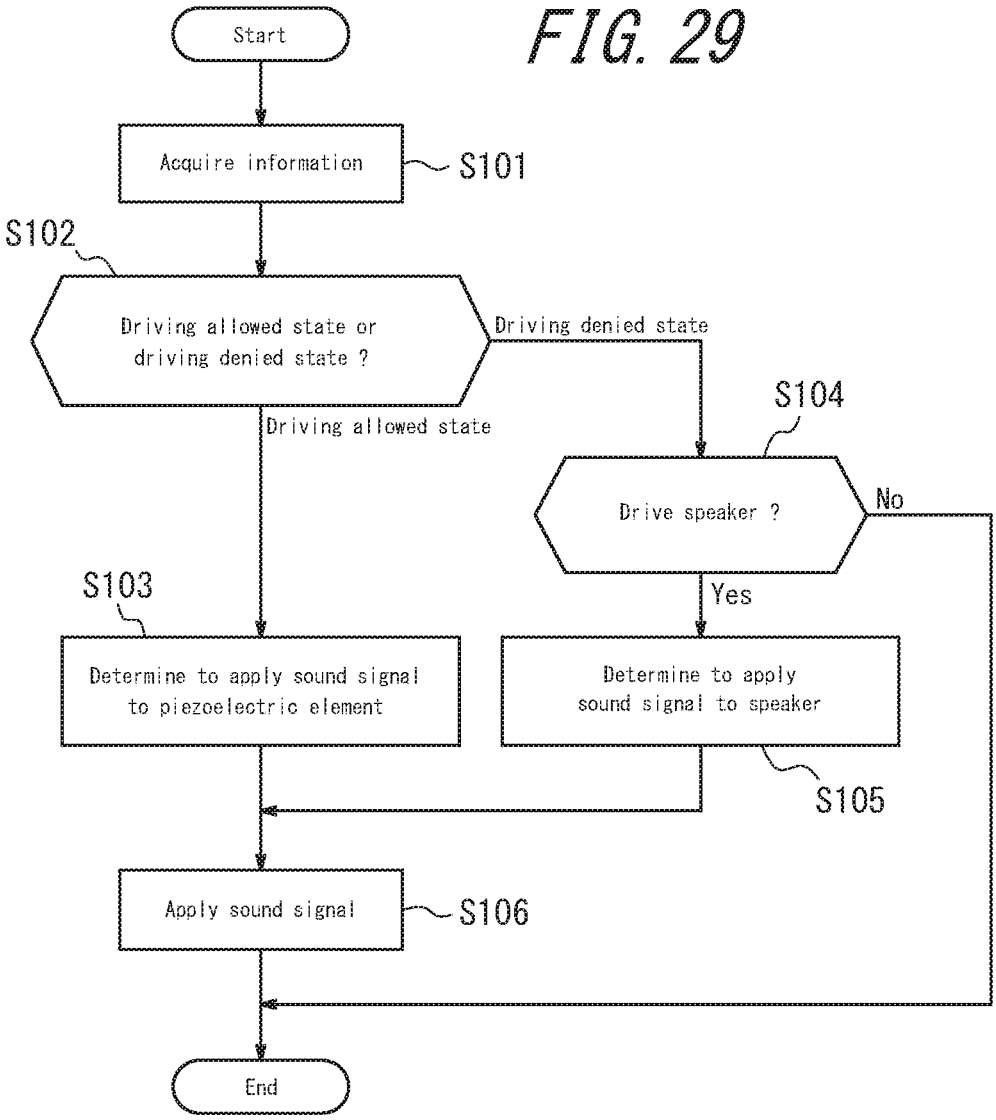
FIG. 29 is a flowchart illustrating an operation procedure for sound output performed by the mobile phone in FIG. 24.

The mobile phone 10 outputs sound based on the above-described operations of the detection unit 71 and the control unit 130. FIG. 29 is a flowchart illustrating an operation procedure for sound output performed by the mobile phone 10.

First, in the mobile phone 10, one of the detection mechanisms in the detection unit 71 acquires information for judging the two states (step S101). For example, the information for judging the two states is sound emitted from the contact surface 150 when the detection mechanism is the microphone 91 and is information on whether a detection target is present nearby when the detection mechanism is the proximity sensor 72. Next, based on the information acquired by the detection mechanism, the detection unit 71 detects whether the mobile phone 10 is in the driving allowed state or the driving denied state (step S102).

When the detection unit 71 detects the driving allowed state (step S102: driving allowed state), the control unit 130 determines to apply a sound signal to the piezoelectric element 61 (step S103). The control unit 130 then applies a sound signal to the piezoelectric element 61 (step S106). Conversely, when the detection unit 71 detects the driving denied state (step S102: driving denied state), the control unit 130 judges whether to drive the speaker 41 (step S104).

For example, when the detection unit 71 detects the driving denied state by the proximity sensor 72 detecting that nobody is nearby, the mobile phone 10 need not output sound from the speaker 41. In this case, the control unit 130 can judge not to drive the speaker. When, for example, the detection unit 71 detects the driving denied state by the wireless communication unit 110 detecting that the mobile phone 10 is in a library, outputting sound from the speaker 41 of the mobile phone 10 is inappropriate. In this case, the control unit 130 can judge not to drive the speaker. The control unit 130 can thus judge whether to drive the speaker 41 based on the information from the detection mechanisms. Judgment by the control unit 130 is not, however, limited in this way and may be made by further establishing a different judgment criterion or algorithm.

When the control unit 130 judges to drive the speaker 41 (step S104: Yes), the control unit 130 determines to apply a sound signal to the speaker 41 (step S105). The control unit 130 then applies the sound signal to the speaker 41 (step S106). Conversely, when the control unit 130 judges not to drive the speaker 41 (step S104: No), the control unit 130 does not apply a sound signal, and this processing flow terminates. The mobile phone 10 may repeat this processing flow by having the detection unit 71 periodically or irregularly detect the two states.

By the mobile phone 10 repeating this processing flow, when the location of sound output switches due to the target of application of the sound signal switching between the piezoelectric element 61 and the speaker 41, the mobile phone 10 can notify the user that the location of sound output has switched. The user may be notified by a variety of methods, such as by displaying the location of sound output on the display unit 50 of the mobile phone 10. When the location of sound output switches, for example a notification sound indicating that the location of output has switched may be inserted into the sound that is output.

When the detection unit 71 has detected the driving denied state, the mobile phone 10 may for example notify the user of the driving denied state. Notification of the driving denied state may be made in a variety of ways, such as by display on the display unit 50 of the mobile phone 10, or by separately providing a Light Emitting Diode (LED) in the mobile phone 10 and causing the LED to flash.

Referring again to FIG. 27, the DSP 124 performs necessary signal processing, such as equalizing, D/A conversion, boosting, filtering, or the like on a digital signal from the control unit 130 and applies a necessary sound signal to the speaker 41 and the piezoelectric element 61.

The maximum voltage of the playback sound signal applied to the laminated piezoelectric element 61 may, for example, be from 10 Vpp to 50 Vpp, yet the voltage is not limited to this range and may be adjusted appropriately in accordance with the weight of the mobile phone 10 and the performance of the laminated piezoelectric element 61. For the sound signal applied to the laminated piezoelectric element 61, direct current may be biased, and the maximum voltage may be set centered on the bias voltage.

Figure 30:
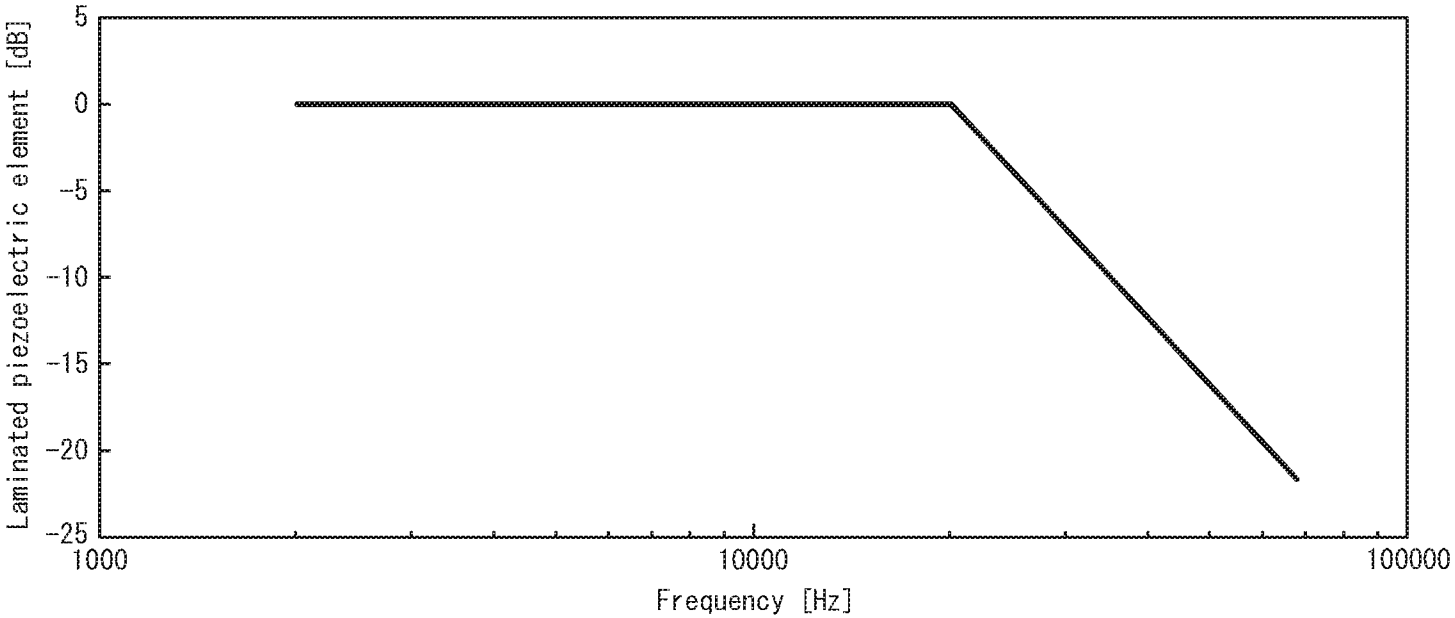
FIG. 30 illustrates an example of the frequency characteristic of filter processing by the DSP in FIG. 27.

For piezoelectric elements in general, not just the laminated piezoelectric element 61, power loss increases as the frequency becomes higher. Therefore, the filtering of the sound signal to the laminated piezoelectric element 61 by the DSP 124 is set to have a frequency characteristic that attenuates or cuts at least a portion of a frequency component of approximately 10 kHz to 50 kHz or more, or to have a frequency characteristic such that the attenuation rate increases gradually or stepwise. As an example, FIG. 30 illustrates the frequency characteristic when the cutoff frequency is approximately 20 kHz. Thus attenuating or cutting the high-frequency component can suppress power consumption.

Figure 31:
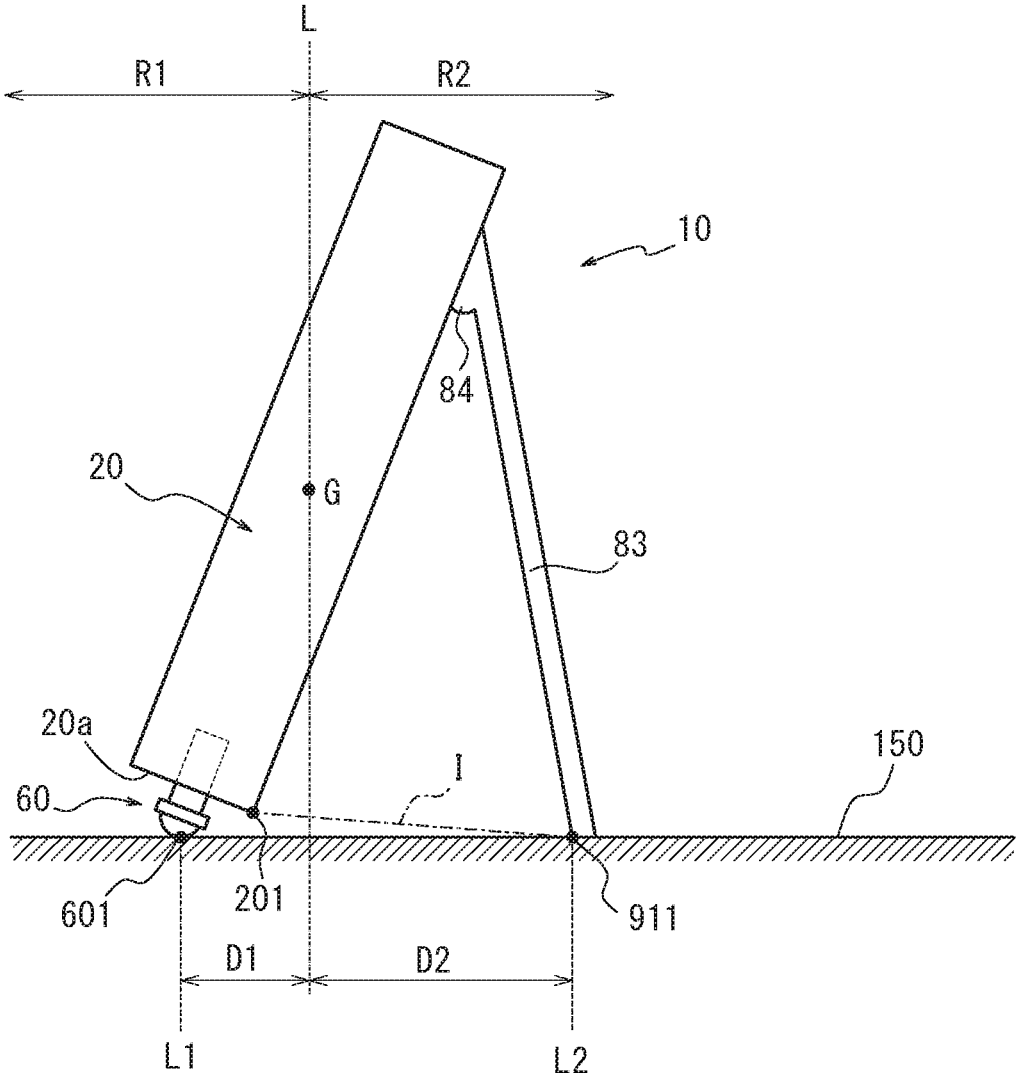
FIG. 31 illustrates the arrangement of the piezoelectric vibrator and the leg in the mobile phone in FIG. 24.

Next, with reference to FIG. 31, the arrangement of the piezoelectric vibrator 60 and the leg 83 is described. FIG. 31 illustrates a state in which the mobile phone 10 is mounted on a horizontal contact surface 150, such as a desk, with the bottom side 20*a* downwards. The desk referred to here is an example of a contacted member, and the contact surface 150 is an example of a contact surface on which the sound generator is mounted. As illustrated in FIG. 31, at least the leg 83 and the piezoelectric vibrator 60 contact the contact surface 150 and support the mobile phone 10. Point G is the center of gravity of the mobile phone 10. In other words, the point G is the center of gravity of the anchor in the sound generator.

In FIG. 31, the leg 83 has a lowermost edge 911. The lowermost edge 911 is, within the leg 83, the location that abuts the horizontal contact surface 150, such as a desk, when the mobile phone 10 is mounted on the contact surface 150 with the bottom side 20*a* downwards.

The piezoelectric vibrator 60 has a lowermost edge 601. The lowermost edge 601 is, within the piezoelectric vibrator 60, the location that abuts the horizontal contact surface 150, such as a desk, when the mobile phone 10 is mounted on the contact surface 150 with the bottom side 20*a* downwards. The lowermost edge 601 is, for example, the tip of the cap 63.

In FIG. 31, a dashed line L is a line (virtual line) that traverses the center of gravity G of the mobile phone 10 and is perpendicular to the horizontal contact surface 150, such as a desk, when the mobile phone 10 is mounted on the contact surface 150 with the bottom side 20*a* downwards. An alternate long and short dash line I is a line (virtual line) that connects the lowermost edge 911 of the leg 83 and the lowermost edge 201 of the mobile phone 10 assuming the piezoelectric vibrator 60 does not exist. A dashed line L1 is a line (virtual line) that traverses the lowermost edge 601 and is perpendicular to the contact surface 150. A dashed line L2 is a line (virtual line) that traverses the lowermost edge 911 and is perpendicular to the contact surface 150. The dashed line L1 is separated from the dashed line L in the horizontal direction by a distance of D1. The dashed line L2 is separated from the dashed line L in the horizontal direction by a distance of D2.

In FIG. 31, the region R2 is a region at one side of the mobile phone 10, separated by the dashed line L. The region R1 is a region at the other side of the mobile phone 10, separated by the dashed line L. The leg 83 is provided in the region R2. The piezoelectric vibrator 60 is provided on the bottom side 20*a* in the region R1.

In the region R1, the piezoelectric vibrator 60 is preferably provided at a position as close as possible to the dashed line L. The load in the vertical direction on the piezoelectric vibrator 60 thus increases as compared to when the piezoelectric vibrator 60 is provided at a position distant from the dashed line L in the region R1. Hence, the mobile phone 10 can effectively be used as an anchor for the sound generator.

In the region R2, the lowermost edge 911 of the leg 83 is preferably provided at a position as far as possible from the dashed line L. A sufficient distance can thus be ensured between the lowermost edge 911 and the piezoelectric vibrator 60 even when the piezoelectric vibrator 60 is provided at a position as close as possible to the dashed line L. Hence, the sound generator can be stably mounted on the contact surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 of the piezoelectric vibrator 60 is preferably located towards the contact surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 preferably projects towards the contact surface 150 from the alternate long and short dash line I. In this way, the contact surface 150 can appropriately be vibrated by the piezoelectric vibrator 60.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 of the piezoelectric vibrator 60 is preferably located towards the contact surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 preferably projects towards the contact surface 150 from the alternate long and short dash line I. It is thus more difficult for the lowermost edge 201 of the mobile phone 10 to contact the contact surface 150, which for example depending on the type of paint on the housing 20, makes it more difficult for the paint to peel off. Abnormal noise is also less likely to be emitted between the lowermost edge 201 and the contact surface 150.

Figure 32A:
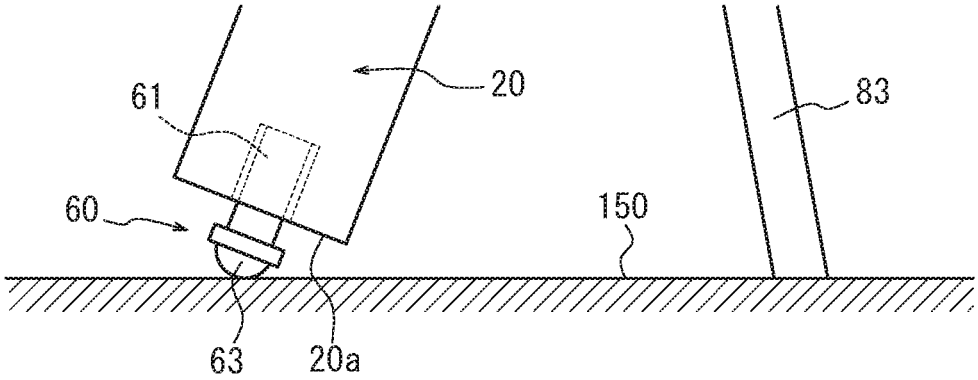
FIG. 32A schematically illustrates operation of the piezoelectric vibrator in the mobile phone in FIG. 24.
Figure 32B:
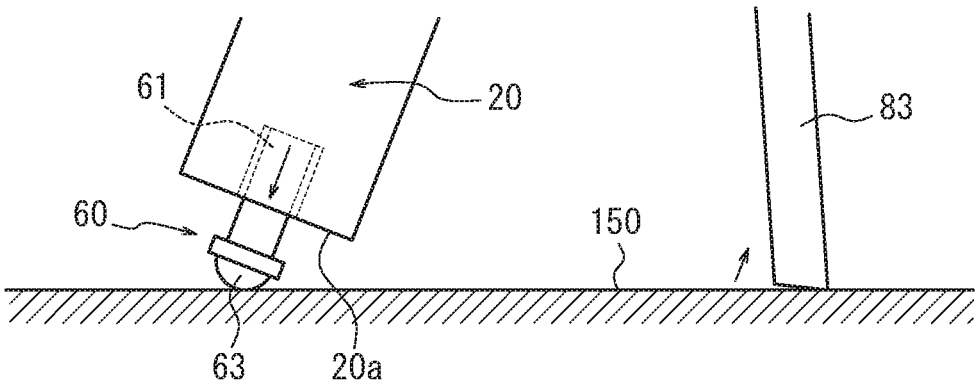
FIG. 32B schematically illustrates operation of the piezoelectric vibrator in the mobile phone in FIG. 24.
Figure 32C:
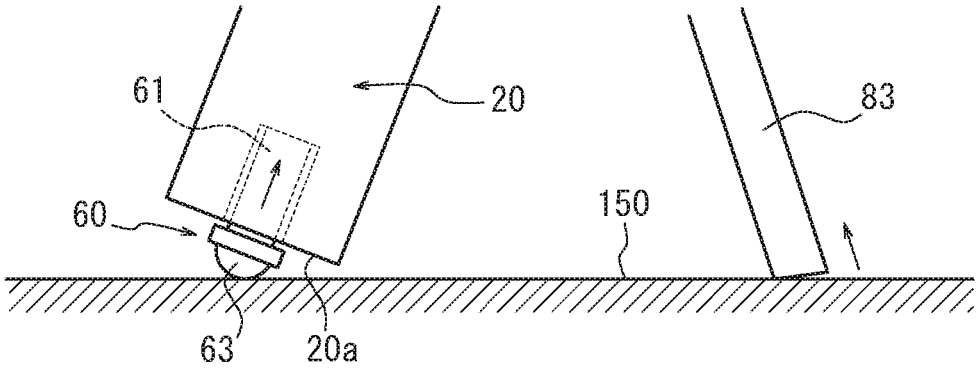
FIG. 32C schematically illustrates operation of the piezoelectric vibrator in the mobile phone in FIG. 24.

FIGS. 32A, 32B, and 32C schematically illustrate operation of the mobile phone 10 as a sound generator. When causing the mobile phone 10 to function as a sound generator, the mobile phone 10 is stood horizontally with the bottom side 20*a* of the housing 20 downwards, so that the cap 63 of the piezoelectric vibrator 60 and the leg 83 contact the contact surface 150, such as a desk, as illustrated in FIG. 32A. In this way, the weight of the mobile phone 10 is provided to the piezoelectric vibrator 60 as a load. In other words, the mobile phone 10 acts as an anchor for the sound generator according to the present disclosure. Note that in the state illustrated in FIG. 32A, the laminated piezoelectric element 61 does not expand or contract, since no voltage is applied thereto.

In this state, when the laminated piezoelectric element 61 of the piezoelectric vibrator 60 is driven by a playback sound signal, the laminated piezoelectric element 61 vibrates by expanding and contracting in accordance with the playback sound signal with the portion of the leg 83 contacting the contact surface 150 acting as a pivot, and without the cap 63 separating from the contact surface 150, as illustrated in FIGS. 32B and 32C. As long as problems such as the lowermost edge 201 contacting the contact surface 150 and emitting abnormal noise do not occur, the cap 63 may separate slightly from the contact surface 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the contact surface 150 through the cap 63, and the contact surface 150 vibrates, causing the contact surface 150 to function as a vibration speaker by emitting sound. If the difference in length between full expansion and full contraction is less than 0.05 μm, it may not be possible to vibrate the contact surface appropriately. Conversely, if the difference exceeds 50 μm, vibration grows large, and the sound generator may wobble.

As described above, when the laminated piezoelectric element 61 is fully expanded, the tip of the cap 63 is preferably located towards the contact surface 150 from a line (the alternate long and short dash line I in FIG. 31) connecting the lowermost edge 911 of the leg 83 and the lowermost edge 201 of the mobile phone 10 assuming the piezoelectric vibrator 60 does not exist. Furthermore, when the laminated piezoelectric element 61 is fully contracted, the tip of the cap 63 is preferably located towards the contact surface 150 from this virtual line.

The distance d between the bottom side 20*a* and the opposing face 63*c* of the cap 63 illustrated in FIG. 5 is preferably greater than the amount of displacement when the laminated piezoelectric element 61 is fully contracted from a state in which no voltage is applied thereto so that the laminated piezoelectric element 61 is not expanding or contracting. In this way, it is difficult for the bottom side 20*a* of the housing 20 and the cap 63 to contact even when the laminated piezoelectric element 61 is fully contracted (the state in FIG. 32C). Accordingly, the cap 63 does not easily detach from the piezoelectric element 61.

The location at which the piezoelectric vibrator 60 is disposed on the bottom side 20*a*, the length of the laminated piezoelectric element 61 in the lamination direction, the dimensions of the cap 63, and the like are appropriately determined so as to satisfy the above conditions.

According to the sound generator of the present embodiment, good sound can be output in accordance with the circumstances. In greater detail, the mobile phone 10 can output sound using a piezoelectric element when the detection unit 71 detects the driving allowed state. The stack-type laminated piezoelectric element 61 is used as the piezoelectric element and vibrates by expanding and contracting along the lamination direction due to a playback sound signal. Since this expanding and contracting vibration is transmitted to the contact surface 150, the vibration transmission efficiency with respect to the contact surface 150 in the expansion and contraction direction (deformation direction) is good, and the contact surface 150 can be vibrated efficiently. Moreover, since the laminated piezoelectric element 61 contacts the contact surface 150 with the cap 63 therebetween, damage to the laminated piezoelectric element 61 can also be prevented. By standing the mobile phone 10 horizontally so that the cap 63 of the piezoelectric vibrator 60 contacts the contact surface 150, the weight of the mobile phone 10 is applied as a load to the cap 63. Hence, the cap 63 can reliably contact the contact surface 150, and the expanding and contracting vibration of the piezoelectric vibrator 60 can efficiently be transmitted to the contact surface 150. In this way, when the detection unit 71 detects the driving allowed state, good sound can be generated using the piezoelectric element.

Furthermore, according to the sound generator of the present embodiment, the detection unit 71 detects two states of the piezoelectric element 61, i.e. the driving allowed state and the driving denied state, using the detection mechanisms. In accordance with the detected state, a sound signal is applied to the piezoelectric element 61 or the speaker 41. Accordingly, for example in circumstances when sound need not be generated with the piezoelectric element 61, or circumstances in which generation of sound with the piezoelectric element 61 is inappropriate, application of the sound signal to the piezoelectric element 61 can be suspended, or a sound signal can be applied to the speaker 41 instead. In this way, the sound generator of the present embodiment can output sound by applying a sound signal in accordance with the circumstances.

Embodiment 5

Figure 33A:
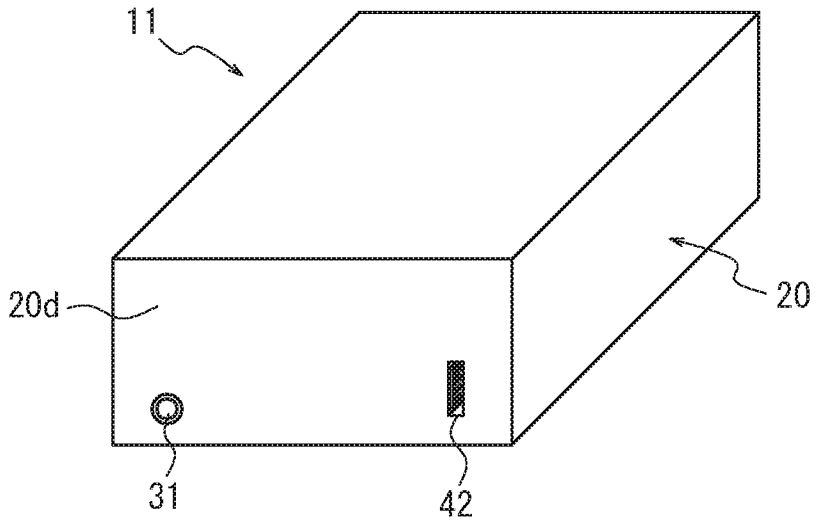
FIG. 33A is an external perspective view illustrating a sound generator according to Embodiment 5 of the present disclosure.
Figure 33B:
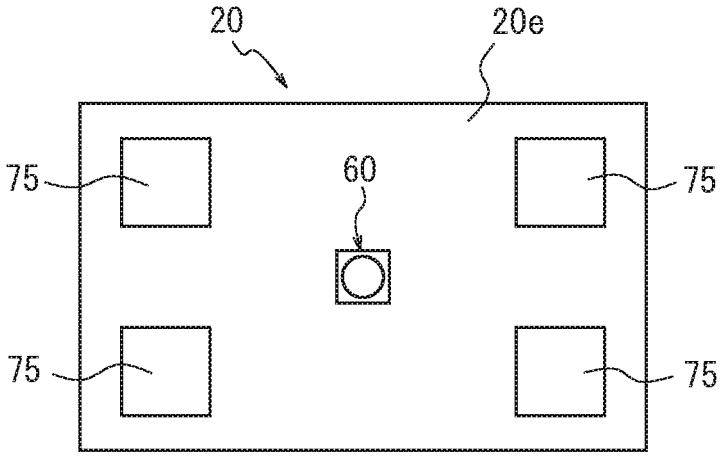
FIG. 33B is a bottom view illustrating a sound generator according to Embodiment 5 of the present disclosure.

FIG. 33A and FIG. 33B illustrate a sound generator according to Embodiment 5 of the present disclosure. FIG. 33A is an external perspective view, and FIG. 33B is a bottom view. A sound generator 11 according to the present embodiment includes a housing 20, a line-in port 31, a DC input terminal 42 for charging, a piezoelectric vibrator 60, and four permanent magnets 75. The housing 20 may be any solid shape, such as a cuboid, a polyhedron, a cylinder, or the like. FIG. 33A and FIG. 33B illustrate the case of the housing 20 being a cuboid. The following describes the differences from Embodiment 1, omitting a description of common features.

The line-in port 31 receives input of the sound signal (playback sound signal) output by an external device by connecting via a line (wire) to a line-out terminal of the external device. The line-in port 40 may be configured using, for example, a monaural jack. The DC input terminal 42 for charging receives input DC voltage for charging a power source 24 (see FIG. 34) and may be configured using a DC jack or a USB terminal. FIG. 33A illustrates the case of the DC input terminal 42 for charging being a USB terminal. The line-in port 31 and the DC input terminal 42 for charging may be provided on the top side or on any lateral side of the housing 20, on the same side or on a different side. FIG. 33A illustrates an example in which the line-in port 31 and the DC input terminal 42 for charging are provided on the same lateral side 20*d* of the housing 20.

The piezoelectric vibrator 60 is provided protruding from approximately the center of the bottom face 20*e* of the housing 20. The permanent magnets 75 are attached, by adhesion or the like, to the four corners of the bottom face 20*e* of the housing 20.

In the sound generator 11 according to the present embodiment, the permanent magnets 75 provided on the bottom face 20*e* of the housing 20 are attached magnetically to a contact surface (mounting surface), which is a magnetic member, and the piezoelectric vibrator 60 is pressed against the contact surface due to the magnetic force of the permanent magnets 75. By applying a sound signal to the piezoelectric vibrator 60 in this state, the piezoelectric vibrator 60 deforms, and deformation of the piezoelectric vibrator 60 vibrates the contact surface, causing sound to be emitted from the contact surface. The arrangement of the piezoelectric vibrator 60 and the permanent magnets 75 is described in detail below.

Figure 34:
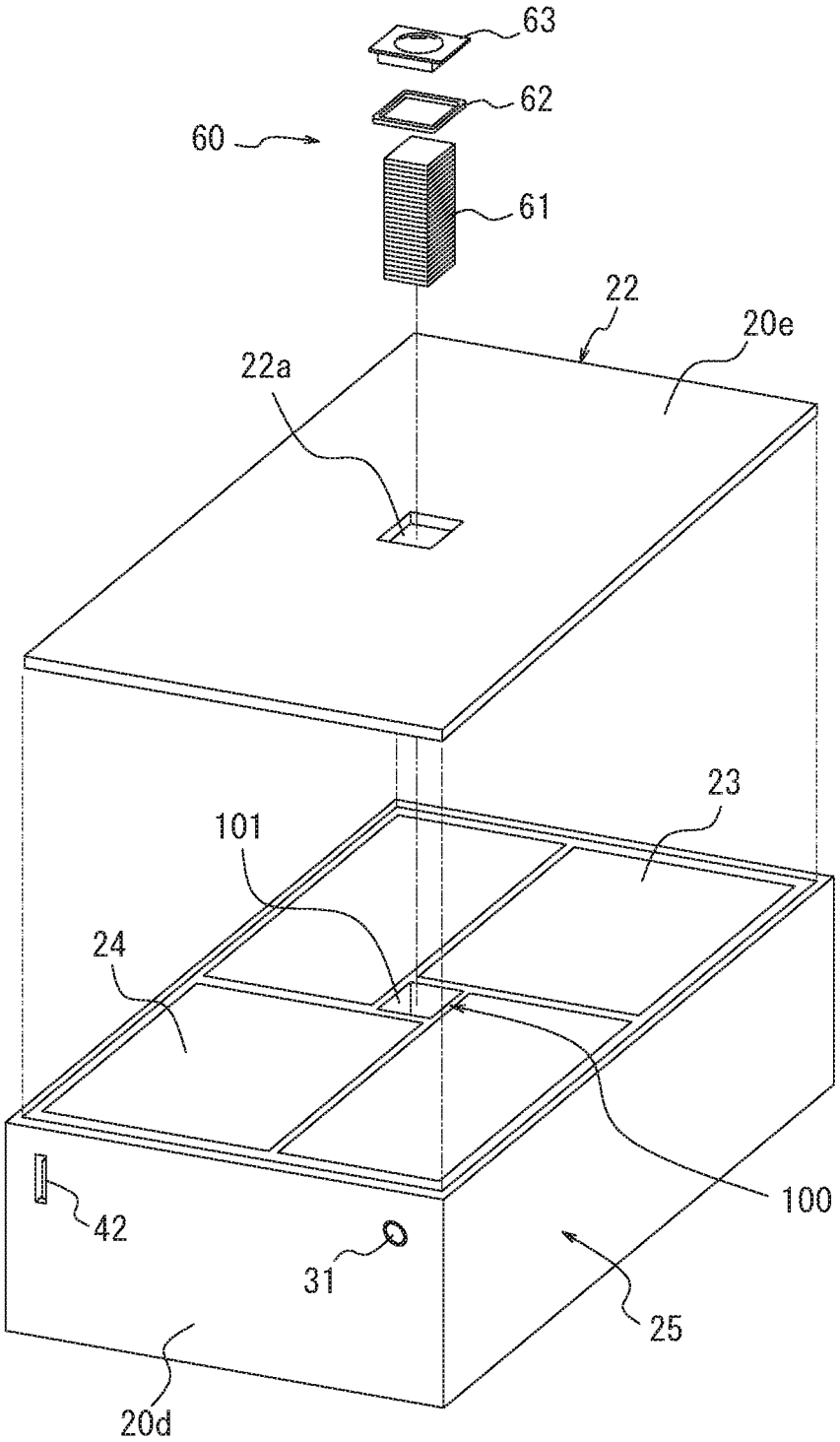
FIG. 34 is an exploded perspective view schematically illustrating the bottom face of the sound generator in FIG. 33A and FIG. 33B.

FIG. 34 is an exploded perspective view schematically illustrating the bottom face of the sound generator 11 in FIG. 33A and FIG. 33B. The housing 20 includes a housing case 25 and a bottom cover 22. The housing case 25 is an external cover for the sound generator 11, forming the top side and the surrounding lateral sides 20*d* of the housing 20. The bottom cover 22 is an external cover forming the bottom face 20*e* of the housing 20. For example, electronic circuitry 23, the power source 24, and the like are included inside the housing case 25. The electronic circuitry 23 controls overall operations of the sound generator 11 and is provided with a control unit, a piezoelectric element drive unit, and the like, as described below. The power source 24 is provided with a secondary battery such as a lithium-ion battery or the like, provides necessary power to the electronic circuitry 23, and is charged by DC voltage input from the DC input terminal 42 for charging.

At the bottom side of the housing 20, the sound generator 11 according to the present embodiment includes a holding unit 100 that houses and holds the piezoelectric vibrator 60. In other words, the piezoelectric vibrator 60 is provided at a position facing the contact surface to which the housing 20 is attached by the permanent magnets 75. The holding unit 100 for example includes a slit 101, with a uniform width, that extends in a substantially perpendicular direction to the bottom face 20*e* of the sound generator 11 and opens towards the bottom face of the housing 20. On the bottom cover 22, a hole 22*a* through which the piezoelectric vibrator 60 protrudes is provided to allow the piezoelectric vibrator 60 to abut the contact surface.

The number of layers and the cross-sectional area of the laminated piezoelectric element 61 are determined appropriately in accordance with the magnetic force of the permanent magnets 75, so as to ensure sufficient pressure or quality of the sound emitted from the contact surface abutted by the piezoelectric vibrator 60.

The laminated piezoelectric element 61 is supplied with a sound signal (playback sound signal) from the control unit via the piezoelectric element drive unit. In other words, voltage corresponding to a sound signal is applied to the laminated piezoelectric element 61 from the control unit via the piezoelectric element drive unit.

In FIG. 34, the permanent magnets 75 are attached to the bottom cover 22, by adhesion or the like, at the four corners of the bottom face of the housing 20. The permanent magnets 75 may be of any type, such as ferrite magnets, neodymium magnets, or the like. Furthermore, the permanent magnets 75 may be of any shape, such as a rectangle, cylinder, or the like. The case of a rectangular shape is illustrated. The permanent magnets 75 are preferably attached to the four corners of the bottom cover 22 in a symmetrical positional relationship with respect to the piezoelectric vibrator 60. In other words, the permanent magnets 75 are attached in a plane perpendicular to a deformation direction of the piezoelectric vibrator 60 in a symmetrical positional relationship with respect to a cap 63 of the piezoelectric vibrator 60.

Figure 35A:
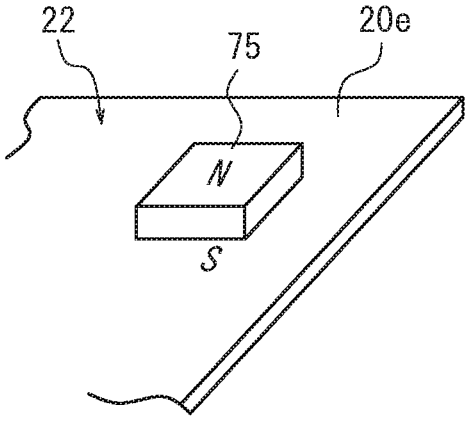
FIG. 35A illustrates an example of the magnetization direction of the permanent magnets in FIG. 33A and FIG. 33B.
Figure 35B:
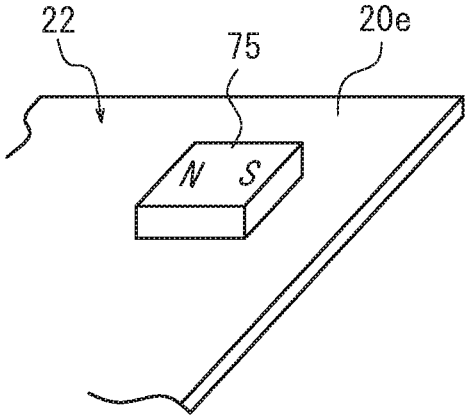
FIG. 35B illustrates another example of the magnetization direction of the permanent magnets in FIG. 33A and FIG. 33B.

The magnetization direction of the permanent magnets 75 may be along the deformation direction of the piezoelectric vibrator 60, i.e. in the normal direction of the bottom cover 22, as illustrated in FIG. 35A, or may be in a direction perpendicular to the deformation direction of the piezoelectric vibrator 60, i.e. in a direction parallel to the plane of the bottom cover 22, as illustrated in FIG. 35B. The permanent magnets 75 have a thickness such that when the permanent magnets 75 are magnetically attached to the contact surface, which is formed from a magnetic body, the cap 63 of the piezoelectric vibrator 60 is pressed against the contact surface by the magnetic force of the permanent magnets 75.

Figure 36:
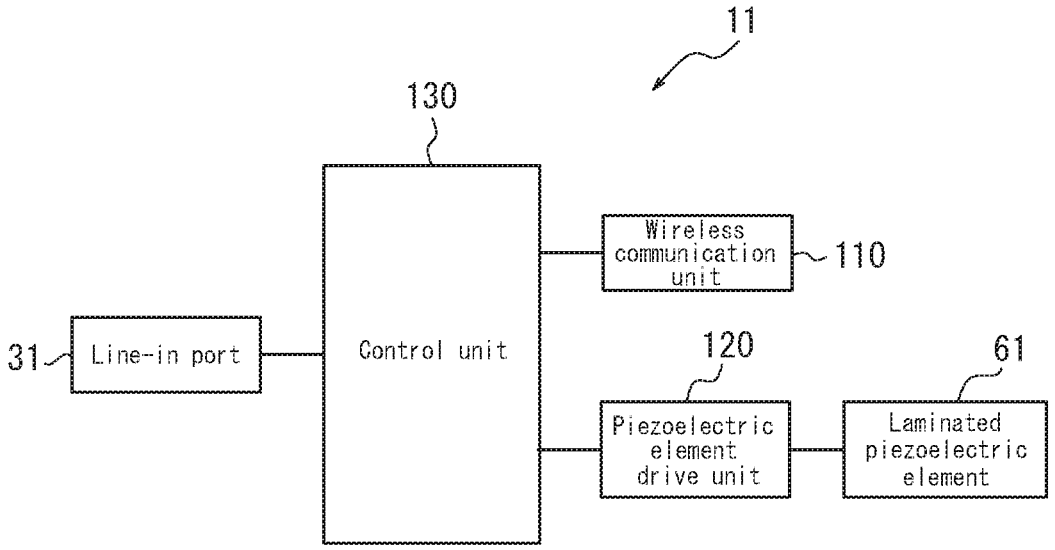
FIG. 36 is a functional block diagram of the main parts of the sound generator in FIG. 33A and FIG. 33B.

FIG. 36 is a functional block diagram of the main portions of the sound generator 11 according to the present embodiment. The sound generator 11 includes the line-in port 31, the laminated piezoelectric element 61, a wireless communication unit 110, a piezoelectric element drive unit 120, and a control unit 130. The power source 24 and the DC input terminal 42 for charging are omitted from the drawings. The line-in port 31, wireless communication unit 110, and piezoelectric element drive unit 120 connect to the control unit 130. The laminated piezoelectric element 61 connects to the piezoelectric element drive unit 120.

The wireless communication unit 110 receives electromagnetic waves modulated by a playback sound signal and is configured using, for example, a Bluetooth (registered trademark) or other near field communication unit, a low-power radio communication unit, or the like. The wireless communication unit 110 may, for example, be an AM/FM or other radio receiver, or an infrared receiver, without a transmission function. The control unit 130 applies a playback sound signal (voltage corresponding to a playback sound signal of speech, music including songs, or the like) to the laminated piezoelectric element 61 via the piezoelectric element drive unit 120. The playback sound signal may be based on electromagnetic waves received by the wireless communication unit 110 or may be input from the line-in port 31.

Figure 37:
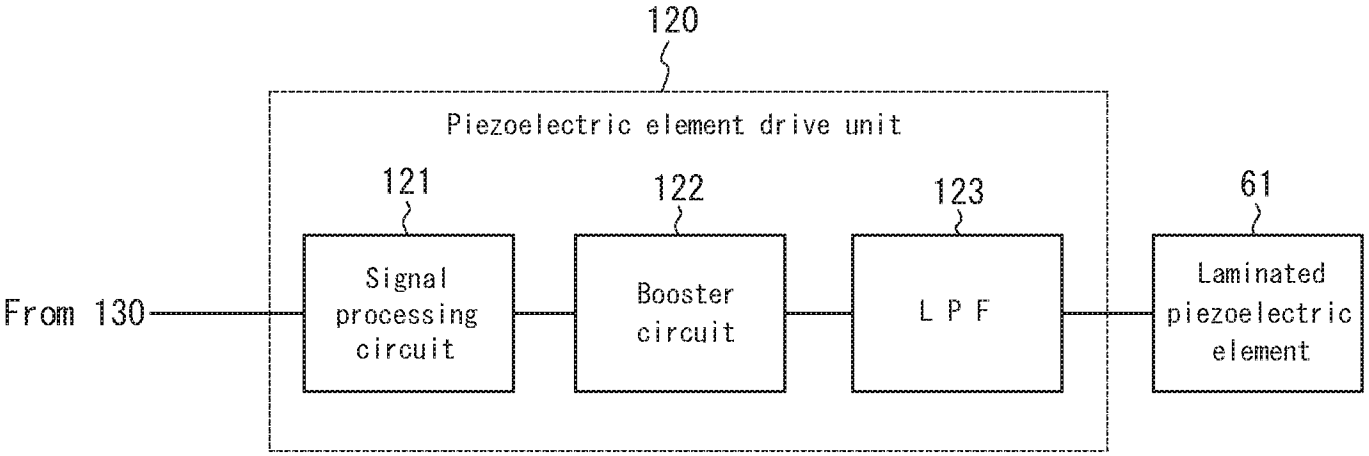
FIG. 37 is a functional block diagram illustrating the structure of an example of the piezoelectric element drive unit in FIG. 36.

For example as illustrated in FIG. 37, the piezoelectric element drive unit 120 includes a signal processing circuit 121, a booster circuit 122, and a low pass filter (LPF) 123. The signal processing circuit 121 may be configured using a digital signal processor (DSP) that includes an equalizer, A/D converter circuit, or the like and performs necessary signal processing, such as equalizing, D/A conversion, or the like on a digital signal from the control unit 130 to generate an analog playback sound signal, outputting the analog playback sound signal to the booster circuit 122. The functions of the signal processing circuit 121 may be internal to the control unit 130.

The booster circuit 122 boosts the voltage of the input analog playback sound signal and applies the result to the laminated piezoelectric element 61 via the LPF 123. The maximum voltage of the playback sound signal applied to the laminated piezoelectric element 61 by the booster circuit 122 may, for example, be from 1 Vpp to 500 Vpp, yet the voltage is not limited to this range and may be adjusted appropriately in accordance with factors such as the magnetic force of the permanent magnets 75, the performance of the laminated piezoelectric element 61, and the like. For the playback sound signal applied to the laminated piezoelectric element 61, direct current may be biased, and the maximum voltage may be set centered on the bias voltage.

Figure 38:
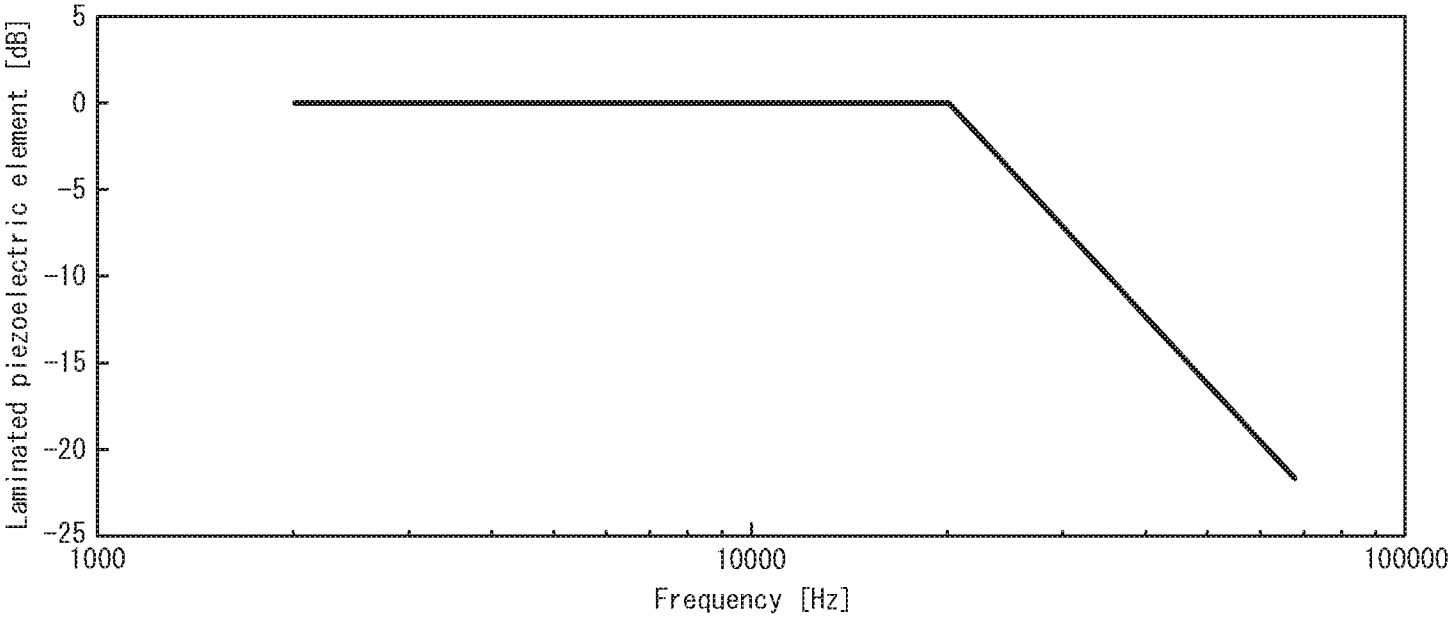
FIG. 38 illustrates an example of the frequency characteristic of the LPF in FIG. 37.

For piezoelectric elements in general, not just the laminated piezoelectric element 61, power loss increases as the frequency becomes higher. Therefore, the LPF 123 is set to have a frequency characteristic that attenuates or cuts at least a portion of a frequency component of approximately 10 kHz to 50 kHz or more, or to have a frequency characteristic such that the attenuation rate increases gradually or stepwise. As an example, FIG. 38 illustrates the frequency characteristic of the LPF 123 when the cutoff frequency is approximately 20 kHz. Thus attenuating or cutting the high-frequency component can suppress power consumption and can also suppress heat generation in the laminated piezoelectric element 61. The control unit 130 may be configured using, for example, a CPU or a DSP.

Figure 39A:
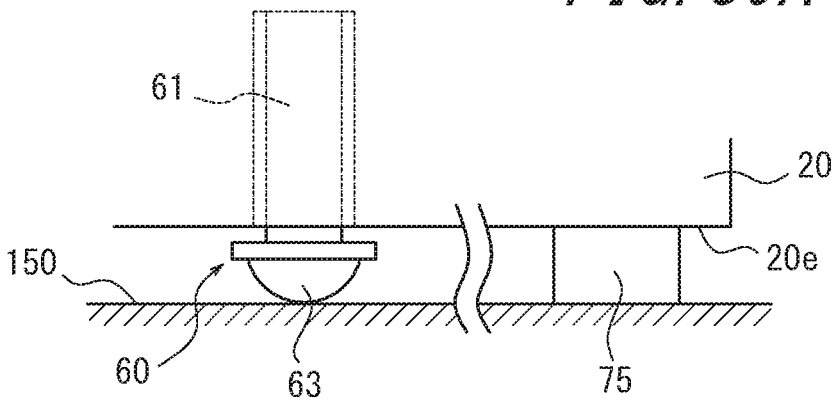
FIG. 39A schematically illustrates operation of the sound generator in FIG. 33A and FIG. 33B.
Figure 39B:
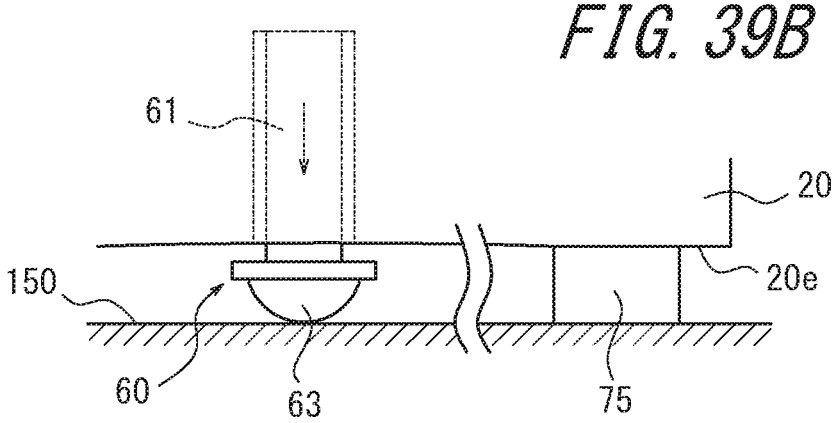
FIG. 39B schematically illustrates operation of the sound generator in FIG. 33A and FIG. 33B.
Figure 39C:
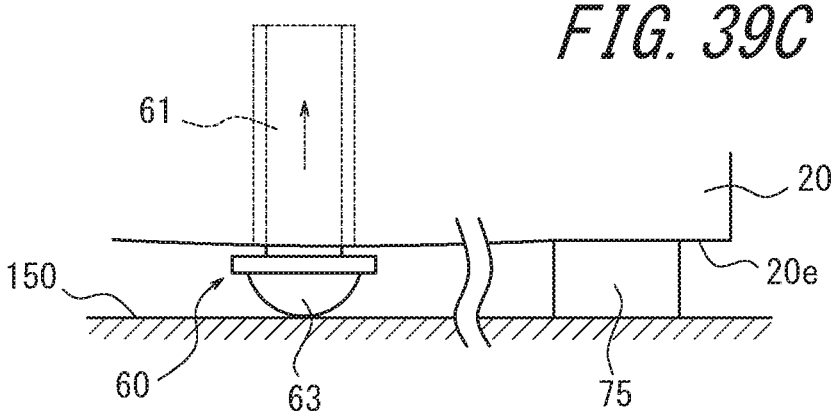
FIG. 39C schematically illustrates operation of the sound generator in FIG. 33A and FIG. 33B.

FIGS. 39A, 39B, and 39C schematically illustrate operation of the sound generator 11 according to the present embodiment. As illustrated in FIG. 39A, with the bottom face 20*e* of the housing 20 downwards, the permanent magnets 75 in the sound generator 11 are attached magnetically to the contact surface 150, which is a magnetic member. In this way, the cap 63 of the piezoelectric vibrator 60 is pressed against the contact surface 150 by the magnetic force of the permanent magnets 75. Note that in the state illustrated in FIG. 39A, the laminated piezoelectric element 61 does not expand or contract, since no voltage is applied thereto.

In this state, when the laminated piezoelectric element 61 of the piezoelectric vibrator 60 is driven by a playback sound signal, the laminated piezoelectric element 61 vibrates by expanding and contracting in accordance with the playback sound signal, without the cap 63 separating from the contact surface 150, as illustrated in FIGS. 39B and 39C. The difference in length between when the laminated piezoelectric element 61 is fully expanded and fully contracted may, for example, be from 0.05 μm to 100 μm. At this time, the permanent magnets 75 remain attached to the contact surface 150 without separating therefrom. Accordingly, the sound generator 11 bends in the expansion and contraction direction in accordance with vibration of the laminated piezoelectric element 61. In this way, the expanding and contracting vibration of the laminated piezoelectric element 61 is transmitted to the contact surface 150 through the cap 63, and the contact surface 150 vibrates, causing the contact surface 150 to function as a vibration speaker by emitting sound. If the difference in length between full expansion and full contraction of the laminated piezoelectric element 61 is less than 0.05 μm, it may not be possible to vibrate the contact surface 150 appropriately. Conversely, if the difference exceeds 100 μm, vibration grows large depending on the frequency, and the sound generator 11 may wobble. Note that FIG. 39B and FIG. 39C are exaggerated illustrations of the bending of the sound generator 11. Even if the difference is less than 100 μm, the sound generator may wobble due to the relationship between load and frequency.

The distance d between the bottom face 20*e* and an opposing face 63*c* of the cap 63 illustrated in FIG. 5 is preferably greater than the amount of displacement when the laminated piezoelectric element 61 is fully contracted from a state in which no voltage is applied thereto so that the laminated piezoelectric element 61 is not expanding or contracting. In this way, it is difficult for the bottom face 20*e* of the housing 20 and the cap 63 to contact even when the laminated piezoelectric element 61 is fully contracted (the state in FIG. 39C). Accordingly, the cap 63 does not easily detach from the piezoelectric element 61.

The length of the laminated piezoelectric element 61 in the lamination direction, the dimensions of the cap 63, and the like are appropriately determined so as to satisfy the above conditions.

According to the sound generator 11 of the present embodiment, a piezoelectric element is used as the source of vibration, hence reducing the number of components as compared to a vibration generating device having a dynamic speaker configuration and allowing for a simple structure with few components. Furthermore, the stack-type laminated piezoelectric element 61 is used as the piezoelectric element and vibrates by expanding and contracting along the lamination direction due to a playback sound signal. Since this expanding and contracting vibration is transmitted to the contact surface 150, the vibration transmission efficiency with respect to the contact surface 150 in the expansion and contraction direction (deformation direction) is good, and the contact surface 150 can be vibrated efficiently. Moreover, since the laminated piezoelectric element 61 is pressed against the contact surface 150 with the cap 63 therebetween, damage to the laminated piezoelectric element 61 can also be prevented.

The sound generator 11 according to the present embodiment can mainly transmit vibration of the laminated piezoelectric element 61 directly to the contact surface 150. Therefore, unlike a technique to transmit vibration of a piezoelectric element to another elastic body, there is no dependence on the high-frequency side threshold frequency at which another elastic body can vibrate when emitting sound. The high-frequency side threshold frequency at which another elastic body can vibrate is the inverse of the shortest time among the times from when the other elastic body is caused to deform by a piezoelectric element until the other elastic body returns to a state in which deformation is again possible. In light of this fact, the sound generator 11 according to the present embodiment preferably has enough stiffness (flexural strength) so as not to undergo flexing deformation due to deformation of the laminated piezoelectric element 61.

Figure 40A:
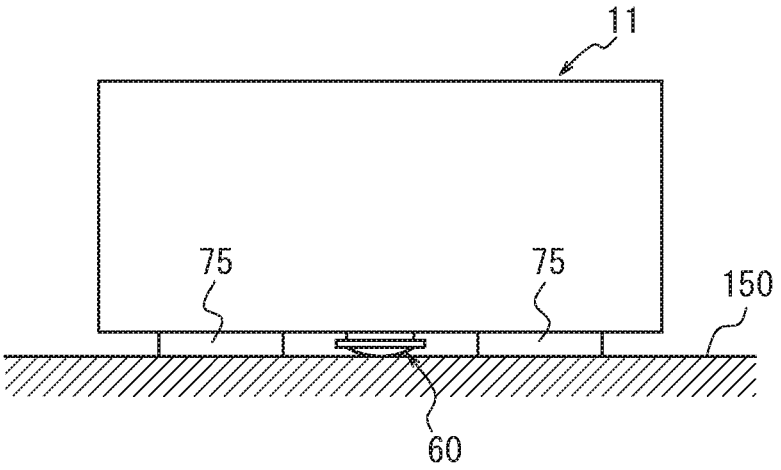
FIG. 40A illustrates an example of the state of attachment of the sound generator in FIG. 33A and FIG. 33B to a contact surface.
Figure 40B:
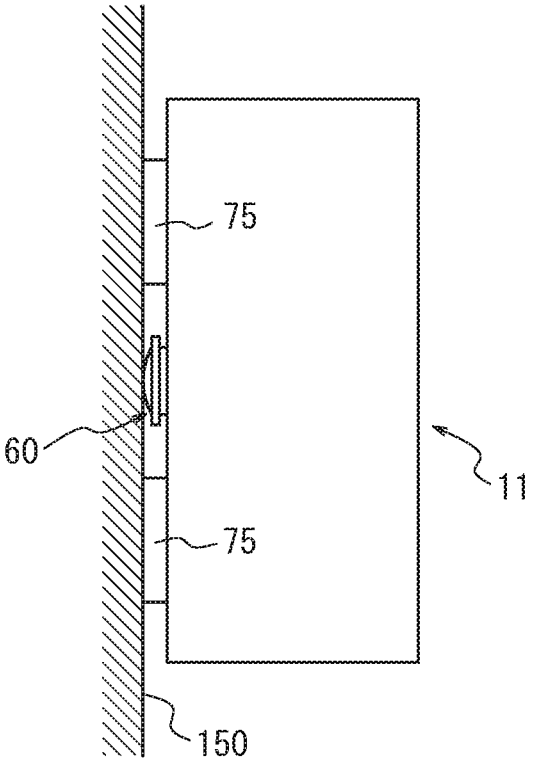
FIG. 40B illustrates another example of the state of attachment of the sound generator in FIG. 33A and FIG. 33B to a contact surface.

In the sound generator 11 according to the present embodiment, the piezoelectric vibrator 60 is pressed against the contact surface 150 by the magnetic force of the permanent magnets 75. Therefore, without providing an anchor in the sound generator 11, the cap 63 can reliably be caused to contact the contact surface 150, and the expanding and contracting vibration of the piezoelectric vibrator 60 can efficiently be transmitted to the contact surface 150. Accordingly, the weight of the sound generator 11 may, for example, be reduced to approximately 100 g. Moreover, since the sound generator 11 is attached to the contact surface by a magnetic force, the contact surface 150 is not limited to being horizontal, as illustrated in FIG. 40A, and the sound generator 11 may be attached as long as the contact surface includes a magnetic body, even if the contact surface 150 is a vertical surface, as illustrated in FIG. 40B, or is an inclined surface. Accordingly, when inside, such as in the kitchen, the sound generator 11 may be attached to a sink, to the door or sides of a refrigerator, or the like, all of which are magnetic. Furthermore, when outside, the sound generator 11 may be used by being attached to the hood or other part of a parked car, thus improving user-friendliness and versatility.

The attaching force of the permanent magnets 75 is set to allow for reliable transmission of vibration to the contact surface 150 even when attached to a vertical contact surface 150, as illustrated in FIG. 40B. For example, when the weight of the sound generator 11 is 100 g, then with an attaching ratio to the contact surface 150 of 75% and a vertical sliding of 25%, the permanent magnets 75 should have an attaching force of 0.533 kgf or more. Accordingly, for instance when using neodymium magnets, for example a cube shape having height by width by thickness dimensions of 4 mm×4 mm×4 mm is preferably adopted. In this case, an attaching force of 0.628 kgf is obtained.

Embodiment 6

Figure 41:
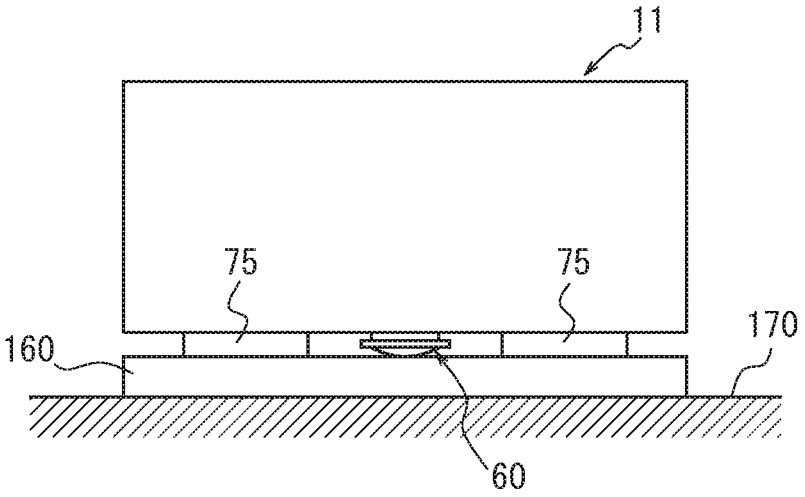
FIG. 41 illustrates a sound generation system according to Embodiment 6 of the present disclosure.

FIG. 41 illustrates a sound generation system according to Embodiment 6 of the present disclosure. The sound generation system according to the present embodiment includes the sound generator 11 described in Embodiment 5 and a plate-shaped vibration transmission member 160 formed from a magnetic member to which the permanent magnets 75 of the sound generator 11 can attach magnetically. In greater detail, since the sound generator 11 is used by being attached magnetically to the contact surface, the member constituting the contact surface needs to be magnetic. A mounting surface 170 that the user prefers for the sound generator 11 might, however, be formed from a nonmagnetic member.

Even when the contact surface 170 that the user prefers is formed from a nonmagnetic member, the sound generation system according to the present embodiment allows for sound to be emitted from the mounting surface 170 by mounting the sound generator 11 on the mounting surface 170. Therefore, in the sound generation system according to the present embodiment, the sound generator 11 is attached to the vibration transmission member 160 in order to mount the sound generator 11 on the mounting surface 170 via the vibration transmission member 160. As a result, vibration of the piezoelectric vibrator 60 in the sound generator 11 is transmitted to the mounting surface 170 via the vibration transmission member 160, causing sound to be emitted from the mounting surface 170.

The vibration transmission member 160 is made from a known magnetic material, such as iron, silicon steel, or the like. The vibration transmission member 160 may or may not be entirely coated with a nonmagnetic coating. The vibration transmission member 160 may have any shape, size, or thickness so long as all of the permanent magnets 75 can be attached thereto and so long as the vibration transmission member 160 can reliably transmit vibration of the piezoelectric vibrator 60 to the mounting surface 170. Having approximately the same shape and size, however, as the shape and size of the bottom face 20*e* of the housing 20 yields a good appearance. Furthermore, the vibration transmission member 160 may be contacted to the mounting surface 170 with the face contacting the mounting surface 170 as a planar surface, or three or more protrusions may be formed on the face contacting the mounting surface 170 to allow for point contact with the mounting surface 170.

According to the sound generation system of the present embodiment, even when the mounting surface 170 that the user prefers is formed from a nonmagnetic member, sound can be emitted from the mounting surface 170 by mounting the sound generator 11 on the mounting surface 170 via the vibration transmission member 160.

Embodiment 7

Figure 42:
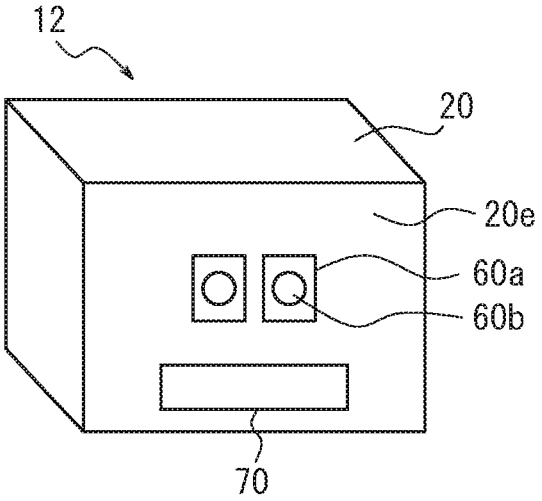
FIG. 42 is an external perspective view of a vibration speaker as Embodiment 7 of a sound generator according to the present disclosure.

FIG. 42 is an external perspective view of a vibration speaker, which is a sound generator according to Embodiment 7 of the present disclosure. The sound generator according to the present embodiment functions as a vibration speaker 12 and includes a piezoelectric vibrator 60*a*, a piezoelectric vibrator 60*b*, and an elastic member 70. As described below, the vibration speaker 12 acts as an anchor (the anchor in the sound generator) providing a load to the piezoelectric vibrator 60*a* and the piezoelectric vibrator 60*b*. The vibration speaker 12 includes a housing 20 having an approximately rectangular external shape. The piezoelectric vibrator 60*a*, the piezoelectric vibrator 60*b*, and the elastic member 70 are formed on the bottom face 20*e* of the vibration speaker 12, which is one side of the housing 20. The following describes the differences from Embodiment 1, omitting a description of common features.

When the vibration speaker 12 is mounted on a horizontal contact surface, such as a desk, with the bottom face 20*e* downwards, the vibration speaker 12 is supported at three points on the contact surface by the piezoelectric vibrator 60*a*, the piezoelectric vibrator 60*b*, and the elastic member 70. The arrangement of the piezoelectric vibrator 60*a*, the piezoelectric vibrator 60*b*, and the elastic member 70 is described in detail below.

Figure 43:
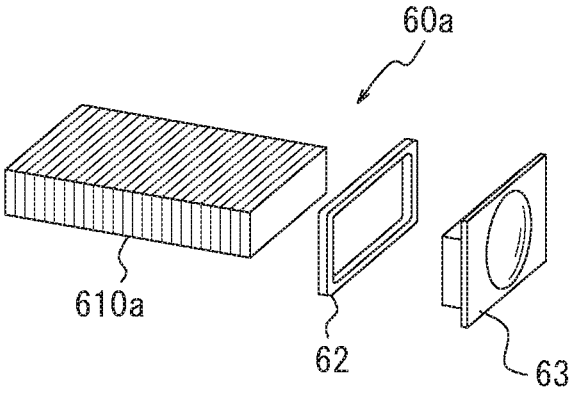
FIG. 43 is a perspective view schematically illustrating the piezoelectric vibrator of the vibration speaker in FIG. 42.

FIG. 43 is a perspective view schematically illustrating the piezoelectric vibrator 60*a* of the vibration speaker in FIG. 42. The piezoelectric vibrator 60*a* includes a laminated piezoelectric element 610*a*, an O-ring 62 for waterproofing, and an insulating cap 63 that is a cover member. The laminated piezoelectric element 610*a* has the same structure as the laminated piezoelectric element 61 in Embodiment 1. In FIG. 43, the structure of the piezoelectric vibrator 60*a* is illustrated, yet the piezoelectric vibrator 60*b* has a similar structure. At the bottom face of the housing 20, the vibration speaker 12 according to the present embodiment includes a holding unit that houses and holds the piezoelectric vibrator 60*a* and the piezoelectric vibrator 60*b*. The holding unit extends along the longitudinal direction of the housing 20.

Figure 44:
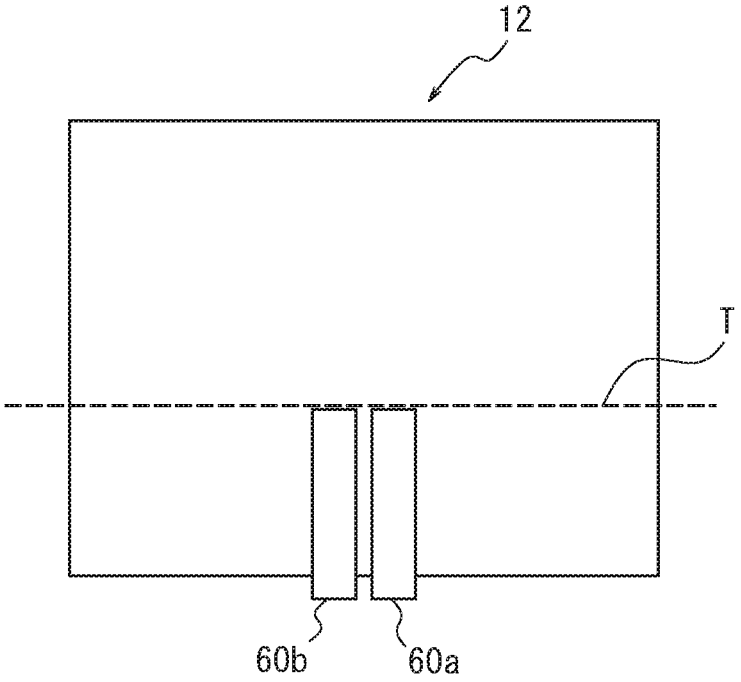
FIG. 44 is a schematic cross-sectional view of the vibration speaker in FIG. 42.

In other words, in the vibration speaker 12 according to the present embodiment, towards the bottom face 20*e* of the housing 20, the piezoelectric vibrator 60*a* and the piezoelectric vibrator 60*b* are disposed on a virtual plane T perpendicular to the expansion and contraction direction of the piezoelectric elements that form the piezoelectric vibrator 60*a* and the piezoelectric vibrator 60*b*, as illustrated in FIG. 44. FIG. 44 is a schematic cross-sectional view of the vibration speaker in FIG. 42.

The laminated piezoelectric element 610*a* is supplied with a sound signal (playback sound signal) from a control unit 130 via a piezoelectric element drive unit 120, as described below. In other words, voltage corresponding to a sound signal is applied to the laminated piezoelectric element 610*a* from the control unit 130 via the piezoelectric element drive unit 120.

Figure 45:
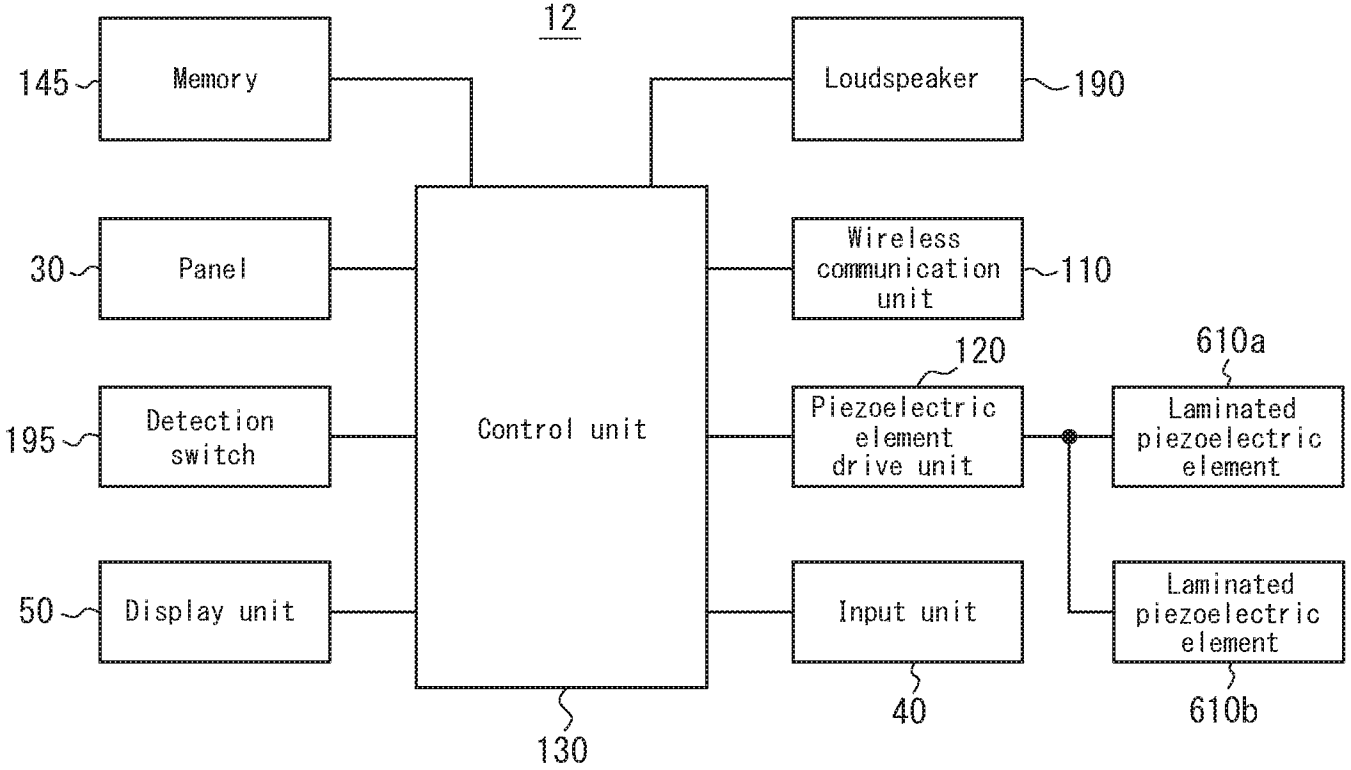
FIG. 45 is a functional block diagram of the main parts of the vibration speaker in FIG. 42.

FIG. 45 is a functional block diagram of the main portions of the vibration speaker 12 according to the present embodiment. The vibration speaker 12 includes a panel 30 that detects the contact position of the user's finger or the like due to a change in capacitance or the like; an input unit 40 that accepts input of an operation such as a playback instruction; a display unit 50 that displays images, the operation state, and the like; the laminated piezoelectric element 610*a* forming the piezoelectric vibrator 60*a*; and a laminated piezoelectric element 610*b* forming the piezoelectric vibrator 60*b*. Furthermore, the vibration speaker 12 includes a wireless communication unit 110, a piezoelectric element drive unit 120, a control unit 130, a memory 145, a detection switch 195, and a loudspeaker 190. The panel 30, input unit 40, display unit 50, wireless communication unit 110, piezoelectric element drive unit 120, memory 145, detection switch 195, and loudspeaker 190 connect to the control unit 130. The laminated piezoelectric element 610*a* and the laminated piezoelectric element 610*b* connect to the control unit 130 via the piezoelectric element drive unit 120. The panel 30 and the display unit 50 integrally form a touch panel.

The wireless communication unit 110 may have a well-known structure and connects wirelessly to other terminals or to a communication network via a close-range wireless communication standard, infrared, or the like. The control unit 130 is a processor that controls overall operations of the vibration speaker 12. The control unit 130 applies a playback sound signal (voltage corresponding to a playback sound signal of the other party's voice, a ringtone, music including songs, or the like) to the laminated piezoelectric element 610*a* and the laminated piezoelectric element 610*b* via the piezoelectric element drive unit 120. Note that the playback sound signal may be based on music data stored in internal memory or may be music data stored on an external server or the like and played back over a network.

Figure 46:
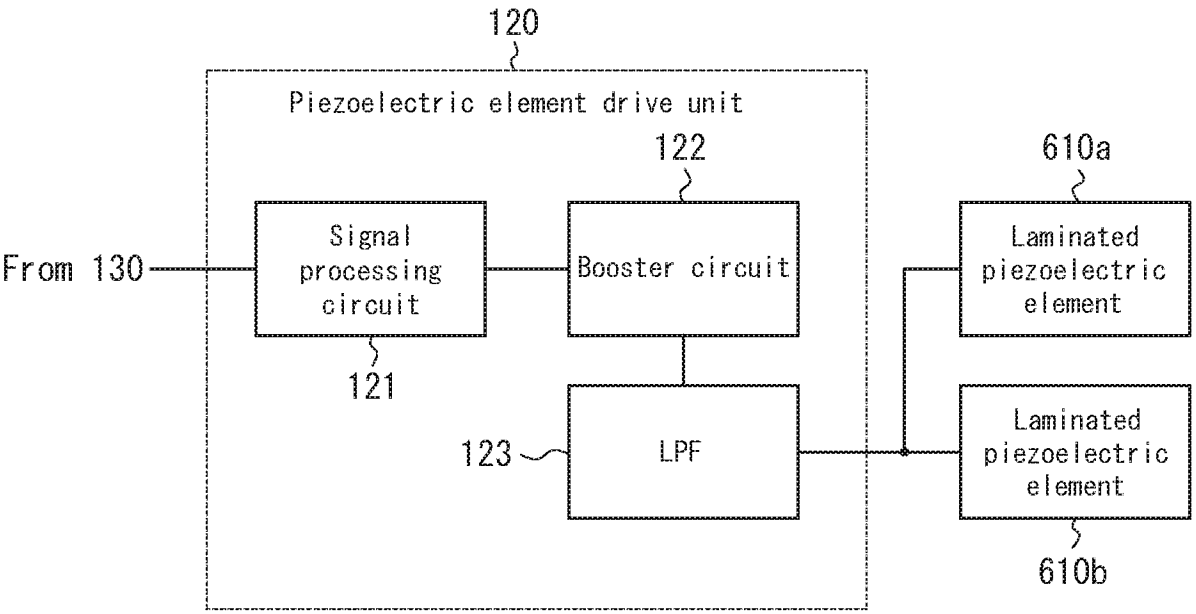
FIG. 46 is a functional block diagram illustrating the structure of an example of the piezoelectric element drive unit in FIG. 45.

For example as illustrated in FIG. 46, the piezoelectric element drive unit 120 includes a signal processing circuit 121, a booster circuit 122, and a low pass filter (LPF) 123. The signal processing circuit 121 may be configured using a digital signal processor (DSP) that includes an equalizer, A/D converter circuit, or the like and performs necessary signal processing, such as equalizing, D/A conversion, or the like on a digital signal from the control unit 130 to generate an analog playback sound signal, outputting the analog playback sound signal to the booster circuit 122. The functions of the signal processing circuit 121 may be internal to the control unit 130.

The memory 145 stores programs, data, and the like used by the control unit 130. The detection switch 195 is configured using, for example, an illuminance sensor, an infrared sensor, a mechanical switch, or the like, and detects when the vibration speaker 12 is placed on a contact surface, such as a desk, table, or the like, outputting the result of detection to the control unit 130. Based on the detection result from the detection switch 195, the control unit 130 for example turns operation of the laminated piezoelectric element 610*a* and the laminated piezoelectric element 610*b* on and off. The loudspeaker 190 is a speaker that outputs audio due to control by the control unit 130.

The booster circuit 122 boosts the voltage of the input analog playback sound signal and applies the result to the laminated piezoelectric element 610*a* and the laminated piezoelectric element 610*b* via the LPF 123. The maximum voltage of the playback sound signal applied to the laminated piezoelectric element 610*a* and the laminated piezoelectric element 610*b* by the booster circuit 122 may, for example, be from 1 Vpp to 500 Vpp, yet the voltage is not limited to this range and may be adjusted appropriately in accordance with the weight of the vibration speaker 12 and the performance of the laminated piezoelectric element 610*a* and the laminated piezoelectric element 610*b*. For the playback sound signal applied to the laminated piezoelectric element 610*a* and the laminated piezoelectric element 610*b*, direct current may be biased, and the maximum voltage may be set centered on the bias voltage.

Figure 47:
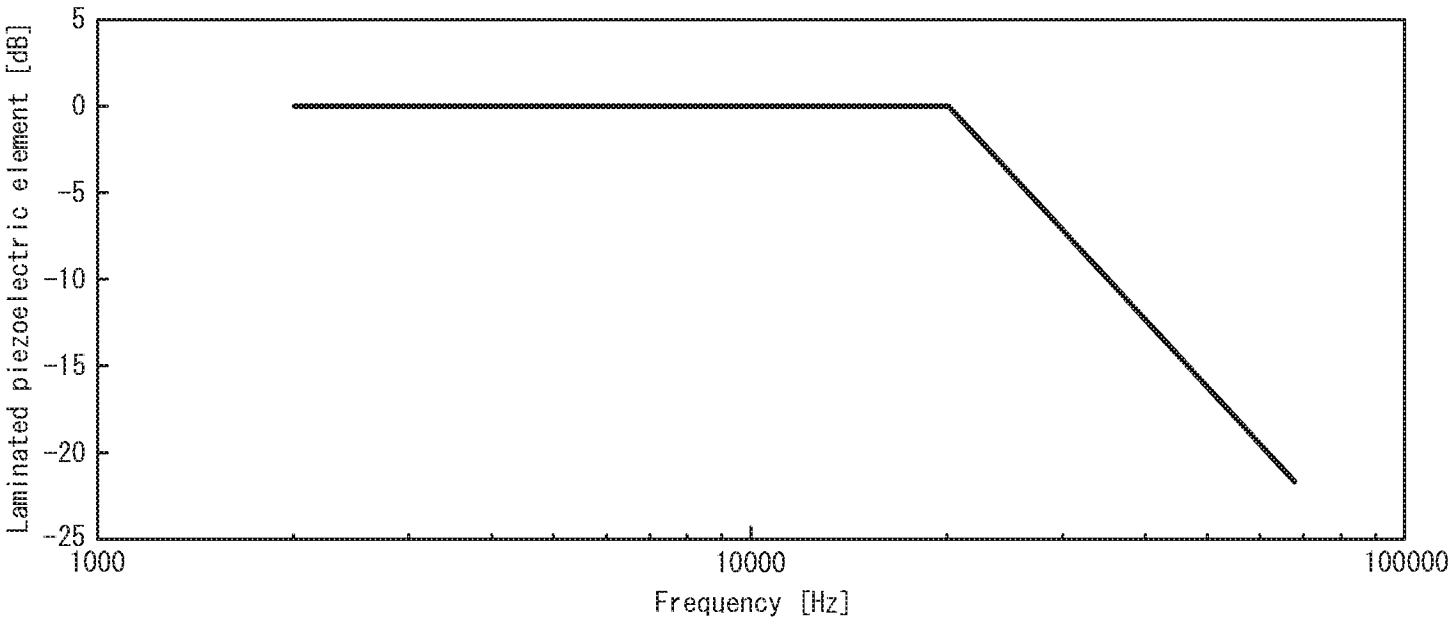
FIG. 47 illustrates an example of the frequency characteristic of the LPF in FIG. 46.

For piezoelectric elements in general, not just the laminated piezoelectric element 610*a* and the laminated piezoelectric element 610*b*, power loss increases as the frequency becomes higher. Therefore, the LPF 123 is set to have a frequency characteristic that attenuates or cuts at least a portion of a frequency component of approximately 10 kHz to 50 kHz or more, or to have a frequency characteristic such that the attenuation rate increases gradually or stepwise. As an example, FIG. 47 illustrates the frequency characteristic of the LPF 123 when the cutoff frequency is approximately 20 kHz. Thus attenuating or cutting the high-frequency component can suppress power consumption and can also suppress heat generation in the laminated piezoelectric element 610*a* and the laminated piezoelectric element 610*b*.

The loudspeaker 190 is driven by being controlled by the control unit 130 and emits audio upon input of a playback sound signal. This audio signal may be the same as the playback sound signal that is applied to the laminated piezoelectric element 610*a* and the laminated piezoelectric element 610*b* or may be different. This audio signal may be applied to the loudspeaker 190 simultaneously with application of the playback sound signal to the laminated piezoelectric element 610*a* and the laminated piezoelectric element 610*b* so that the loudspeaker 160 is driven simultaneously with the laminated piezoelectric element 610*a* and the laminated piezoelectric element 610*b*.

Figure 48:
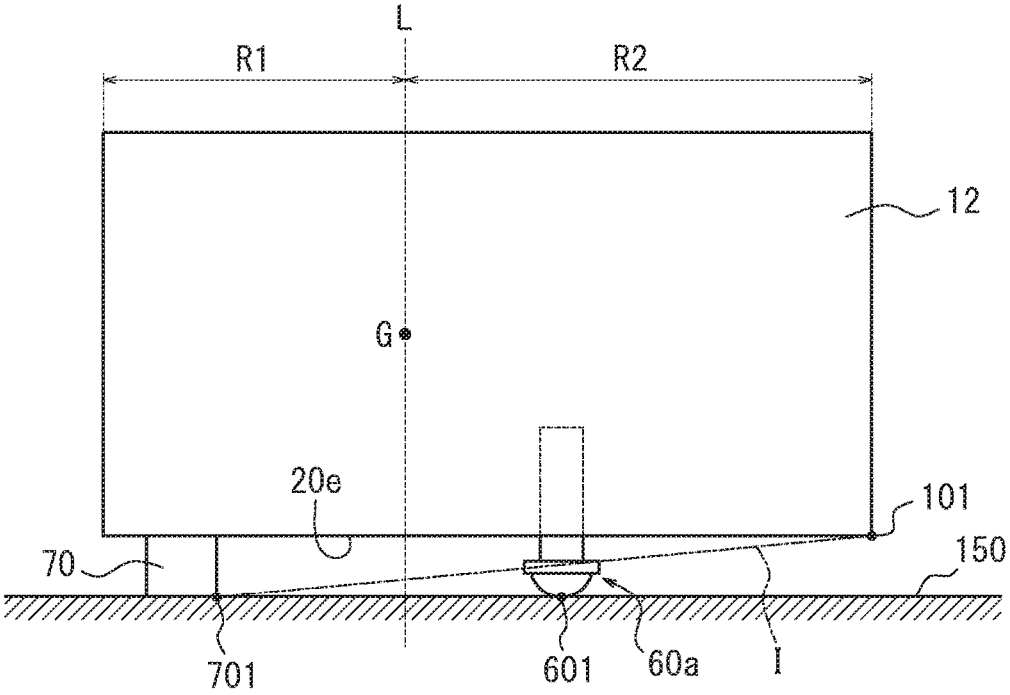
FIG. 48 illustrates the arrangement of the piezoelectric vibrator and the elastic member in the sound generator in FIG. 42.

Next, with reference to FIG. 48, the arrangement of the piezoelectric vibrator 60*a*, the piezoelectric vibrator 60*b*, and the elastic member 70 is described. FIG. 48 illustrates a state in which the vibration speaker 12 is mounted on a horizontal contact surface 150, such as a desk, with the bottom face 20*e* downwards. The desk referred to here is an example of a contacted member in the present disclosure, and the contact surface 150 is an example of a contact surface (mounting surface) that the sound generator contacts. As illustrated in FIG. 48, the vibration speaker 12 is supported at three points on the contact surface 150 by the piezoelectric vibrator 60*a*, the piezoelectric vibrator 60*b*, and the elastic member 70. Point G is the center of gravity of the vibration speaker 12. In other words, the point G is the center of gravity of the anchor in the sound generator. Note that in FIG. 48, for the sake of simplicity, the piezoelectric vibrator 60*b* is not illustrated, yet the description below applies equally to the piezoelectric vibrator 60*b*.

In FIG. 48, the elastic member 70 has a lowermost edge 701. The lowermost edge 701 is, within the elastic member 70, the location that abuts the horizontal contact surface 150, such as a desk, when the vibration speaker 12 is mounted on the contact surface 150 with the bottom face 20*e* downwards.

The piezoelectric vibrator 60*a* has a lowermost edge 601. The lowermost edge 601 is, within the piezoelectric vibrator 60*a*, the location that abuts the horizontal contact surface 150, such as a desk, when the vibration speaker 12 is mounted on the contact surface 150 with the bottom face 20*e* downwards. The lowermost edge 601 is, for example, the tip of the cap 63.

The vibration speaker 12 has a lowermost edge 201. The lowermost edge 201 is, within the vibration speaker 12, the location that would abut the horizontal contact surface 150, such as a desk, when the vibration speaker 12 is mounted on the contact surface 150 with the bottom face 20*e* downwards if the piezoelectric vibrator 60*a* did not exist. A non-limiting example of the lowermost edge 201 of the vibration speaker 12 is a corner of the housing 20. When a protrusion protrudes from the bottom face 20*e*, this protrusion may be the lowermost edge 201 of the vibration speaker 12. The protrusion may, for example, be a side key, a connector cap, or the like.

In FIG. 48, a dashed line L is a line (virtual line) that traverses the center of gravity G of the vibration speaker 12 and is perpendicular to the horizontal contact surface 150, such as a desk, when the vibration speaker 12 is mounted on the contact surface 150 with the bottom face 20*e* downwards. An alternate long and short dash line I is a line (virtual line) that connects the lowermost edge 701 of the elastic member 70 and the lowermost edge 201 of the vibration speaker 12 assuming the piezoelectric vibrator 60*a* does not exist.

In FIG. 48, the region R1 is a region at one side of the vibration speaker 12, separated by the dashed line L. The region R2 is a region at the other side of the vibration speaker 12, separated by the dashed line L. The elastic member 70 is provided on the bottom face 20*e* in the region R1. The piezoelectric vibrator 60*a* is provided on the bottom face 20*e* in the region R2.

In the region R2 of the bottom face 20*e*, the piezoelectric vibrator 60*a* is preferably provided at a position as close as possible to the dashed line L. The load on the piezoelectric vibrator 60*a* thus increases as compared to when the piezoelectric vibrator 60*a* is provided at a position distant from the dashed line L on the bottom face 20*e* in the region R2. Hence, the vibration speaker 12 can effectively be used as an anchor for the sound generator.

In the region R1 of the bottom face 20*e*, the elastic member 70 is preferably provided at a position as far as possible from the dashed line L. A sufficient distance can thus be ensured between the elastic member 70 and the piezoelectric vibrator 60*a* even when the piezoelectric vibrator 60*a* is placed at a position as close as possible to the dashed line L. Hence, the sound generator can be stably mounted on the contact surface 150.

When the laminated piezoelectric element 610*a* is fully expanded from a state in which no voltage is applied thereto and the laminated piezoelectric element 610*a* is not expanding or contracting, or at the time of maximum amplitude of the laminated piezoelectric element 610*a*, the lowermost edge 601 of the piezoelectric vibrator 60*a* is preferably located towards the contact surface 150 from the alternate long and short dash line I. In other words, when the laminated piezoelectric element 610*a* is fully expanded from a state in which no voltage is applied thereto and the laminated piezoelectric element 610*a* is not expanding or contracting, or at the time of maximum amplitude of the laminated piezoelectric element 610*a*, the lowermost edge 601 preferably projects towards the contact surface 150 from the alternate long and short dash line I. In this way, the contact surface 150 can appropriately be vibrated by the piezoelectric vibrator 60*a*.

Furthermore, when the laminated piezoelectric element 610*a* is fully contracted from a state in which no voltage is applied thereto and the laminated piezoelectric element 610*a* is not expanding or contracting, or at the time of minimum amplitude of the laminated piezoelectric element 610*a*, the lowermost edge 601 of the piezoelectric vibrator 60*a* is preferably located towards the contact surface 150 from the alternate long and short dash line I. In other words, when the laminated piezoelectric element 610*a* is fully contracted from a state in which no voltage is applied thereto and the laminated piezoelectric element 610*a* is not expanding or contracting, or at the time of minimum amplitude of the laminated piezoelectric element 610*a*, the lowermost edge 601 preferably projects towards the contact surface 150 from the alternate long and short dash line I. It is thus more difficult for the lowermost edge 201 of the vibration speaker 12 to contact the contact surface 150, which for example depending on the type of paint on the housing 20, makes it more difficult for the paint to peel off. Abnormal noise is also less likely to be emitted between the lowermost edge 201 and the contact surface 150.

Figure 49A:
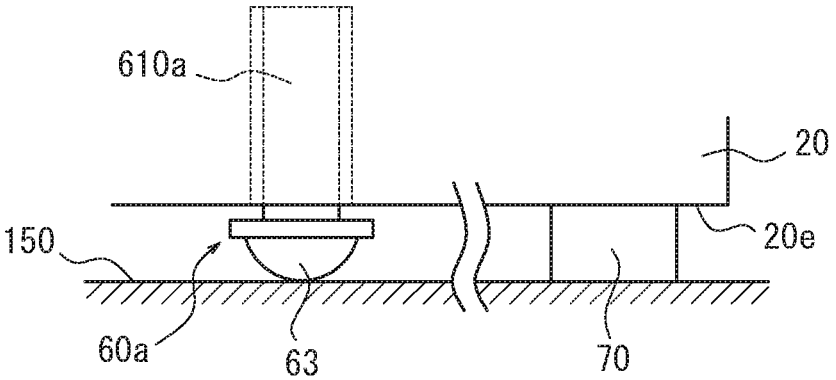
FIG. 49A schematically illustrates operation of the vibration speaker in FIG. 42 as a sound generator.
Figure 49B:
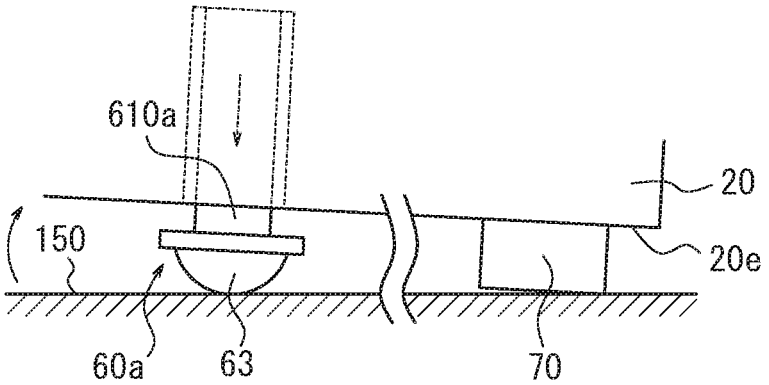
FIG. 49B schematically illustrates operation of the vibration speaker in FIG. 42 as a sound generator.
Figure 49C:
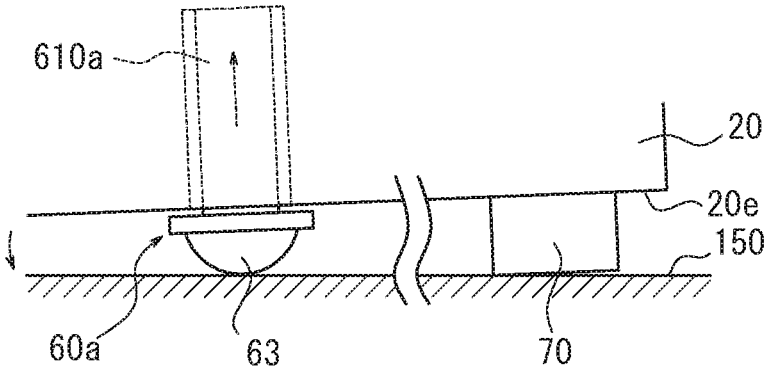
FIG. 49C schematically illustrates operation of the vibration speaker in FIG. 42 as a sound generator.

FIGS. 49A, 49B, and 49C schematically illustrate operation of the vibration speaker 12 according to the present embodiment as a sound generator. The following description uses the piezoelectric vibrator 60*a* as an example yet equally applies to the piezoelectric vibrator 60*b* as well. When causing the vibration speaker 12 to function as a sound generator, the vibration speaker 12 is mounted on a contact surface 150, such as a desk, with the bottom face 20*e* of the housing 20 downwards, so that the cap 63 of the piezoelectric vibrator 60*a* and the elastic member 70 contact the contact surface 150, as illustrated in FIG. 49A. In this way, the weight of the vibration speaker 12 is provided to the piezoelectric vibrator 60*a* as a load. In other words, the vibration speaker 12 acts as an anchor for the sound generator according to the present disclosure. Note that in the state illustrated in FIG. 49A, the laminated piezoelectric element 610*a* does not expand or contract, since no voltage is applied thereto.

In this state, when the laminated piezoelectric element 610*a* of the piezoelectric vibrator 60*a* is driven by a playback sound signal, the laminated piezoelectric element 610*a* vibrates by expanding and contracting in accordance with the playback sound signal with the portion of the elastic member 70 contacting the contact surface 150 acting as a pivot, and without the cap 63 separating from the contact surface 150, as illustrated in FIGS. 49B and 49C. As long as problems such as the lowermost edge 201 contacting the contact surface 150 and emitting abnormal noise do not occur, the cap 63 may separate slightly from the contact surface 150. The difference in length between when the laminated piezoelectric element 610*a* is fully expanded and fully contracted may, for example, be from 0.05 μm to 100 μm. In this way, the expanding and contracting vibration of the laminated piezoelectric element 610*a* is transmitted to the contact surface 150 through the cap 63, and the contact surface 150 vibrates, causing the contact surface 150 to function as a vibration speaker by emitting sound. If the difference in length between full expansion and full contraction is less than 0.05 μm, it may not be possible to vibrate the contact surface appropriately. Conversely, if the difference exceeds 100 μm, vibration grows large depending on the frequency, and the sound generator may wobble. Even if the difference is less than 100 μm, the sound generator may wobble due to the relationship between load and frequency.

As described above, when the laminated piezoelectric element 610*a* is fully expanded, the tip of the cap 63 is preferably located towards the contact surface 150 from a line (the alternate long and short dash line I in FIG. 48) connecting the lowermost edge 701 of the elastic member 70 and the lowermost edge 201 of the vibration speaker 12 assuming the piezoelectric vibrator 60*a* does not exist. Furthermore, when the laminated piezoelectric element 610*a* is fully contracted, the tip of the cap 63 is preferably located towards the contact surface 150 from this virtual line.

The location at which the piezoelectric vibrator 60 is disposed on the bottom face 20*e*, the length of the laminated piezoelectric element 610*a* in the lamination direction, the dimensions of the cap 63, and the like are appropriately determined so as to satisfy the above conditions.

According to the vibration speaker as a sound generator in the present embodiment, a piezoelectric element is used as the source of vibration, hence reducing the number of components as compared to a vibration generating device having a dynamic speaker configuration and allowing for a simple structure with few components. Furthermore, the stack-type laminated piezoelectric element 610*a* is used as the piezoelectric element and vibrates by expanding and contracting along the lamination direction due to a playback sound signal. Since this expanding and contracting vibration is transmitted to the contact surface 150, the vibration transmission efficiency with respect to the contact surface 150 in the expansion and contraction direction (deformation direction) is good, and the contact surface 150 can be vibrated efficiently. Moreover, since the laminated piezoelectric element 610*a* contacts the contact surface 150 with the cap 63 therebetween, damage to the laminated piezoelectric element 610*a* can also be prevented. By mounting the vibration speaker 12 on the contact surface 150 so that the cap 63 of the piezoelectric vibrator 60*a* contacts the contact surface 150, the weight of the vibration speaker 12 is applied as a load to the cap 63. Hence, the cap 63 can reliably contact the contact surface 150, and the expanding and contracting vibration of the piezoelectric vibrator 60*a* can efficiently be transmitted to the contact surface 150.

The sound generator according to the present embodiment includes two piezoelectric vibrators, the piezoelectric vibrator 60*a* and the piezoelectric vibrator 60*b*, on a virtual plane perpendicular to the expansion and contraction direction of the piezoelectric elements forming the piezoelectric vibrator 60*a* and the piezoelectric vibrator 60*b*. Hence, as compared to the case of only one piezoelectric vibrator, the stroke can be the same, and the output power can be doubled. Furthermore, since the piezoelectric vibrator 60*a* and the piezoelectric vibrator 60*b* are provided, stereo sound can be achieved by providing the vibrators respectively with right audio input and left audio input.

The present disclosure is not limited to the above embodiments, and a variety of modifications and changes are possible. For example, the mobile phone 10 in Embodiment 1 includes one elastic member 70, yet the mobile phone 10 may include a plurality of elastic members 70 on the bottom side 20*a*. The mobile phone 10 can thus be mounted on the contact surface more stably.

Figure 50:
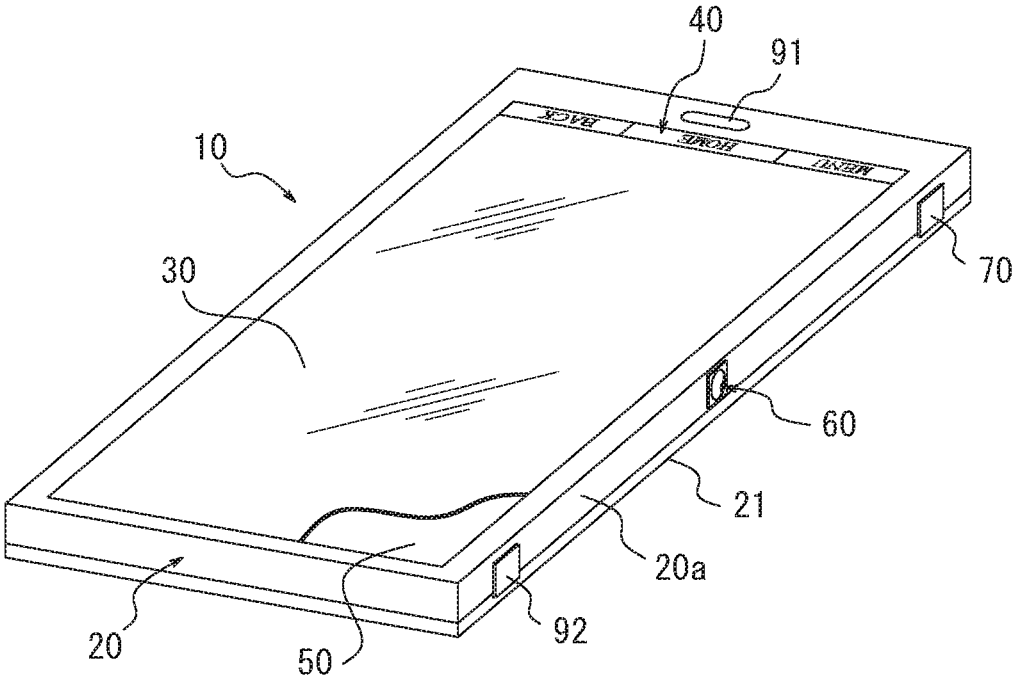
FIG. 50 is an external perspective view schematically illustrating the structure of a sound generator in which the measurement unit includes a vibration detector.

In Embodiment 1, the measurement unit 90 has been described as including a microphone 91 and measuring a frequency characteristic of sound acquired by the microphone 91, yet the measurement unit 90 is not limited in this way. For example, the measurement unit 90 may include a vibration detector and may measure a frequency characteristic of the amplitude of vibration, detected by the vibration detector, of the contact surface. As illustrated in the external perspective view in FIG. 50, the mobile phone 10 may include, on the bottom side 20*a*, a vibration detector 92 that is a vibration pickup or the like including, for example, a piezoelectric element or an acceleration sensor. When the mobile phone 10 is mounted horizontally on the contact surface, the vibration detector 92 contacts the contact surface and measures the amplitude of vibration of the contact surface.

Figure 51A:
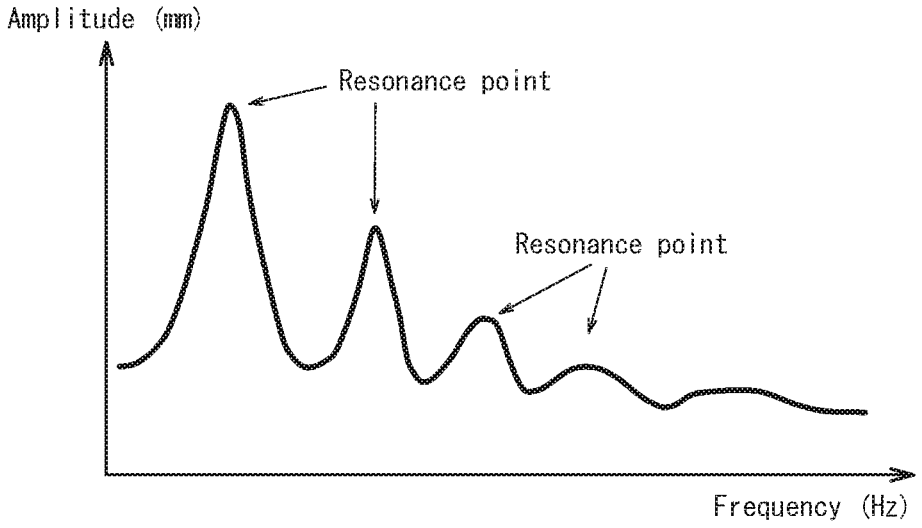
FIG. 51A schematically illustrates the frequency characteristic with respect to amplitude of vibration of the contact surface when, for example, the frequency of a sound signal applied to a laminated piezoelectric element matches the resonance frequency of the contact surface.
Figure 51B:
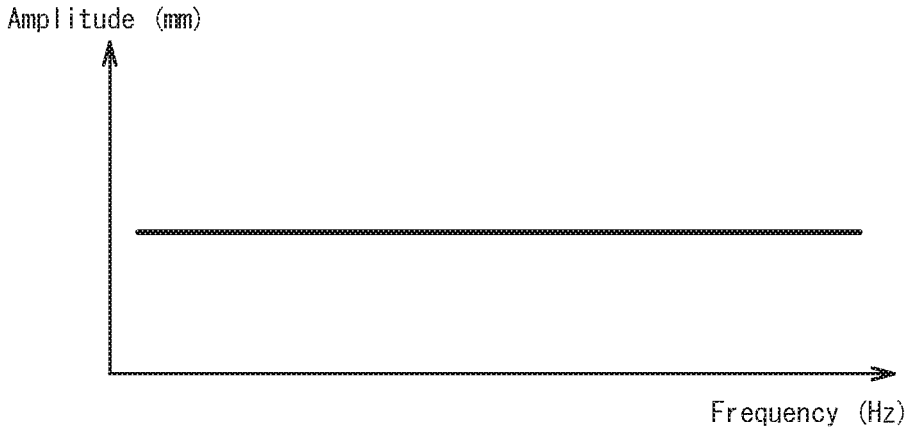
FIG. 51B schematically illustrates the frequency characteristic with respect to amplitude of vibration of the contact surface when the input voltage is controlled so that the contact surface vibrates with an amplitude such that sound emitted from the contact surface has a target frequency characteristic.

When the laminated piezoelectric element 61 is used to cause sound to be emitted, sound with a desired frequency characteristic is preferably emitted. Even if a sound signal with the same voltage is applied to the laminated piezoelectric element 61 at each frequency, however, the amplitude of vibration of the contact surface might not be uniform. In greater detail, for example when the frequency of the sound signal applied to the laminated piezoelectric element 61 matches the resonance frequency of the contact surface, then as schematically illustrated in FIG. 51A, the amplitude of vibration of the contact surface is greater as compared to when a sound signal at other frequencies is applied to the laminated piezoelectric element 61. The volume of sound emitted from the contact surface is correlated with the amplitude of vibration of the contact surface. Hence, when the difference in amplitude based on frequency is large, as in FIG. 51A, the volume of the sound emitted from the contact surface is not uniform, and the desired frequency characteristic for the sound cannot be acquired. This is inconvenient for the user. Therefore, the control unit 130 controls the input voltage based on a frequency characteristic so that the contact surface vibrates at an amplitude such that sound emitted from the contact surface has a target frequency characteristic. By controlling the input voltage, the control unit 130 can cause the contact surface to vibrate at an amplitude uniform at all frequencies, for example as illustrated in FIG. 51B. Note that the amplitude of the contact surface controlled by the control unit 130 is not limited to the example in FIG. 51B and may be any amplitude.

When the measurement unit 90 includes the vibration detector 92, in the flowchart in FIG. 8, after the control unit 130 applies the reference voltage Vr in step S102, the amplitude of vibration of the contact surface is measured by the vibration detector 92, and the control unit 130 acquires the result of measurement of the amplitude from the vibration detector 92 (step S103). The control unit 130 then stores the acquired result of amplitude measurement in association with the frequency f at which the amplitude was measured in the storage unit 140 (step S104). Subsequently, in step S108, the control unit 130 refers to the amplitude stored in the storage unit 140 to determine the input voltage based on a frequency characteristic. Note that when the measurement unit 90 includes the vibration detector 92, the other detailed steps in the flowchart in FIG. 8 are the same as in Embodiment 1.

Figure 52A:
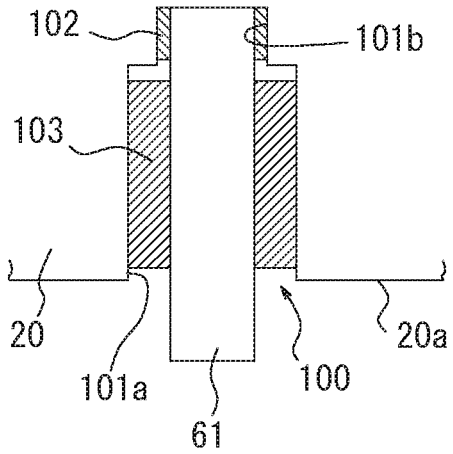
FIG. 52A illustrates a modification to the holding state of the piezoelectric vibrator.
Figure 52B:
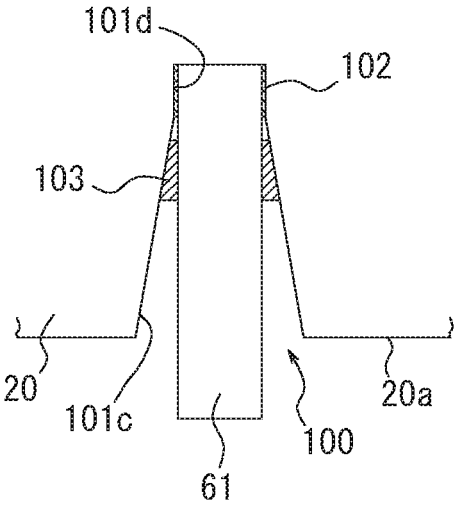
FIG. 52B illustrates another modification to the holding state of the piezoelectric vibrator.
Figure 52C:
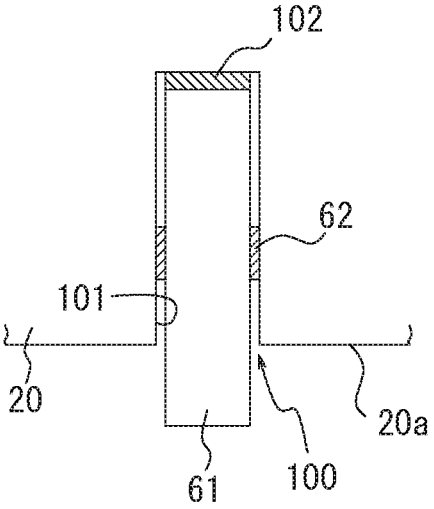
FIG. 52C illustrates yet another modification to the holding state of the piezoelectric vibrator.

Furthermore, the structure to fix the piezoelectric vibrator 60 to the holding unit 100 is not limited to that illustrated in FIG. 5. For example, as illustrated in FIGS. 52A to 52C, the piezoelectric vibrator 60 may be held by the holding unit 100. The holding unit 100 illustrated in FIG. 52A includes a wide slit 101*a* that opens to the bottom side 20*a* and a narrow slit 101*b* that is contiguous with the slit 101*a*. One end of the laminated piezoelectric element 61 is disposed in the narrow slit 101*b*, and the sides of the laminated piezoelectric element 61 are fixed to the slit 101*b* by adhesive 102. Filler 103 such as silicone rubber, gel, or the like that does not impede expansion and contraction of the laminated piezoelectric element 61 is packed in the gap between the wide slit 101*a* and the laminated piezoelectric element 61. By thus holding the piezoelectric vibrator 60 in the holding unit 100, the mobile phone 10 can more reliably be waterproofed without using waterproof packing such as an O-ring. By covering the portion of the laminated piezoelectric element 61 protruding from the bottom side 20*a* with an insulating cap, the laminated piezoelectric element 61 can also reliably be insulated.

The holding unit 100 illustrated in FIG. 52B includes a tapered slit 101*c* that expands toward the bottom side 20*a* and a narrow slit 101*d* that is contiguous with the tapered slit 101*c*. One end of the laminated piezoelectric element 61 is disposed in the narrow slit 101*d*, and the sides of the laminated piezoelectric element 61 are fixed to the slit 101*d* by adhesive 102. Filler 103 such as silicone rubber, gel, or the like that does not impede expansion and contraction of the laminated piezoelectric element 61 is packed in the gap between the tapered slit 101*c* and the laminated piezoelectric element 61. This structure achieves the same effects as the holding unit 100 in FIG. 52A, and by including the tapered slit 101*c*, offers the advantage that the laminated piezoelectric element 61 is easy to assemble into the holding unit 100.

As in the above embodiment, the holding unit 100 illustrated in FIG. 52C has a uniform-width slit 101, yet the end face at one end of the laminated piezoelectric element 61 is fixed to the slit 101 by adhesive 102. Furthermore, an O-ring 62 is disposed in the slit 101 at an appropriate location along the laminated piezoelectric element 61. Holding the laminated piezoelectric element 61 in this way particularly offers an advantage in routing lead wires in the case that connectors for lead wires are formed in lateral electrodes of the laminated piezoelectric element 61, as illustrated in FIG. 4.

Figure 53:
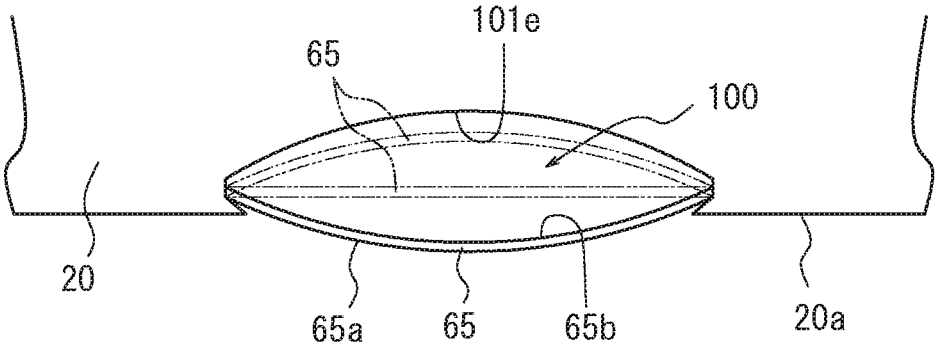
FIG. 53 schematically illustrates the structure of the main parts of a modification to the piezoelectric vibrator.

In the above embodiments and the modifications in FIGS. 52A to 52C, the cap 63 may be omitted from the piezoelectric vibrator 60, so that the end surface of the laminated piezoelectric element 61 is mounted on the contact surface directly or with a vibration transmission member, formed from an insulating member or the like, therebetween. The piezoelectric element in Embodiment 1 is not limited to the above-described stack-type laminated piezoelectric element. A unimorph, bimorph, or laminated bimorph element may be used. FIG. 53 schematically illustrates the structure of the main parts when using bimorph. Bimorph 65 is shaped as an elongated rectangle, with one surface 65*a* exposed at the bottom side 20*a* of the housing 20, and the edges of the rectangle held by the holding unit 100. The holding unit 100 includes an opening 101*e* that holds the bimorph 65, and the inner surface of the opening 101*e* towards a back side 65*b* of the bimorph 65 is curved. According to this structure, by mounting the housing 20 on the contact surface so that the bimorph 65 contacts the contact surface and then driving the bimorph 65 with a playback sound signal, the bimorph 65 undergoes bending (flexure) vibration. In this way, the vibration of the bimorph 65 is transmitted to the contact surface, and the contact surface functions as a vibration speaker, causing playback sound to be emitted from the contact surface. Note that a covering layer of polyurethane or the like may be formed on the surface 65*a* of the bimorph 65.

In the above embodiments, an example of the piezoelectric vibrator 60 being disposed on the bottom side 20*a* of the housing 20 and protruding from the bottom side 20*a* has been described, yet the present disclosure is not limited in this way. Depending on the dimensions of the housing 20 and the dimensions of the piezoelectric vibrator 60, the piezoelectric vibrator 60 may, for example, protrude from the battery lid 21.

In the above embodiments, the contacted member is a desk, and the contact surface is a horizontal mounting surface of the desk, yet the present disclosure is not limited in this way. The contact surface need not be horizontal. The contact surface may, for example, be a surface of the desk perpendicular to the ground. An example of a contacted member having a surface perpendicular to the ground is a partition for sectioning off space.

In the above embodiments, the sound generator is installed in the mobile phone 10, and the mobile phone 10 functions as an anchor, yet the anchor is not limited in this way. For example, a sound generator may be installed in any of a wide variety of electronic devices serving as an anchor, such as a portable music player, a tabletop television, a telephone conferencing system, a notebook computer, a projector, a hanging clock or hanging television, an alarm clock, or a photo frame.

Furthermore, in FIG. 20, a LPF having the same characteristics as the LPF 123 may be provided between the signal processing circuit 121 and the booster circuit 122. In FIG. 20, the LPF 123 may also be omitted by providing an equalizer of the signal processing circuit 121 or the like with the functions of the LPF 123.

In Embodiment 3, an example of the cover 97 being disposed on the bottom side 20*a* of the housing 20 and the vibration unit 98 protruding from the bottom side 20*a* has been described, yet the present disclosure is not limited in this way. Depending on the dimensions of the housing 20 and the dimensions of the piezoelectric vibrator 60, the piezoelectric vibrator 60 and the cover 97 may, for example, be provided in the battery lid 21, and the vibration unit 98 may protrude from the battery lid 21.

Figure 54:
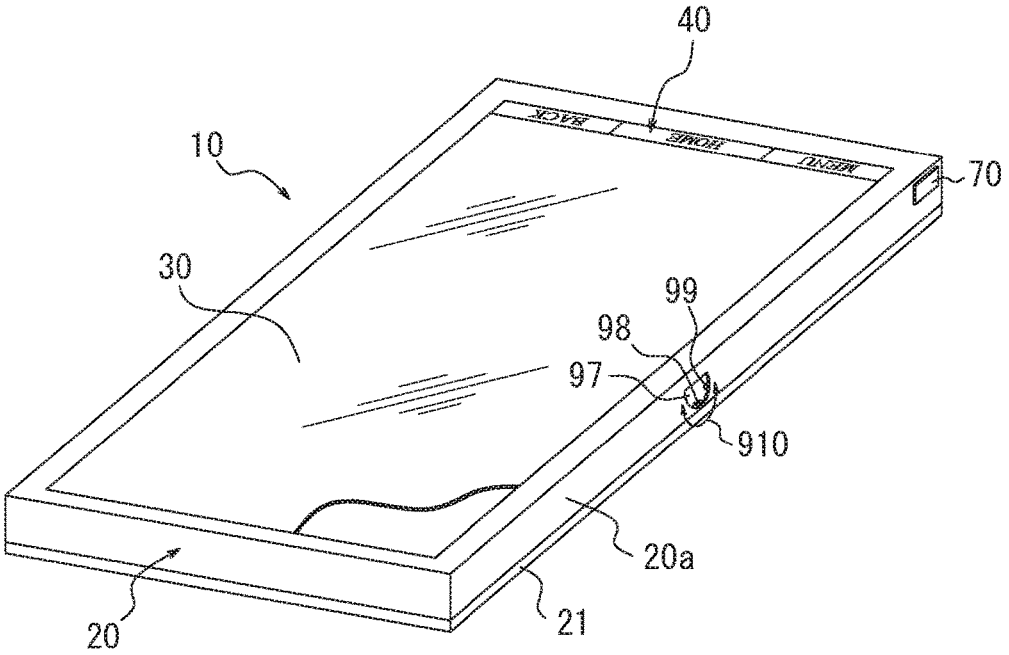
FIG. 54 is an external perspective view schematically illustrating the structure of a sound generator provided with a circular cover.

The cover 97 is not limited to being slid in the longitudinal direction along the bottom side 20*a*, as illustrated in FIG. 15. For example, as illustrated in FIG. 54, the cover 97 may be circular and may be manipulated by being rotated in the directions of the arrows 910.

Figure 55A:
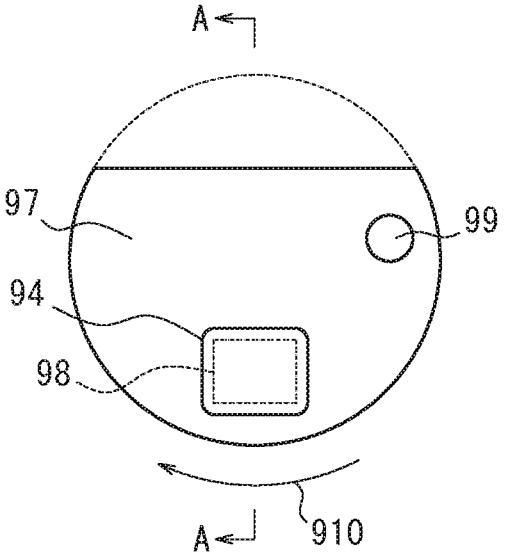
FIG. 55A schematically illustrates a first position of the cover in FIG. 13.
Figure 55B:
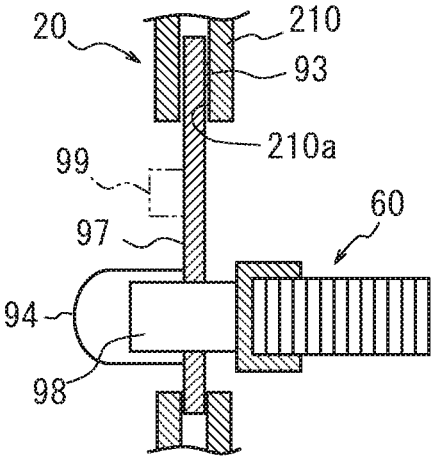
FIG. 55B is a cross-section along the A-A line in FIG. 55A.
Figure 55C:
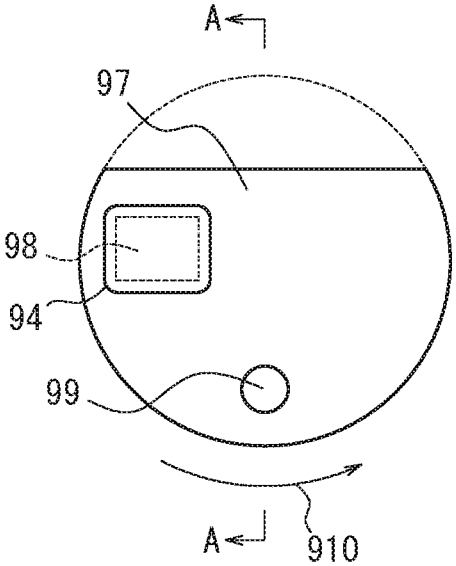
FIG. 55C schematically illustrates a second position of the cover in FIG. 13.
Figure 55D:
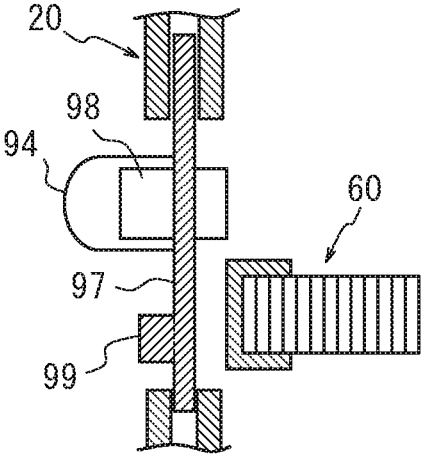
FIG. 55D is a cross-section along the A-A line in FIG. 55B.

FIG. 55A through FIG. 55D illustrate operation of a circular cover. FIG. 55A illustrates the contact state of the vibration unit 98 with the piezoelectric vibrator 60. At this time, the cover 97 is in a first position. FIG. 55B is a cross-section along the A-A line in FIG. 55A. FIG. 55C illustrates the non-contact state of the vibration unit 98 with the piezoelectric vibrator 60. At this time, the cover 97 is in a second position. FIG. 55D is a cross-section along the A-A line in FIG. 55C. By manipulating the protrusion 99, the user of the mobile phone 10 can move the cover 97 (vibration unit 98) in the rotational direction between the first position and the second position, thereby switching between the contact state and the non-contact state of the vibration unit 98 with the piezoelectric vibrator 60. The first position in FIG. 55A is used when emitting sound with the mobile phone 10. In other words, since the piezoelectric vibrator 60 and the vibration unit 98 are in contact, as illustrated in FIG. 55B, vibration of the piezoelectric element is transmitted to the contact surface, such as a desk, via the vibration unit 98. Conversely, the second position in FIG. 55C is used when not emitting sound with the mobile phone 10. In this case, since the piezoelectric vibrator 60 and the vibration unit 98 are not in contact, as illustrated in FIG. 55D, vibration of the piezoelectric element is not transmitted to the contact surface. Furthermore, in the non-contact state, the piezoelectric vibrator 60 is protected by the cover 97. Therefore, even if the mobile phone 10 is dropped, for example, providing a shock to the bottom side 20*a* from the location of impact, the cover 97 receives the shock and can thus protect the piezoelectric vibrator 60 from the shock of the drop.

The circular cover 97 also functions as a switch for input of a sound signal to the piezoelectric element 61. As illustrated in FIG. 55B, the circular cover 97 includes a switch 93 that is at the opposite side from the vibration unit 98 with the rotation of axis of the cover 97 therebetween and that includes conductive metal towards the inside of the housing 20. A holding member 210, which is a portion of the housing 20 that holds the cover 97, has two terminals on a contact face 210*a* that form part of a circuit for inputting a sound signal to the piezoelectric element 61. When the cover 97 is in the first position, as illustrated in FIG. 55B, the switch 93 contacts the contact surface 210*a*, and the two terminals provided at the contact surface 210*a* are connected via the conductive metal of the switch 93. Hence, the circuit inputting a sound signal to the piezoelectric element 61 is closed, and as a result of a signal being input into the piezoelectric element 61, the piezoelectric vibrator 60 is driven, and vibration thereof is transmitted to the contact surface via the vibration unit 98. The mobile phone 10 can thus cause sound to be emitted from the contact surface. Conversely, when the cover 97 is in the second position, the vibration unit 98 is in the non-contact state with the piezoelectric vibrator 60, and the circuit is open. Therefore, no sound signal is input into the piezoelectric element 61, and the piezoelectric vibrator 60 is not driven. Hence, the mobile phone 10 does not cause sound to be emitted.

Figure 56A:
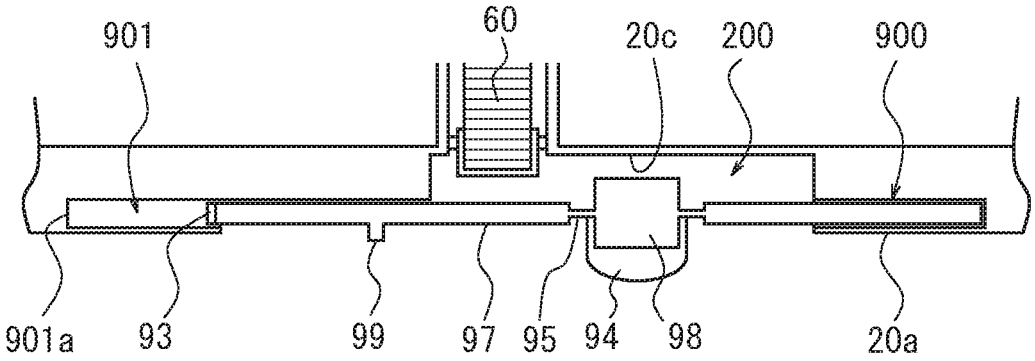
FIG. 56A schematically illustrates the structure of the main parts of a modification to the cover.
Figure 56B:
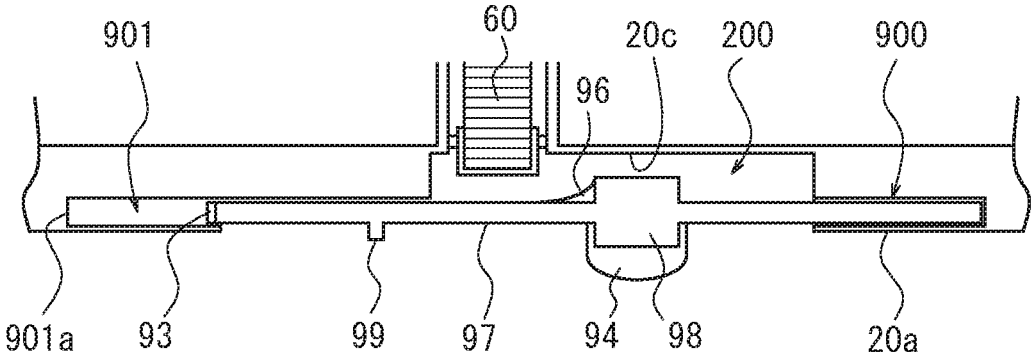
FIG. 56B schematically illustrates the structure of the main parts of another modification to the cover.

The cover is not limited to the shape illustrated in FIG. 18A, FIG. 18B, and FIG. 55A through FIG. 55D. For example, as illustrated in FIG. 56A, at the ends of the vibration unit 98, the cover 97 may include a constricted portion 95 that is thinner than the cover 97. Providing the constricted portion 95 allows the vibration unit 98 to vibrate more easily, thereby allowing vibration of the piezoelectric element 61 to be transmitted to the contact surface 150 more efficiently. For example as illustrated in FIG. 56B, the cover 97 may also be provided with a tapered portion 96 on the side of the vibration unit 98 by the piezoelectric vibrator 60. Providing the tapered portion 96 allows the cover 97 to be moved smoothly when moving the cover 97 from the second position to the first position, without the piezoelectric vibrator 60 and the vibration unit 98 interfering with each other, and so that the piezoelectric vibrator 60 and the cover 97 reliably come into contact.

Furthermore, the switch 93 is not limited to Embodiment 3. For example, a detection switch may be provided in the cover 97 as the switch 93. The detection switch detects whether the end of the cover 97 that includes the switch 93 is in contact with the end face 901*a*, i.e. whether the cover 97 is in the first position. In this case, when detecting that the cover 97 is at the first position, the detection switch inputs a sound signal to the piezoelectric element 61, and when not detecting that the cover 97 is at the first position, i.e. that the cover 97 is at the second position, the detection switch does not input a sound signal to the piezoelectric element 61.

Additionally, for example the cap 94 may be omitted from the vibration unit 98, so that the end surface of the vibration unit 98 contacts the contact surface directly or with a vibration transmission member, formed from an insulating member or the like, therebetween. The protrusion 99 may also be omitted. In this case, the user can move the cover 97 by, for example, moving the vibration unit 98 with a finger.

The present disclosure is not limited to Embodiment 4 above, but rather a variety of modifications and changes are possible. For example, in Embodiment 4, the detection unit 71 has been described as detecting two states using any of the detection mechanisms, yet the present disclosure is not limited in this way. In other words, the detection unit 71 may detect the two states using two or more detection mechanisms. In the case that the detection unit 71 detects the two states using two or more detection mechanisms, the control unit 130 can apply a sound signal to the piezoelectric element 61 when the detection unit 71 detects the driving allowed state with all of the detection mechanisms used for detection of the two states. Conversely, when the detection unit 71 detects the driving denied state with any of the detection mechanisms used for detection of the two states, the control unit 130 can suspend application of the sound signal to the piezoelectric element 61. At this time, the control unit 130 may apply a sound signal to the speaker 41.

Figure 57:
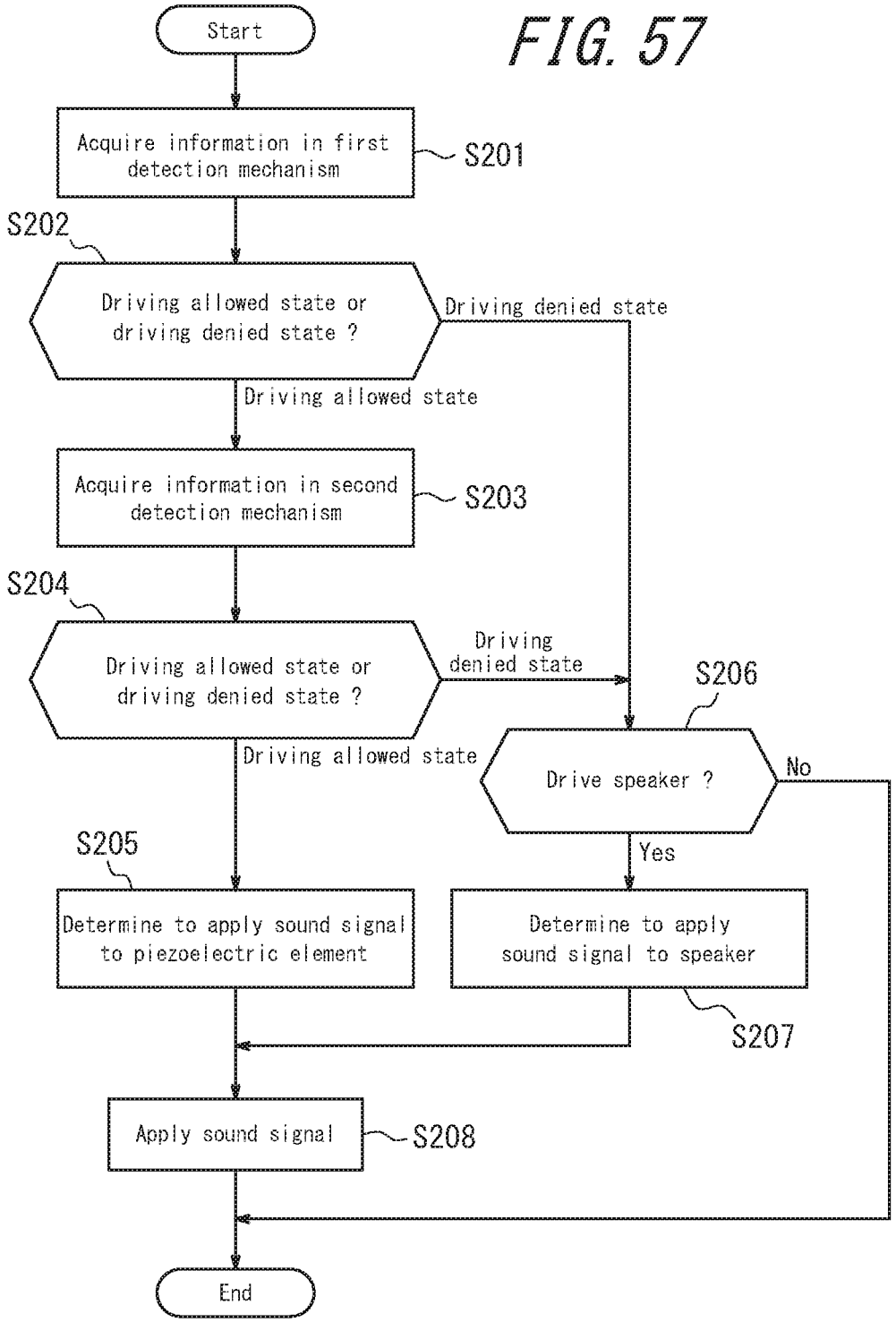
FIG. 57 is a flowchart illustrating a modification to the operation procedure for sound output performed by the mobile phone in FIG. 1.

The following concretely describes the case of the detection unit 71 detecting the two states with two detection mechanisms. Here, the microphone 91 is described as being used for the first detection mechanism, and the proximity sensor 72 for the second detection mechanism, yet the present disclosure is not limited in this way. Any detection mechanisms may be used as the first and the second detection mechanisms. FIG. 57 is a flowchart illustrating an operation procedure for sound output performed by the mobile phone 10 when the detection unit 71 uses two detection mechanisms to detect the two states.

First, in the mobile phone 10, the microphone 91, which is the first detection mechanism, acquires information for judging the two states, i.e. acquires sound emitted from the contact surface 150 (step S201). Next, based on the information acquired by the first detection mechanism, the detection unit 71 detects whether the mobile phone 10 is in the driving allowed state or the driving denied state (step S202). When the detection unit 71 detects the driving allowed state (step S202: driving allowed state), the proximity sensor 72, which is the second detection mechanism, acquires information for judging the two states, i.e. acquires information on whether a detection target is present nearby (step S203). Based on the information acquired by the second detection mechanism, the detection unit 71 then detects whether the mobile phone 10 is in the driving allowed state or the driving denied state (step S204). When the detection unit 71 detects the driving allowed state (step S204: driving allowed state), the control unit 130 determines to apply a sound signal to the piezoelectric element 61 (step S205). The control unit 130 then applies a sound signal to the piezoelectric element 61 (step S208).

Conversely, when the detection unit 71 detects the driving denied state based on information acquired by either the first or the second detection mechanism (step S202: driving denied state, or step S204: driving denied state), the control unit 130 judges whether to drive the speaker 41 (step S206). The control unit 130 for example judges to drive the speaker 41 when the detection unit 71 detects the driving denied state based on information acquired by the microphone 91, which is the first detection mechanism, and judges not to drive the speaker 41 when the detection unit 71 detects the driving denied state based on information acquired by the proximity sensor 72, which is the second detection mechanism.

When the control unit 130 judges to drive the speaker 41 (step S206: Yes), the control unit 130 determines to apply a sound signal to the speaker 41 (step S207). The control unit 130 then applies the sound signal to the speaker 41 (step S208). Conversely, when the control unit 130 judges not to drive the speaker 41 (step S206: No), the control unit 130 does not apply a sound signal, and this processing flow terminates. The mobile phone 10 may repeat this processing flow by having the detection unit 71 periodically or irregularly detect the two states. Also in the case of the detection unit 71 detecting the two states using three or more detection mechanisms, the mobile phone 10 can output sound with a similar operation procedure.

Since the detection unit 71 thus detects the two states of the piezoelectric element 61, i.e. the driving allowed state and the driving denied state, using two or more detection mechanisms, and the control unit 130 applies a sound signal to the piezoelectric element 61 or the speaker 41 in accordance with the detected state, a sound signal can be applied and sound can be output in accordance with a plurality of different circumstances.

In Embodiment 4, the detection mechanisms are not limited to the microphone 91, proximity sensor 72, inclination detection sensor 73, vibration detection sensor 74, and wireless communication unit 110. Any detection mechanism that the detection unit 71 uses to detect the two states may be used.

For example, a camera may be provided on the bottom side 20*a* of the housing 20, and the detection unit 71 may use the camera as a detection mechanism. The camera periodically or irregularly captures an image of the lowermost edge 601, which corresponds to the tip of the piezoelectric vibrator 60, and detects whether the piezoelectric vibrator 60 is in contact with the contact surface 150. Based on the image captured by the camera, the detection unit 71 detects the driving allowed state when the piezoelectric vibrator 60 and the contact surface 150 are in contact and detects the driving denied state when the piezoelectric vibrator 60 and the contact surface 150 are not in contact. The detection unit 71 may, for example, recognize that the mobile phone 10 has moved and detect the driving denied state when the image captured by the camera changes. In this way, the mobile phone 10 can drive the piezoelectric element 61 when the piezoelectric vibrator 60 is in contact with the contact surface and can suspend driving of the piezoelectric element 61 when the mobile phone 10 is moving.

The detection unit 71 can also, for example, use a clock provided in the mobile phone 10 as a detection mechanism. When using a clock as a detection mechanism, the user registers in advance, in the detection unit 71, a time slot during which a sound signal is not to be applied to the piezoelectric element 61. When the clock indicates a time within the time slot registered in advance, the detection unit 71 recognizes that the current time is in a time slot for not applying a sound signal to the piezoelectric element 61 and detects the driving denied state. Conversely, when the clock indicates a time outside of the time slot registered in advance, the detection unit 71 recognizes that the current time is in a time slot for applying a sound signal to the piezoelectric element 61 and detects the driving allowed state. When using a clock as a detection mechanism, the user may register in advance, in the detection unit 71, a time slot during which a sound signal is to be applied to the piezoelectric element 61. In this case, when the clock indicates a time within the time slot registered in advance, the detection unit 71 detects the driving allowed state, and when the clock indicates a time outside of the time slot registered in advance, the detection unit 71 detects the driving denied state. By using a clock as a detection mechanism, it is possible, for example, to prevent sound from being emitted with the piezoelectric element 61 late at night, or to emit sound with the piezoelectric element 61 only within a predetermined time period during the day.

The mobile phone 10 may include a content recognition unit that recognizes content to be played back, and the detection unit 71 may use the content recognition unit as a detection mechanism. For example based on a predetermined algorithm, the content recognition unit recognizes whether content to be played back is content that may be shared with people other than the user. The user may, for example, register content that may be shared with other people in the content recognition unit in advance. When sound is to be output from the mobile phone 10, the content recognition unit recognizes whether the sound is content that may be shared with people other than the user. The detection unit 71 detects the driving allowed state when the content recognition unit recognizes that the sound is content that may be shared and detects the driving denied state when the content recognition unit recognizes that the sound is not content that may be shared. Content that may be shared may, for example, be sound for a movie or a television program. On the other hand, content not corresponding to content that may be shared can be sound, such as a voice mail message, that might include private information on the user. Leaking of private information on the user to others due to sound output using the piezoelectric element 61 can thus be prevented.

The mobile phone 10 may also be provided with a battery amount detection unit that detects the remaining amount of the battery, and the detection unit 71 may use the battery amount detection unit as a detection mechanism. The detection unit 71 detects the driving allowed state when the battery amount detection unit detects that the remaining amount of the battery in the mobile phone 10 is at least a predetermined value, for example when the remaining amount of the battery is at least 10% of the battery capacity. Conversely, the detection unit 71 detects the driving denied state when the battery amount detection unit detects that the remaining amount of the battery in the mobile phone 10 is less than a predetermined value, for example when the remaining amount of the battery is less than 10% of the battery capacity. In this way, when the remaining amount of the battery is low, the mobile phone 10 can suspend driving of the piezoelectric element 61 and can drive the speaker 41, which has lower battery consumption than the piezoelectric element 61.

The mobile phone 10 may also be provided with an operation detection unit, and the detection unit 71 may use the operation detection unit as a detection mechanism. In greater detail, the detection unit 71 detects the driving denied state when the operation detection unit recognizes an operation by the user on the mobile phone 10 and detects the driving allowed state when the operation detection unit does not recognize an operation on the mobile phone 10. While the user is operating the mobile phone 10, it is thus possible to prevent obstruction of such operation by the user on the mobile phone 10 by, for example, having the piezoelectric element 61 refrain from vibrating. During detection of the state using the operation detection unit, the detection unit 71 has been described above as detecting the driving denied state if any operation whatsoever is performed, yet the mobile phone 10 may be configured so that the detection unit 71 detects the driving allowed state for a predetermined operation. For example, it would be convenient for sound to be output from the mobile phone 10 when the user performs an operation related to sound, such as adjusting the volume. Therefore, the mobile phone 10 may be configured so that the detection unit 71 detects the driving allowed state by, for example, registering a predetermined operation in the operation detection unit in advance.

The detection unit 71 may also use the stand 82 as a detection mechanism. For example, when the stand 82 is housed in the housing 20, the detection unit 71 may recognize that sound is not being output using the piezoelectric element 61 and may detect the driving denied state. Conversely, when the stand 82 has been extended from the housing 20, the detection unit 71 may recognize that sound is being output using the piezoelectric element 61 and may detect the driving allowed state. Hence, the detection unit 71 can detect the two states using a variety of detection mechanisms.

In Embodiment 4, the mobile phone 10 has been described as including the speaker 41, yet the mobile phone 10 need not include the speaker 41. In this case, the mobile phone 10 causes sound to be emitted by applying a sound signal to the piezoelectric element 61 when the detection unit 71 detects the driving allowed state and does not apply a sound signal, thereby not causing sound to be emitted, when the detection unit 71 detects the driving denied state. In this way, when the mobile phone 10 does not include the speaker 41, the number of components can be reduced as compared to a mobile phone with a dynamic speaker configuration, thereby achieving a mobile phone 10 with a simple structure having few components. Therefore, the mobile phone 10 can be further reduced in size.

In Embodiments 5 and 6 and the modifications in FIGS. 52A to 52C, the cap 63 may be omitted from the piezoelectric vibrator 60, so that the end surface of the laminated piezoelectric element 61 contacts the contact surface directly or with a vibration transmission member, formed from an insulating member or the like, therebetween. The piezoelectric element is not limited to the above-described stack-type laminated piezoelectric element. A unimorph, bimorph, or laminated bimorph element may be used. FIG. 53 schematically illustrates the structure of the main parts when using bimorph. Bimorph 65 is shaped as an elongated rectangle, with one surface 65*a* exposed at the lateral side 20*d* of the housing 20, and the edges of the rectangle held by the holding unit 100. The holding unit 100 includes an opening 101*e* that holds the bimorph 65, and the inner surface of the opening 101*e* towards a back side 65*b* of the bimorph 65 is curved. With this structure, when the housing 20 is attached magnetically to the contact surface, the bimorph 65 is pressed against the contact surface by a magnetic force. By driving the bimorph 65 with a playback sound signal in the state, the bimorph 65 undergoes bending (flexure) vibration. In this way, the vibration of the bimorph 65 is transmitted to the contact surface, and the contact surface functions as a vibration speaker, causing playback sound to be emitted from the contact surface. Note that a covering layer of polyurethane or the like may be formed on the surface 65*a* of the bimorph 65. Furthermore, the bimorph 65 may be pressed directly against the contact surface, or an intermediate member may be joined to the surface 65*a* of the bimorph 65 so that the bimorph 65 is pressed against the contact surface with the intermediate member therebetween.

Furthermore, in FIG. 36, a LPF having the same characteristics as the LPF 123 may be provided between the signal processing circuit 121 and the booster circuit 122. In FIG. 36, the LPF 123 may also be omitted by providing an equalizer of the signal processing circuit 121 or the like with the functions of the LPF 123.

Figure 58A:
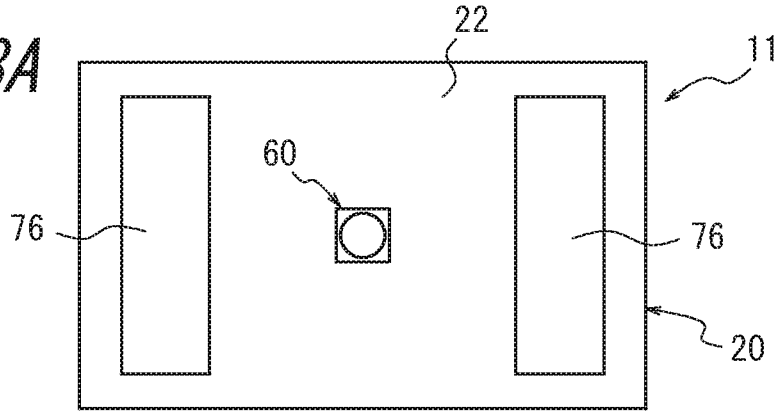
FIG. 58A illustrates another example of arrangement of permanent magnets.
Figure 58B:
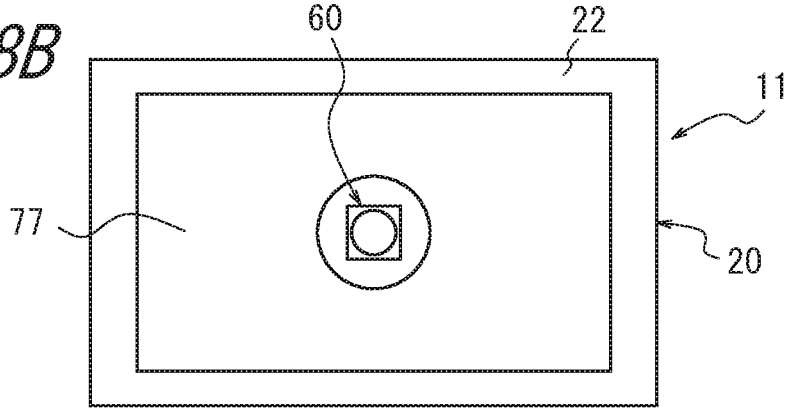
FIG. 58B illustrates another example of arrangement of a permanent magnet.
Figure 58C:
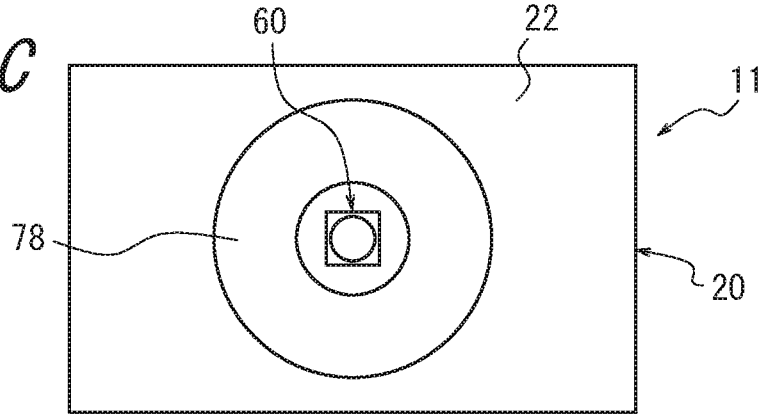
FIG. 58C illustrates another example of arrangement of a permanent magnet.

The number of permanent magnets for attaching the housing 20 is not limited to four and may be any number. For example, as illustrated in FIG. 58A, two rod-shaped permanent magnets 76 may be mounted on the sides of the bottom cover 22 at positions symmetrical with respect to the piezoelectric vibrator 60. In this case, as in the case described in Embodiment 5, in order to obtain an attaching force of 0.533 kgf or more when the weight of the sound generator 11 is 100 g and the sound generator 11 is attached to a vertical contact surface, then when using ferrite magnets, a rectangular column shape having height by width by thickness dimensions of 22 mm×22 mm×5 mm is preferably adopted. In this case, an attaching force of 0.535 kgf is obtained. As illustrated in FIG. 58B, one hollow permanent magnet 77, rectangular on the outside, may be mounted so that the piezoelectric vibrator 60 is positioned in the center of the hollow portion. As illustrated in FIG. 58C, one ring-shaped permanent magnet 78 may also be mounted so that the piezoelectric vibrator 60 is positioned in the center of the hollow portion. Three permanent magnets may also be mounted in a symmetrical positional relationship with respect to the piezoelectric vibrator 60 on the bottom face 20*e* of the housing 20 in order to attach the sound generator 11 to the contact surface at three points.

Furthermore, instead of exposing the permanent magnets on the bottom face 20*e* of the housing 20, the permanent magnets may be mounted on the inner side of the bottom cover 22, i.e. inside the housing 20. In this case, in accordance with the amount of projection of the piezoelectric vibrator 60, a spacer with an appropriate thickness, formed from a magnetic or nonmagnetic body, is preferably provided on the bottom face 20*e*. The sound generator 11 is not limited to using permanent magnets, and vibration of the piezoelectric vibrator 60 may be transmitted to the contact surface by holding the sound generator 11 to the contact surface with a known, removable attachment member, such as a hook and loop fastener or the like.

In the description of the above embodiments, a cap is inserted on the other end of the laminated piezoelectric element, yet the present disclosure is not limited to this case. For example, such a cap need not be used on the other end of the laminated piezoelectric element.

In the description of the above embodiments, the laminated piezoelectric element is fixed within a slit of the holding unit in the housing by adhesive (for example, epoxy resin), yet the present disclosure is not limited to this case. For example, instead of adhesive, a method may be adopted to fix the laminated piezoelectric element by opening a slit in an elastic body such as silicon rubber or the like and pushing the laminated piezoelectric element into the slit.

The above embodiments and modifications may be combined in any way that does not exceed the scope of the present disclosure.

Furthermore, in FIG. 46, a LPF having the same characteristics as the LPF 123 may be provided between the signal processing circuit 121 and the booster circuit 122. In FIG. 46, the LPF 123 may also be omitted by providing an equalizer of the signal processing circuit 121 or the like with the functions of the LPF 123.

In the above embodiment, an example of the piezoelectric vibrator 60*a* and the piezoelectric vibrator 60*b* being disposed on the bottom face 20*e* of the housing 20 and protruding from the bottom face 20*e* has been described, yet the present disclosure is not limited in this way. Depending on the dimensions of the housing 20 and the dimensions of the piezoelectric vibrator 60*a* and piezoelectric vibrator 60*b*, the piezoelectric vibrator 60*a* may, for example, protrude from the side of the housing or from the battery lid.

In the above embodiment, the vibration speaker 12 is described as an example of a sound generator, and the vibration speaker 12 functions as an anchor, yet the anchor is not limited in this way. For example, a sound generator may be configured with any of a wide variety of electronic devices serving as an anchor, such as a mobile phone, a portable music player, a tabletop television, a telephone conferencing system, a notebook computer, a projector, a hanging clock or hanging television, an alarm clock, or a photo frame. The anchor is not limited to an electronic device and may, for example, be a vase, a chair, or the like. Furthermore, the present disclosure is not limited to a sound generator and may also be configured as a piezoelectric vibrator for a sound generator, the piezoelectric vibrator including a piezoelectric element, or as a sound generation system provided with a sound generator and a contacted member that has a contact surface contacted by the sound generator. These configurations are also to be understood as within the scope of the present disclosure.

(Modification 1)

Figure 59:
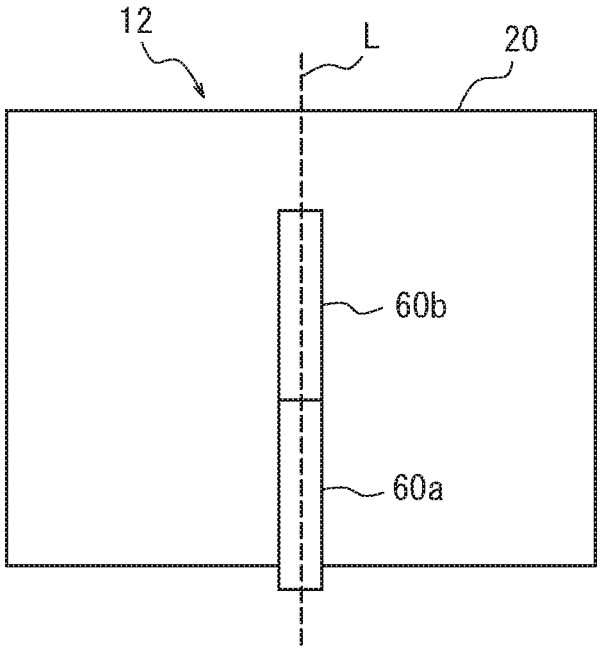
FIG. 59 is a schematic cross-sectional view of a vibration speaker that is a modification to a sound generator according to the present disclosure.

Next, with reference to FIG. 59, Modification 1 to the sound generator according to Embodiment 7 is described. FIG. 59 is a schematic cross-sectional view of the vibration speaker that is Modification 1 to a sound generator according to the present disclosure. The following only describes the differences from Embodiment 7.

As illustrated in FIG. 59, in the vibration speaker 12 according to Modification 1, the piezoelectric vibrator 60*a* and the piezoelectric vibrator 60*b* are disposed towards the bottom face of the housing 20 on a virtual line L parallel to the expansion and contraction direction of the piezoelectric elements that form the piezoelectric vibrator 60*a* and the piezoelectric vibrator 60*b*.

The sound generator according to Modification 1 thus includes two piezoelectric vibrators, the piezoelectric vibrator 60*a* and the piezoelectric vibrator 60*b*, on a virtual line parallel to the expansion and contraction direction of the piezoelectric elements forming the piezoelectric vibrator 60*a* and the piezoelectric vibrator 60*b*. Hence, as compared to the case of only one piezoelectric vibrator, the stroke can be doubled, and the output power can be the same.

(Modification 2)

Figure 60:
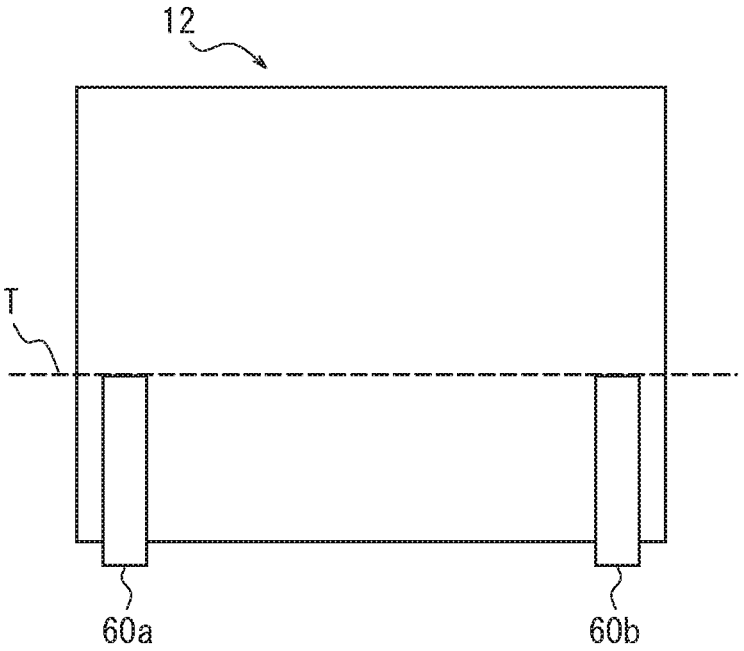
FIG. 60 is a schematic cross-sectional view of a vibration speaker that is a modification to a sound generator according to the present disclosure.

Next, with reference to FIG. 60, Modification 2 to the sound generator according to Embodiment 7 is described. FIG. 60 is a schematic cross-sectional view of a vibration speaker that is Modification 2 to the sound generator according to Embodiment 7. The following only describes the differences from Embodiment 7.

As illustrated in FIG. 60, in the vibration speaker 12 according to Modification 2, the piezoelectric vibrator 60*a* and the piezoelectric vibrator 60*b* are disposed towards the bottom face of the housing 20 on a virtual plane T perpendicular to the expansion and contraction direction of the piezoelectric elements that form the piezoelectric vibrator 60*a* and the piezoelectric vibrator 60*b*, and the distance therebetween is greater than in the embodiment illustrated in FIG. 44. In other words, in Modification 2, the piezoelectric vibrator 60*a* and the piezoelectric vibrator 60*b* are disposed at the edges of the bottom face of the housing 20.

The sound generator according to Modification 2 thus includes two piezoelectric vibrators, the piezoelectric vibrator 60*a* and the piezoelectric vibrator 60*b*, on a virtual plane perpendicular to the expansion and contraction direction of the piezoelectric elements forming the piezoelectric vibrator 60*a* and the piezoelectric vibrator 60*b*. Hence, as compared to the case of only one piezoelectric vibrator, the stroke can be the same, and the output power can be doubled. Furthermore, since the piezoelectric vibrator 60*a* and the piezoelectric vibrator 60*b* are provided, stereo sound can be achieved by providing the vibrators respectively with right audio input and left audio input. Moreover, in Modification 2, the piezoelectric vibrator 60*a* and the piezoelectric vibrator 60*b* are disposed at the edges towards the bottom face of the housing 20, and therefore the quality of stereo sound can be improved as compared to the embodiment illustrated in FIG. 44.

(Modification 3)

Figure 61:
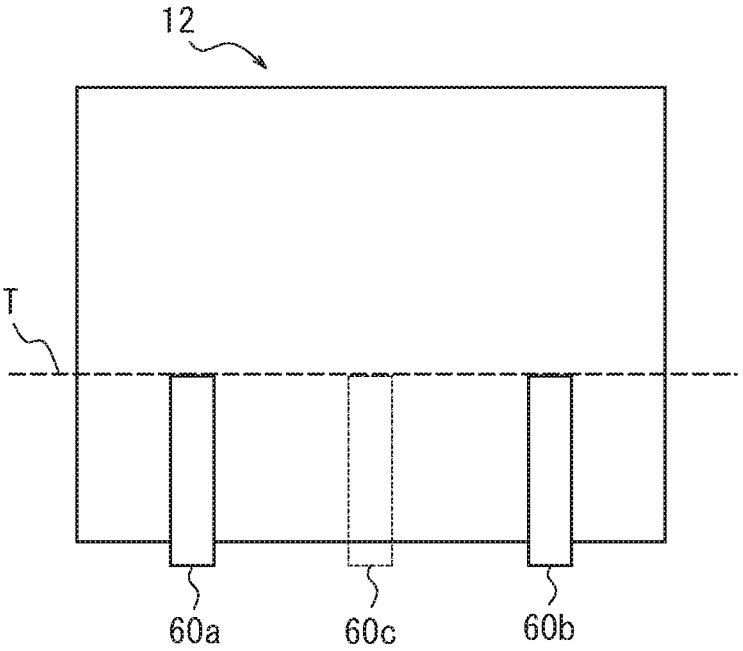
FIG. 61 is a schematic cross-sectional view of a vibration speaker that is a modification to a sound generator according to the present disclosure.
Figure 62:
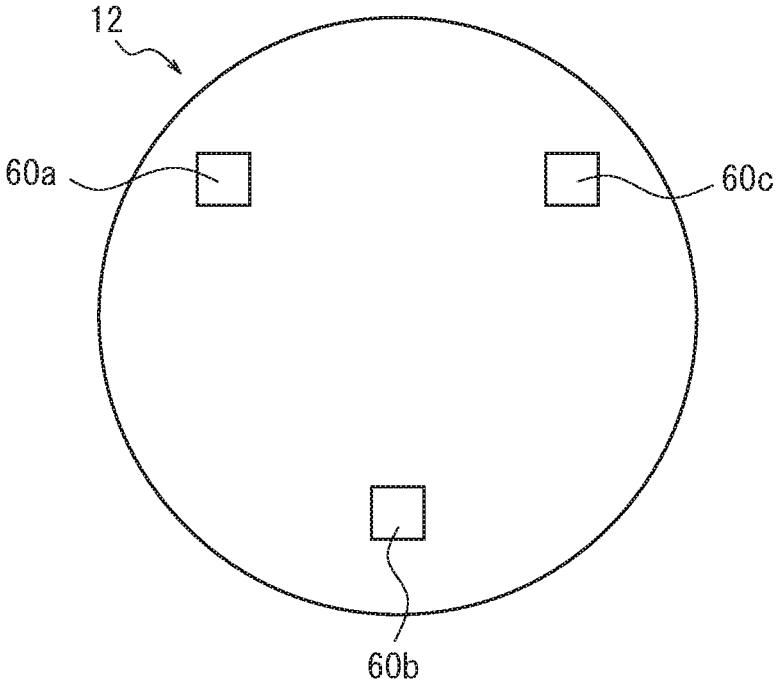
FIG. 62 is a schematic view of the bottom face of the vibration speaker in FIG. 16.

Next, with reference to FIGS. 61 and 62, Modification 3 to the sound generator according to Embodiment 7 is described. FIGS. 61 and 62 are schematic cross-sectional views of a vibration speaker that is Modification 3. The following only describes the differences from Embodiment 7.

As illustrated in FIGS. 61 and 62, the vibration speaker 12 according to Modification 3 includes three piezoelectric vibrators: piezoelectric vibrator 60*a*, piezoelectric vibrator 60*b*, and piezoelectric vibrator 60*c*. The piezoelectric vibrator 60*a*, piezoelectric vibrator 60*b*, and piezoelectric vibrator 60*c* are disposed towards the bottom face of the housing 20 on a virtual plane T perpendicular to the expansion and contraction direction of the piezoelectric elements that form the piezoelectric vibrator 60*a*, piezoelectric vibrator 60*b*, and piezoelectric vibrator 60*c*. In Modification 3, the piezoelectric vibrator 60*a*, piezoelectric vibrator 60*b*, and piezoelectric vibrator 60*c* are formed towards the bottom face of the housing 20 at positions corresponding to the vertices of an equilateral triangle. In the present disclosure, the positional relationship between the three piezoelectric vibrators is of course not limited to the case of forming vertices of an equilateral triangle, and any other appropriate positions may be adopted.

The sound generator according to Modification 3 thus includes three piezoelectric vibrators, the piezoelectric vibrator 60*a*, piezoelectric vibrator 60*b*, and piezoelectric vibrator 60*c* on a virtual plane perpendicular to the expansion and contraction direction of the piezoelectric elements forming the piezoelectric vibrator 60*a*, piezoelectric vibrator 60*b*, and piezoelectric vibrator 60*c*. Hence, as compared to the case of only one piezoelectric vibrator, the stroke can be the same, and the output power can be tripled. Since the piezoelectric vibrator 60*a*, piezoelectric vibrator 60*b*, and piezoelectric vibrator 60*c* can support the vibration speaker 12 at three points, the vibration speaker 12 can be supported stably without requiring another leg to prevent the vibration speaker 12 from falling over.

In Embodiment 7 and the modifications thereto, examples of two or three piezoelectric vibrators have been described, yet the sound generator of the present disclosure may include four or more piezoelectric vibrators. As described in Embodiment 1, the input voltage applied to each of the piezoelectric vibrators may be controlled by the control unit based on a frequency characteristic. As described in Embodiment 2, the voltage measurement unit may measure the output voltage that is based on the force that the piezoelectric element in each of the piezoelectric vibrators receives from the contact surface. In this case, the control unit may control the input voltage applied to each piezoelectric element based on the result of measurement. As in Embodiment 3, the piezoelectric vibrators may be protected by a cover. In this case, one cover may have a plurality of vibration units corresponding to the piezoelectric vibrators, or a plurality of covers may each have a vibration unit corresponding to one of the piezoelectric vibrators.

REFERENCE SIGNS LIST

10: Mobile phone
11: Sound generator
12: Vibration speaker
20: Body
20*a*: Bottom side
20*b*: Top side
20*c*: Surface
20*d*: Lateral side
20*e*: Bottom face
21: Battery lid
30: Panel
31: Line-in port
40: Input unit
41: Speaker
42: DC input terminal for charging
50: Display unit
60, 60*a*, 60*b*, 60*c*: Piezoelectric vibrator
61, 610*a*, 610*b*: Laminated piezoelectric element (piezoelectric element)
62: O-ring
63: Cap
64: Cover member
70: Elastic member
71: Detection unit
72: Proximity sensor
73: Inclination detection sensor
74: Vibration detection sensor
75: Permanent magnet
80: Battery pack
81: Camera unit
82: Stand
83: Leg
84: Attaching portion
90: Measurement unit
91: Microphone
92: Vibration detector
93: Switch
94: Cap
95: Constricted portion

96: Tapered portion
97: Cover
98: Vibration unit
99: Protrusion
100: Holding unit
101: Slit
102: Adhesive
110: Wireless communication unit
120: Piezoelectric element drive unit
121: Signal processing circuit
122: Booster circuit
123: Low pass filter (LPF)
124: Digital Signal Processor (DSP)
130: Control unit
140: Storage unit
150: Contact surface
160: Vibration transmission member
170: Mounting surface
180: Voltage measurement unit
190: Loudspeaker
195: Detection switch
900, 901: Holding unit
901*a*: End face

The invention claimed is:

1. A sound generator comprising:

a housing;

at least one piezoelectric vibrator including a piezoelectric element disposed within the housing; and a vibration unit which can be switched between a non-contact state not contacting the at least one piezoelectric vibrator and a contact state contacting the at least one piezoelectric vibrator, wherein while the vibration unit is in the contact state, the at least one piezoelectric vibrator generates vibration in response to a signal, and causes a contact surface contacted by the vibration unit to vibrate and generate a sound to be emitted from the contact surface.

2. The sound generator according to claim 1, wherein the at least one piezoelectric vibrator includes a cover member that vibrates the vibration unit by transmitting vibration due to deformation of the piezoelectric element to the vibration unit.

3. The sound generator according to claim 1, wherein the vibration unit includes a cover member that vibrates the contact surface by transmitting vibration due to the at least one piezoelectric vibrator to the contact surface.

4. A sound generator comprising:

a housing;

at least one piezoelectric vibrator including a piezoelectric element disposed within the housing;

a vibration unit in one of a non-contact state not contacting the at least one piezoelectric vibrator and a contact state contacting the at least one piezoelectric vibrator; and a cover, including the vibration unit, disposed displaceably in the housing, wherein while the vibration unit is in the contact state, the at least one piezoelectric vibrator generates vibration in response to a signal, and causes a contact surface contacted by the vibration unit to vibrate and generate a sound to be emitted from the contact surface, and at a first position, the cover places the vibration unit in the contact state, and at a second position, the cover places the vibration unit in the non-contact state and protects the at least one piezoelectric vibrator.

5. The sound generator according to claim 4, wherein the piezoelectric element is driven when the cover is in the first position and is not driven when the cover is in the second position.

* * * * *